US008135315B2

(12) United States Patent
Ozeki et al.

(10) Patent No.: US 8,135,315 B2
(45) Date of Patent: Mar. 13, 2012

(54) DEVELOPER REGULATING MEMBER IN A DEVELOPING UNIT, PROCESS CARTRIDGE INCLUDING SAME, AND IMAGE FORMING APPARATUS INCORPORATING SAME

(75) Inventors: Takamasa Ozeki, Yokohama (JP); Katsumi Masuda, Yokohama (JP); Yoshio Hattori, Kawasaki (JP); Hiroyuki Uenishi, Yokohama (JP); Yuji Suzuki, Tokyo (JP); Kyohta Koetsuka, Fujisawa (JP); Masayuki Ohsawa, Atsugi (JP); Yoshiyuki Takano, Hachioji (JP); Takeroh Kurenuma, Ebina (JP); Akira Azami, Yokohama (JP); Nobuyuki Taguchi, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 297 days.

(21) Appl. No.: 12/412,892

(22) Filed: Mar. 27, 2009

(65) Prior Publication Data

US 2009/0245882 A1 Oct. 1, 2009

(30) Foreign Application Priority Data

Mar. 28, 2008 (JP) ..... 2008-086083
Jun. 3, 2008 (JP) ..... 2008-145329
Sep. 22, 2008 (JP) ..... 2008-242840

(51) Int. Cl.
*G03G 15/09* (2006.01)
*G03G 15/095* (2006.01)

(52) U.S. Cl. ..... 399/274; 399/275; 399/277
(58) Field of Classification Search ..... 399/274, 399/275, 276
See application file for complete search history.

(56) References Cited

U.S. PATENT DOCUMENTS 5,321,473 A 6/1994 Azami
6,067,433 A * 5/2000 Kimura et al. ..... 399/274
6,266,507 B1 * 7/2001 Nagahama et al. ..... 399/274
6,697,593 B2 2/2004 Imamura et al.
6,751,433 B2 * 6/2004 Sugihara ..... 399/267
6,895,203 B2 5/2005 Ozeki et al.

(Continued)

FOREIGN PATENT DOCUMENTS

JP 2002-268353 9/2002

(Continued)

OTHER PUBLICATIONS

Machine translation of JP 2006023619 A.*

(Continued)

*Primary Examiner* — David Gray
*Assistant Examiner* — David Bolduc
(74) *Attorney, Agent, or Firm* — Oblon, Spivak, McClelland, Maier & Neustadt, L.L.P.

(57) ABSTRACT

A developing unit includable in a process cartridge and in an image forming apparatus includes a developer bearing member including a magnetic field generator and a nonmagnetic hollow member, a developer container, an agitation/conveyance member, a developer regulating member to regulate the thickness of a layer of the two-component developer. The magnetic field generator has first and second magnetic poles to generate respective magnetic forces for removing the developer from the developer bearing member after the developer passes the development region. The second magnetic pole generates a magnetic force to attract the developer to form a magnetic brush on the developer bearing member. The developer regulating member includes a magnetic member outwardly disposed on an exterior perimeter surface of the developer bearing member upstream from the developer regulating member, and one planar surface of the magnetic member faces the second magnetic pole across an effective development region.

20 Claims, 22 Drawing Sheets

U.S. PATENT DOCUMENTS

| | | | | |
|---|---|---|---|---|
| 6,898,406 | B2 | 5/2005 | Suzuki et al. | |
| 6,904,244 | B2 | 6/2005 | Azami et al. | |
| 7,003,235 | B2 | 2/2006 | Azami et al. | |
| 7,043,182 | B2 * | 5/2006 | Sakai et al. | 399/284 |
| 7,095,971 | B2 | 8/2006 | Ozeki et al. | |
| 7,116,932 | B2 * | 10/2006 | Takeuchi et al. | 399/274 |
| 7,184,691 | B2 | 2/2007 | Kita et al. | |
| 7,189,338 | B2 | 3/2007 | Kamoi et al. | |
| 7,203,450 | B2 | 4/2007 | Kakegawa et al. | |
| 7,283,774 | B2 | 10/2007 | Ozeki et al. | |
| 7,352,983 | B2 | 4/2008 | Kamiya et al. | |
| 7,366,454 | B2 | 4/2008 | Nakamura et al. | |
| 7,466,945 | B2 | 12/2008 | Hattori | |
| 7,474,867 | B2 | 1/2009 | Ozeki et al. | |
| 2004/0114971 | A1 * | 6/2004 | Sakai et al. | 399/284 |
| 2006/0034642 | A1 | 2/2006 | Taguchi et al. | |
| 2007/0104516 | A1 | 5/2007 | Katoh et al. | |
| 2007/0122205 | A1 | 5/2007 | Taguchi et al. | |
| 2007/0127952 | A1 * | 6/2007 | Terashima et al. | 399/277 |
| 2007/0140747 | A1 | 6/2007 | Kita et al. | |
| 2007/0147900 | A1 | 6/2007 | Taguchi et al. | |
| 2007/0147902 | A1 | 6/2007 | Taguchi et al. | |
| 2007/0154243 | A1 | 7/2007 | Taguchi et al. | |
| 2007/0154244 | A1 | 7/2007 | Taguchi et al. | |
| 2007/0160393 | A1 | 7/2007 | Taguchi et al. | |
| 2007/0160394 | A1 | 7/2007 | Taguchi et al. | |
| 2007/0170211 | A1 | 7/2007 | Hattori | |
| 2007/0177886 | A1 | 8/2007 | Taguchi et al. | |

FOREIGN PATENT DOCUMENTS

| | | | |
|---|---|---|---|
| JP | 2002341646 | A * | 11/2002 |
| JP | 3382541 | | 12/2002 |
| JP | 2006-23619 | | 1/2006 |
| JP | 2006023619 | A * | 1/2006 |
| JP | 2006-71730 | | 3/2006 |
| JP | 2007-147682 | | 6/2007 |
| JP | 2007-183533 | | 7/2007 |
| JP | 4003411 | | 8/2007 |

OTHER PUBLICATIONS

Machine translation of JP 2002341646 A.*

U.S. Appl. No. 12/412,019, filed Mar. 26, 2009, Koetsuka, et al.

* cited by examiner

DEVELOPER REGULATING MEMBER IN A DEVELOPING UNIT, PROCESS CARTRIDGE INCLUDING SAME, AND IMAGE FORMING APPARATUS INCORPORATING SAME

CROSS-REFERENCE TO RELATED APPLICATIONS

The present invention claims priority pursuant to 35 U.S.C. §119 from Japanese Patent Application No. 2008-086083, filed on Mar. 28, 2008 in the Japan Patent Office, Japanese Patent Application No. 2008-145329, filed on Jun. 3, 2008 in the Japan Patent Office, and Japanese Patent Application No. 2008-242840, filed on Sep. 22, 2008 in the Japan Patent Office, the contents and disclosures of each of which are hereby incorporated by reference herein in their entirety.

BACKGROUND OF THE INVENTION

1. Field of the Invention

Exemplary embodiments of the present invention generally relate to a developing unit containing a two-component developer including magnetic carrier particles and toner particles, a process cartridge including the developing unit, and an image forming apparatus, such as a copier, printer, facsimile machine, and the like, incorporating the developing unit.

2. Discussion of the Related Art

Developing units that develop toner images for electrophotographic printing generally employ either a one-component developer or a two-component developer. While the one-component developer includes toner particles only, the two-component developer includes toner particles and magnetic carrier particles.

Such developing units include a developer bearing member for bearing the developer to convey it to a development region where the developer bearing member faces an image bearing member. The developer bearing member may include a cylindrical development sleeve, for example, constituted as a hollow cylinder the interior of which contains a magnetic field generator capable of generating a magnetic field sufficient to hold the magnetic carrier particles of the developer on the exterior perimeter surface of the development sleeve. Toner particles are then electrostatically attracted to the magnetic carrier particles. As the development sleeve rotates, the toner particles attached to the magnetic carrier particles that are held on the exterior perimeter surface of the development sleeve are conveyed to the development region and then supplied to a latent image formed on a surface of the image bearing member at the development region.

The magnetic field generator has multiple magnetic poles along a direction of rotation of the development sleeve. Examples of such magnetic field generator are a roller-shaped member having magnetic pole-forming parts magnetized by external magnetic fields, a member in which multiple magnets are held by a common holding member so that each of the magnets faces a given direction, and the like.

Developer carried on the exterior perimeter surface of the development sleeve by the magnetic force generated by the magnetic field generator is conveyed in a direction of movement of the surface of the development sleeve as the development sleeve rotates.

FIG. 1 illustrates a schematic configuration of an example of a generally known developing unit 1214, and more specifically an end-on or lateral cross-sectional view thereof. Broken lines in FIG. 1 shows distribution of magnetic flux density (absolute value) in a direction normal to a surface of a developer bearing member. This conventional developing unit 1214 is hereinafter referred to as a first conventional developing unit 1214.

The first conventional developing unit 1214 includes a developer roller 1240 that serves as a developer bearing member and includes an outer development sleeve 1241 serving as a nonmagnetic hollow body and an inner magnetic roller 1247 serving as a magnetic field generator. That is, the developer roller 1240 is formed by the hollow cylindrical development sleeve 1241 made of some non-magnetic material surrounding the magnetic roller 1247, so as to hold developer on an exterior perimeter surface of the development sleeve 1241 by a magnetic force generated by the magnetic roller 1247.

The developing unit 1214 further includes a developer container 1249 for containing developer, screw-shaped agitation/conveyance members 1242 and 1243 for agitating and conveying the developer axially along a direction of a rotary shaft of the development sleeve 1241, and a developer regulating member 1246 for regulating the thickness of a layer of developer carried on the development sleeve 1241.

The developer container 1249 is separated in a first container (i.e., a developer storing chamber) 1249A and a second container (i.e., a developer agitating chamber) 1249B. The first container 1249A is positioned lower than the development sleeve 1241 and extends in an axial direction of the development sleeve 1241. The second container 1249B is disposed adjacent the first container 1249A and also extends in the axial direction of the development sleeve 1241. The first container 1249A includes the agitation/conveyance member 1242 and the second container 249B includes the agitation/conveyance member 1243 that rotates in a direction indicated by arrow "R1" in FIG. 1. The agitation/conveyance member 1243 conveys the developer to a downstream end of the first container 1249A, which corresponds to a far or distal side in FIG. 1. The developer is then conveyed to the second container 1249B through a space or opening where the first container 1249A and the second container 1249B meet and are communicably coupled together. In the second container 1249B, the agitation/conveyance member 1242 conveys the developer to a downstream end of the second container 1249B, which corresponds to a near or proximal side in FIG. 1. Thus, the developer is circulated or recirculated within the developer container 1249.

Toner is generally supplied from a toner bottle, not shown, to the second container 1249B for replenishment, that is, replacing an amount of toner consumed for development. During conveyance of the developer, the magnetic force generated by the magnetic roller 1247 scoops up, or attracts, the developer contained in the first container 1249A, which is then supplied to the development sleeve 1241. Then, the thickness of the layer of thus-supplied developer on the development sleeve 1241 is regulated by the developer regulating member 1246, and the developer passes the development region facing an image bearing member 1012, and returns to the developer container 1249.

The magnetic roller 1247 includes five magnetic poles, which are a magnetic pole S1 for development, a magnetic pole N1 for conveyance, a magnetic pole S2 for developer release at an upstream portion, a magnetic pole S3 for developer release and attraction, and a magnetic pole N2 for regulation. Where the magnetic poles S1, S2, and S3 are implemented as south poles, for example, the magnetic poles N1 and N2 are implemented as north poles, for example.

As the development sleeve 1241 rotates in a direction indicated by arrow "R2" in FIG. 1, the developer held on the development sleeve 1241 is conveyed and then passes by positions facing the magnetic pole S3, the magnetic pole N2, the magnetic pole S1, the magnetic pole N1, and the magnetic pole S2, in this order. After passing the development region, most of the toner particles of the developer are consumed for developing toner images. Therefore, the developer is released or removed from the development sleeve 1241 to return to the developer container 1249 so that new developer can be constantly attracted to the development sleeve 1241. This action is important to provide stable development ability. That is, this action is important to prevent developer carryover or residual retention, in which developer with fewer toner particles remains on the development sleeve 1241 even post-development to be conveyed continuously to the development region again.

When the magnetic pole S2 and the magnetic pole S3 having an identical polarity are disposed adjacent to each other, a developer-releasing region P is formed between the magnetic poles S2 and S3 in the developing unit 1214 shown in FIG. 1 that exerts a release force to cause the developer carried by the development sleeve 1241 to move away from the development sleeve 1241 and toward the first container 1249A of the developer container 1249. That is, the magnetic force generated by the magnetic poles S2 and S3 releases the developer from the development sleeve 1241 in the developer-releasing region P, so that the developer is removed from the development sleeve 1241 and mixed with the developer in the first container 1249A of the developer container 1249.

The first conventional developing unit 1214 shown in FIG. 1 has a polarity inversion point Q on the development sleeve 1241, located within a region extending from the developer-releasing region P to a regulation region where the developer regulating member 1246 regulates the developer attracted to the development sleeve 1241 by the magnetic force generated by the magnetic pole S3. Developer density is high around the polarity inversion point Q because the magnetic force exerted on the developer is relatively strong and a magnetic flux density in a direction normal to the development sleeve 1241 is too small to form a magnetic brush. Accordingly, even if some developer remains on the development sleeve 1241 without being removed therefrom in the developer-releasing region P, such residual developer can be released or scraped off by the high-density developer held in the vicinity of the polarity inversion point Q. For this reason, this conventional developing unit 1214 can effectively prevent developer carryover.

However, such a continuous high-density state of developer in the vicinity of the polarity inversion point Q imposes a constant mechanical stress on the developer particles, causing them to deteriorate. Therefore, an amount of torque to drive the agitation/conveyance member 1243 of the first container 1249A has to be increased and the agitation/conveyance member 1243 has to be more rigid in strength and larger in size, which can lead to an increase both in cost and in size of the first conventional developing unit 1214.

Further, since the developer is subject to a great amount of stress, a speed of progression of implantation of external additives from the toner into the surface of each carrier particle and abrasion of a surface layer film of each carrier particle, both of which are undesirable, may be accelerated. These actions easily can degrade toner chargeability and powder flowability of developer, which in turn can make it difficult to maintain good image quality over an extended period of time. Since the powder properties of developer can degrade easily, an amount of developer conveyed to the development region may decrease especially when the ability of the development sleeve 1241 to convey developer has deteriorated, and good image quality cannot be maintained for an extended period of time.

FIG. 2 illustrates a schematic configuration of another example of a generally known developing unit 1314. This known developing unit 1314 is referred to as a second conventional developing unit 1314. The second conventional developing unit 1314 reduces an amount of stress on the developer. The second conventional developing unit 1314 shown in FIG. 2 is similar to the first conventional developing unit 1214 shown in FIG. 1, except that a single magnetic pole capable of performing removal, attraction, and regulation of developer simultaneously is provided in the vicinity of a developer regulating member 1346, instead of the known magnetic poles S3 and N2 shown in FIG. 1.

Similar to the first conventional developing unit 1214, the second conventional developing unit 1314 includes a developer roller 1340 that serves as a developer bearing member and is disposed facing the image bearing member 1012, and includes an outer development sleeve 1341 serving as a non-magnetic hollow body and an inner magnetic roller 1347 serving as a magnetic field generator. The developing unit 1314 further includes a developer container 1349 for containing developer, screw-shaped agitation/conveyance members 1342 and 1343, and the developer regulating member 1346 for regulating the thickness of a layer of developer carried on the development sleeve 1341 that rotates in a direction indicated by arrow "R2" in FIG. 2. The developer container 1349 is separated into a first container (i.e., a developer storing chamber) 1349A and a second container (i.e., a developer agitating chamber) 1349B.

According to the second conventional developing unit 1314 shown in FIG. 2, the developer that cannot be attracted by the magnetic force of the magnetic pole N3 may fall to the agitation/conveyance screw 1343 (which rotates in a direction indicated by arrow "R1" in FIG. 2) in a region upstream from the regulation region where the developer regulating member 1346 regulates the thickness of a layer of developer in a direction of conveyance of developer by the development sleeve 1341 of the developing roller 1340. (Hereinafter, "upstream" and "downstream" indicate an upstream side and downstream side from a given specific position in a direction of conveyance of developer by the development sleeve 1341, respectively.) Such an arrangement prevents a large body of developer from accumulating in the region, thereby reducing the stress on the developer.

Further, yet another example of a known developing unit in which the above-described magnetic pole N3 is disposed adjacent a developer regulating member is disclosed. This known developing unit also can reduce the amount of stress on the developer and for the same reasons as described above. This known developing unit is referred to as a third conventional developing unit.

Further, yet another example of a known developing unit includes a developer regulating member and a cooling unit. This known developing unit is referred to as a fourth conventional developing unit. The developer regulating member of the fourth conventional developing unit is a hollow metallic member, extending in a direction perpendicular to a direction of movement of the surface of the developer bearing member. The cooling unit cools the developer regulating member from the interior of the hollow member so as to reduce an increase in temperature of developer in the vicinity of the developer regulating member.

However, a problem arises in the second conventional developing unit 1341 and the third conventional developing units. In these conventional developing units, a decrease in accumulation of developer in a region upstream from the regulation region where the developer regulating member 1346 is disposed can and has caused uneven image density, a matter on which the present inventors have conducted extensive research to determine why the accumulated developer causes such unevenness in image density.

Specifically, after image development is performed in the second conventional developing unit 1314 and the third conventional developing unit, the developer on the development sleeve 1341 is removed therefrom at the developer-releasing region P. The developer released at the developer-releasing region P then falls onto other developer contained in a first container or developer storing chamber 1349A of a developer container 1349, and is then conveyed parallel to the development sleeve 1341 in an axial direction of the development sleeve 1341 in the first container 1349A while the agitation/conveyance screw 1343 agitates both the pre- and post-development developers.

The post-development developer can be attracted by the magnetic force generated by the magnetic pole N3 immediately after falling onto the stored developer in the first container 1349A. Since the post-development developer that has just fallen from the development sleeve 1341 is not sufficiently mixed and agitated with the stored developer, any developer attracted thereafter may include both developer with a low toner density as well as developer with a high toner density when conveyed to the regulation region.

Different from the second conventional developing unit 1314 shown in FIG. 2, in the first conventional developing unit shown in FIG. 1, high-density developer accumulates in a region in the vicinity of the polarity inversion point Q, which is located upstream from the regulation region. The attracted developer is then mixed with the accumulated developer, now highly stressed, when passing the region of developer accumulation. Therefore, even if the post-development developer is scooped up when not mixed sufficiently with other developer, any difference in toner densities of the developers may be erased in the region where the developer accumulates, and therefore unevenness in image density is not likely to occur or occurs less often.

However, since developer does not accumulate in the region located on the upstream side of the regulation region in the configuration shown in FIG. 2, which corresponds to the second and third conventional developing units, differences in toner density of the developers may not be erased even in the developer accumulation region. Therefore, if the post-development developer is scooped up immediately after falling onto the stored developer in the first container 1349A of a developer container 1349, the scooped developer includes both developer with a low toner density as well as developer with a high toner density as discrete, separate streams or portions when conveyed to the development region via the regulation region, which can easily cause fluctuations in output image density.

SUMMARY OF THE INVENTION

Exemplary aspects of the present invention have been made in view of the above-described circumstances.

Exemplary aspects of the present invention provide a novel developing unit that can effectively decrease mechanical stress on developer in a region of a developer regulating member on which a height or thickness of the developer is regulated and reduce nonuniformity in image density.

Another exemplary aspect of the present invention provides a process cartridge that includes the above-described novel developing unit.

Another exemplary aspect of the present invention provides an image forming apparatus that incorporates the above-described novel developing unit.

In one exemplary embodiment, a novel developing unit includes a developer bearing member including a magnetic field generator and a nonmagnetic hollow body containing the magnetic field generator for bearing a two-component developer including magnetic carrier particles and toner particles on an exterior perimeter surface thereof by a magnetic force generated by the magnetic field generator, a developer container disposed adjacent to the developer bearing member and including a developer storing chamber to store the two-component developer therein, an agitation/conveyance member disposed in the developer container to convey the two-component developer in an axial direction of the developer bearing member while agitating the two-component developer, and a developer regulating member disposed opposite the developer bearing member to regulate the thickness of a layer of the two-component developer held on the developer bearing member. The two-component developer conveyed in the developer container is attracted by the magnetic force exerted by the magnetic field generator to the developer bearing member, is regulated by the developer regulating member, then passes through a development region of the development bearing member facing an image bearing member, and returns to the developer container. The magnetic field generator includes first and second magnetic poles with an identical polarity disposed adjacent to each other and downstream from the development region in a direction of rotation of the developer bearing member to generate respective magnetic forces for removing the two-component developer from the developer bearing member after the developer passes through the development region. The second magnetic pole is disposed downstream from the first magnetic pole in a direction of conveyance of developer by the developer bearing member and proximate to the developer regulating member to generate a magnetic force to attract the two-component developer from the developer storing chamber in the developer container for forming a magnetic brush of the two-component developer on the developer bearing member regulated by the developer bearing member. The developer regulating member includes a base member and a thin plate magnetic member projecting outwardly from the base member toward an exterior perimeter surface of the developer bearing member upstream from the developer regulating member in a direction of conveyance of developer by the developer bearing member, one planar surface of the magnetic member facing the second magnetic pole across an effective development region.

The magnetic member may be fixedly mounted on the developer regulating member.

The magnetic member may include a first face disposed to face the second magnetic pole and a second face to adhere to the base member of the developer regulating member. The second face may be fixedly adhered to the base member on one side which faces an upstream side in a direction of conveyance of developer by the developer bearing member.

The magnetic member may be disposed at a position spaced away from the developer regulating member.

The magnetic member may include a hollow body defining an interior hollow region therein extending in the axial direction of the developer bearing member, with a surface of the thin plate disposed facing the second magnetic pole. The magnetic member may be cooled by exhausting heat in the hollow region inside the hollow body of the magnetic member to outside the hollow region.

The magnetic member may be disposed such that an upstream end part of the planar surface of the magnetic member in a direction of conveyance of developer by the developer bearing member is located upstream from a normal line to a local maximum point of a normal component of a magnetic flux density of the second magnetic pole to the developer bearing member.

The developer regulating member may be disposed such that an upstream end part of the developer regulating member in a direction of conveyance of developer by the developer bearing member is located downstream from a normal line to a local maximum point of a normal component of a magnetic flux density of the second magnetic pole to the developer bearing member.

The developer regulating member may include a nonmagnetic material.

The developer regulating member may be disposed in a vertically downward direction with respect to the developer bearing member.

The above-described developing unit may further include a seal member disposed between the developer bearing member and the agitation/conveyance member and held in contact with an inner wall of the developing unit to seal the developer container where the agitation/conveyance member is disposed, and a retaining member disposed at one side of the developing member to retain the seal member so that the seal member can be pulled out from the developing unit in an axial direction of the developer bearing member to closely contact the seal member against the inner wall of the developing unit.

The seal member may include a planar member.

Further, in one exemplary embodiment, a novel developing unit includes a magnetic field generator, a developer bearing member including a nonmagnetic hollow body containing the magnetic field generator for bearing a two-component developer including magnetic carrier particles and toner particles on an exterior perimeter surface thereof by a magnetic force generated by the magnetic field generator, a developer container disposed adjacent to the developer bearing member and including a developer storing chamber to store the two-component developer therein, an agitation/conveyance member disposed in the developer container to convey the two-component developer in an axial direction of the developer bearing member while agitating the two-component developer, and a developer regulating member disposed opposite the developer bearing member to regulate the thickness of a layer of the two-component developer held on the developer bearing member. The two-component developer conveyed in the developer container is attracted by the magnetic force exerted by the magnetic field generator to the developer bearing member, is regulated by the developer regulating member, then passes through a development region of the developer bearing member facing an image bearing member, and returns to the developer container. The magnetic field generator includes first and second magnetic poles with an identical polarity disposed adjacent to each other and downstream from the development region in a direction of rotation of the developer bearing member to generate respective magnetic forces for removing the two-component developer from the developer bearing member after the developer passes through the development region. The second magnetic pole is disposed downstream from the first magnetic pole in a direction of conveyance of developer by the developer bearing member and proximate to the developer regulating member to generate a magnetic force to attract the two-component developer from the developer storing chamber in the developer container for forming a magnetic brush of the two-component developer on the developer bearing member regulated by the developer bearing member. The developer regulating member includes a magnetic member outwardly disposed on an exterior perimeter surface of the developer bearing member upstream from the developer regulating member in a direction of conveyance of developer by the developer bearing member, one surface of the magnetic member facing the second magnetic pole across an effective development region. The magnetic member is disposed such that a line normal to an opposing face of the magnetic member facing the second magnetic pole is substantially parallel to a line tangential to a region on the developer bearing member where a magnetic flux density of the second magnetic pole in the normal direction exists.

The magnetic member may include a hollow body defining an interior hollow region therein extending in the axial direction of the developer bearing member. The magnetic member being cooled by exhausting heat in the hollow region inside the hollow body of the magnetic member to outside the hollow region.

The magnetic member may be held in contact with the developer bearing member.

The above-described novel developing unit may further include a seal member disposed between the developer bearing member and the agitation/conveyance member and held in contact with an inner wall of the developing unit to seal the developer container where the agitation/conveyance member is disposed, and a retaining member disposed at one side of the developing member to retain the seal member so that the seal member can be pulled out from the developing unit in an axial direction of the developer bearing member to closely contact the seal member against the inner wall of the developing unit.

The seal member may include a planar member.

Further, in one exemplary embodiment, a novel process cartridge, detachably attachable to an image forming apparatus, includes an image bearing member to bear an image on a surface thereof, and the above-described developing unit. The image bearing member and the developing unit are integrally supported by the process cartridge. The developing unit is disposed facing the image bearing member to convey and adhere the two-component developer to the image to develop a toner image to be transferred from the image bearing member onto a recording medium.

Further, in one exemplary embodiment, a novel image forming apparatus includes an image bearing member to bear an image on a surface thereof, and the above-described developing unit. The developing unit is disposed facing the image bearing member to convey and adhere the two-component developer to the image to develop a toner image to be transferred from the image bearing member onto a recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
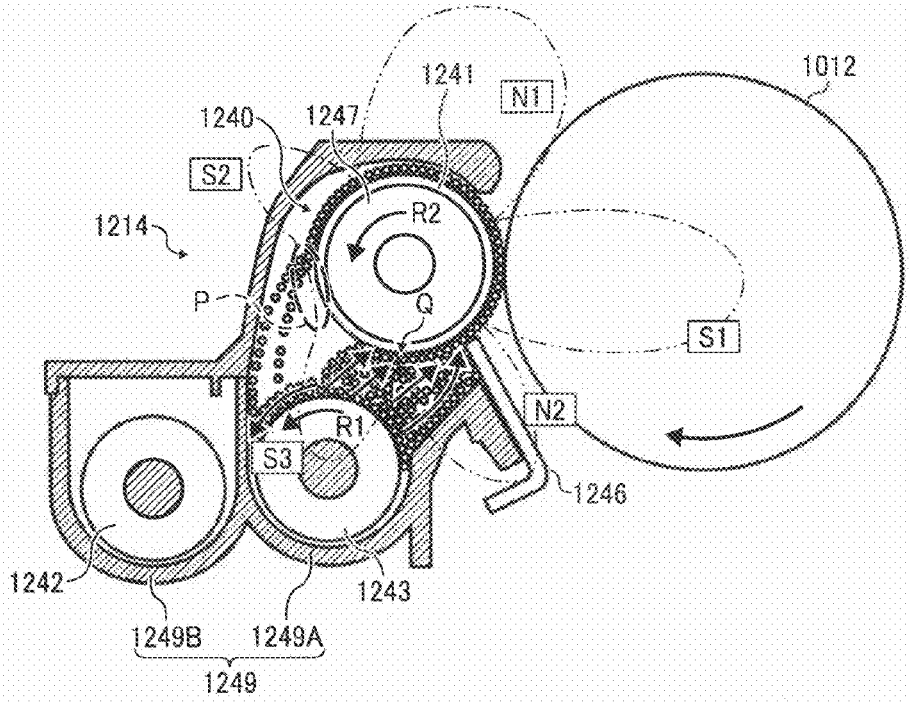
FIG. 1 BACKGROUND ART
FIG. 1 is a cross-sectional view of a schematic configuration of an example of a generally known developing unit.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

First Exemplary Embodiment

Figure 3:
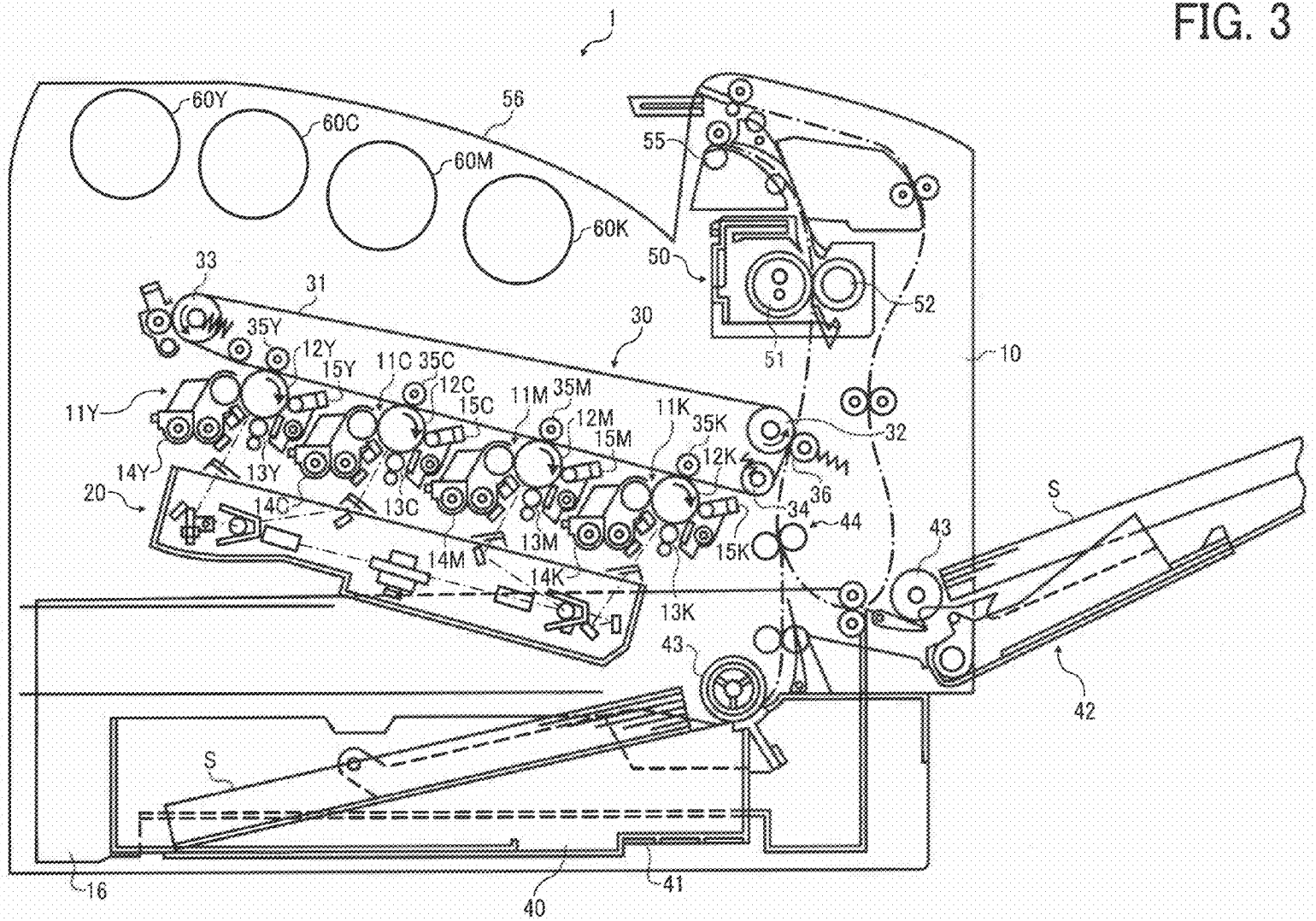
FIG. 3 is a cross-sectional view of a schematic configuration of an image forming apparatus according to an exemplary embodiment of the present invention.

Now, referring to FIG. 3, a description is given of a schematic configuration of an image forming apparatus 1 according to a first exemplary embodiment of the present invention.

The image forming apparatus 1 can be any of a copier, a printer, a facsimile machine, a plotter, and a multifunction printer including at least one of copying, printing, scanning, plotter, and facsimile functions. In this non-limiting example embodiment, the image forming apparatus 1 functions as a printer for electrophotographically forming a toner image based on image data on a recording medium (e.g., a recording sheet).

Reference symbols "Y", "C", "M", and "K" represent yellow color, cyan color, magenta color, and black color, respectively.

The image forming apparatus 1 includes a main body 10, an image forming unit 11, an optical writing unit 20, an intermediate transfer unit 30, a sheet feed unit 40, and a fixing unit 50.

The image forming unit 11 includes four image forming units 11Y, 11C, 11M, and 11K that serve as process cartridges and are detachably attachable to an image forming station provided in the main body 1. The image forming units 11Y, 11C, 11M, and 11K include respective consumable image forming components to perform image forming operations for producing respective toner images with toners of different colors of yellow (Y), cyan (C), magenta (M), and black (K). The image forming units 11Y, 11C, 11M, and 11K are separately disposed at positions having different heights in a stepped manner and are detachably provided to the image forming apparatus 1 so that each of the image forming units 11Y, 11C, 11M, and 11K can be replaced at once at an end of its useful life. The image forming units 11Y, 11C, 11M, and 11K have similar structures and functions, except that respective toners are of different colors, which are yellow, cyan, magenta and black toners, the discussion below will be applied to any of the image forming units 11Y, 11C, 11M, and 11K when the units and components are described without suffixes.

The image forming unit 11 includes a photoconductor drum 12, a charging unit 12, a developing unit 14, and a cleaning unit 15. As previously described, the image forming units 11Y, 11C, 11M, and 11K have similar configurations to each other, except for different toner colors, the photoconductor drum 12 corresponds to any of photoconductor drums 12Y, 12C, 12M, and 12K, the charging unit 13 corresponds to any of charging units 13Y, 13C, 13M, and 13K, the developing unit 14 corresponds to any of developing units 14Y, 14C, 14M, and 14K, and the cleaning unit 15 corresponds to any of cleaning units 15Y, 15C, 15M, and 15K.

The photoconductor drum 12 serves as an image bearing member to form an electrostatic latent image on a surface thereof.

The charging unit 13 uniformly charges the photoconductor drum 12.

The developing unit 14 develops an electrostatic latent image formed on the photoconductor drum 12.

The cleaning unit 15 cleans the photoconductor drum 12 by removing residual toner remaining thereon.

The photoconductor drum 12, the charging unit 13, and the cleaning unit 15 are integrally mounted on the image forming unit 11.

The optical writing unit 20 emits multiple laser light beams each of which irradiates the surface of the photoconductor drum 12 to form an electrostatic latent image.

The intermediate transfer unit 30 includes an intermediate transfer belt 31, multiple rollers 32, 33, and 34, a primary transfer roller 35, and a secondary transfer roller 36.

The intermediate transfer belt 31 serves as an intermediate transfer member and is spanned around and extended by the multiple rollers 32, 33, and 34.

The primary transfer roller 35 corresponds to any of primary transfer rollers 35Y, 35C, 35M, and 35K, and transfers the toner image held on the photoconductor drum 12 onto the intermediate transfer belt 31.

The secondary transfer roller 36 transfers the toner image on the intermediate transfer belt 31 onto a transfer sheet S as a recording medium.

The sheet feed unit 40 includes a sheet feed cassette 41, a manual sheet feed tray 42, a sheet feed roller 43, and a pair of registration rollers 44.

The sheet feed roller 43 feeds the transfer sheet S either from the sheet feed cassette 41 or from the manual sheet feed tray 42 and conveys the transfer sheet S to a secondary transfer region.

The pair of registration rollers 44 stops and feeds the transfer sheet S conveyed by the sheet feed roller 43.

The fixing unit 50 includes a fixing roller 51 and a pressure roller 52.

The fixing roller 51 and the pressure roller 52 fix the toner image to the transfer sheet S by applying heat and pressure, respectively.

Toner bottles 60Y, 60C, 60M, and 60K are disposed above and detachably attachable to the main body 10, separated from the image forming units 11Y, 11C, 11M, and 11K. Each of the toner bottles 60Y, 60C, 60M, and 60K includes toner of a corresponding single color to be conveyed to a toner supply port 145 (see FIG. 4).

Next, image forming operations using the above-described configuration of the image forming apparatus 1 are described.

For example, the surface of the photoconductor drum 12Y is uniformly charged by the charging unit 13Y of the image forming unit 11Y for forming yellow toner image, and exposed to light by the optical writing unit 20 to form an electrostatic latent image thereon. The developing unit 14Y develops the electrostatic latent image to a yellow toner image by attracting yellow toner to the surface of the photoconductor drum 12Y. The yellow toner image formed on the photoconductor drum 12Y is transferred onto the intermediate transfer belt 31 by action of the primary transfer roller 35Y. After the primary transfer, the cleaning unit 15Y cleans the surface of the photoconductor drum 12Y for a subsequent image forming operation.

Residual toner collected by the cleaning unit 15Y is conveyed and stored in a wasted toner collection bottle 16 that is disposed at a lower left position in FIG. 3 and slidably detachable and attachable in a direction of a shaft of the photoconductor drum 12Y. The wasted toner collection bottle 16 is also detachably attachable to the main body 10 to be replaceable when a reservoir therein becomes full.

The above-described operations are repeated for forming a cyan toner image, a magenta toner image, and a black toner image in the image forming units 11C, 11M, and 11K, respectively. The cyan toner image, the magenta toner image, and the black toner image are sequentially transferred onto the intermediate transfer belt 31 to be overlaid on the yellow toner image previously formed thereon, and thus a color toner image is formed.

When the transfer sheet S is conveyed from one of the sheet feed cassette 41 and the manual sheet feed tray 42 to the secondary transfer region, the secondary transfer roller 36 causes the color toner image formed on the intermediate transfer belt 31 to be transferred onto the transfer sheet S. The transfer sheet S having the color toner image thereon is conveyed to the fixing unit 50 so as to fix the toner image to the transfer sheet S by applying heat and pressure to the transfer sheet S at a fixing nip portion formed between the fixing roller 51 and the pressure roller 52. The transfer sheet S is then discharged by a discharging roller 55 to a sheet discharging tray 56 arranged at an upper position of the image forming apparatus 1.

Figure 4:
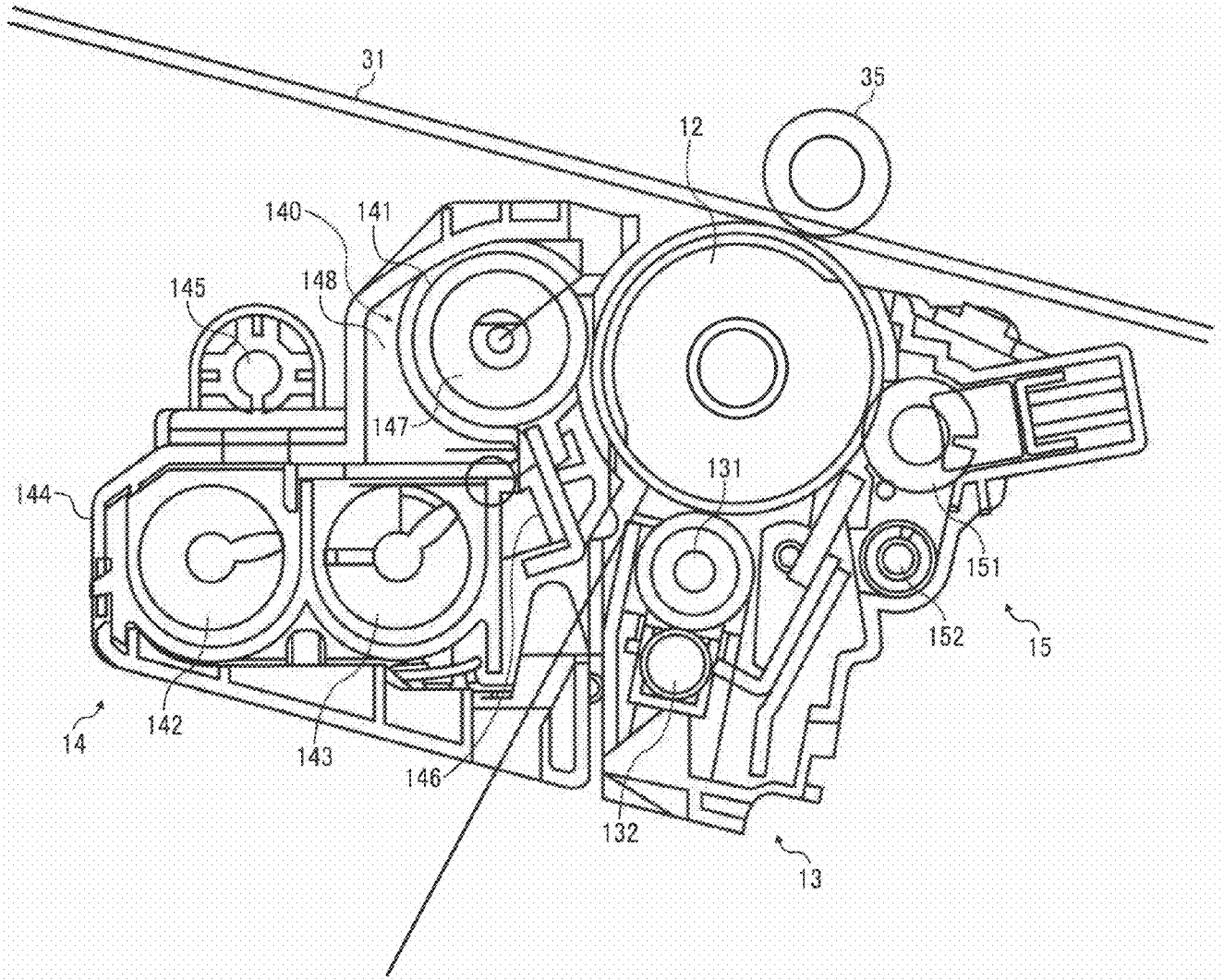
FIG. 4 is a cross-sectional view of an image forming unit included in the image forming apparatus of FIG. 3.

Next, referring to FIG. 4, a detailed description is given of the image forming unit 11, which can be applied to any of the image forming units 11Y, 11C, 11M, and 11K.

Since the image forming units 11Y, 11C, 11M, and 11K have similar structures and functions, except that respective toners are of different colors, which are yellow, cyan, magenta and black toners, the discussion below will be applied to any of the image forming units 11Y, 11C, 11M, and 11K and the image forming components incorporated therein.

FIG. 4 illustrates a schematic configuration of the image forming unit 11. In FIG. 4, the charging unit 13 includes a charge roller 131 and a cleaning roller 132, and the cleaning unit 15 includes a cleaning brush 151, a cleaning blade 152, and a toner collection coil 153, not shown in FIG. 4.

The charging roller 131 has a surface, which is cleaned by the cleaning roller 132.

The cleaning brush 151 and the cleaning blade 152 contact the photoconductor drum 12 to clean a surface thereof.

The toner collection coil 153 conveys toner removed from the photoconductor drum 12 by the cleaning brush 151 and the cleaning blade 152 toward the wasted toner collection bottle 16.

The developing unit 14 includes a developing roller 140, a nonmagnetic outer development sleeve 141, conveyance screws 142 and 143, a casing 144, the toner supply port 145, a doctor blade 146, an inner magnetic roller 147, and a seal member 148. These members and components are housed and supported by the casing 144.

The developing roller 140 serves as a developer bearing member and includes the nonmagnetic development sleeve 141 and the magnetic roller 147.

The nonmagnetic development sleeve 141 serves as a nonmagnetic hollow body constituted as a hollow cylinder of the developing roller 140 and is disposed to face the photoconductor drum 12 in the development region while rotating in a counterclockwise direction as shown in FIG. 4 and holding two-component developer including magnetic carrier particles and toner particles. Hereinafter, the two-component developer is referred to simply as "developer".

The magnetic roller 147 is fixedly disposed in the interior of the hollow development sleeve 141. The magnetic roller 147 serves as a magnetic field generator and contains multiple magnets or magnetic poles in a circumferential direction of the development sleeve 141.

The conveyance screws 142 and 143 are disposed to face the development sleeve 141 of the developing roller 140. The conveyance screws 142 and 143 serve as agitation conveyance member to mix and agitate magnetic carrier contained in the developing unit 14 and toner supplied through the toner supply port 145 and convey the carrier and toner in an axial direction of the photoconductor drum 12 according to respective directions of conveyance of the developer by the conveyance screws 142 and 143.

The doctor blade 146 serves as a developer regulating member to form a doctor gap G with the development sleeve 141 for regulating the thickness of a layer of developer held on the surface of the development sleeve 141. The doctor blade 146 is supported at a slot of the casing 144.

Figure 9:
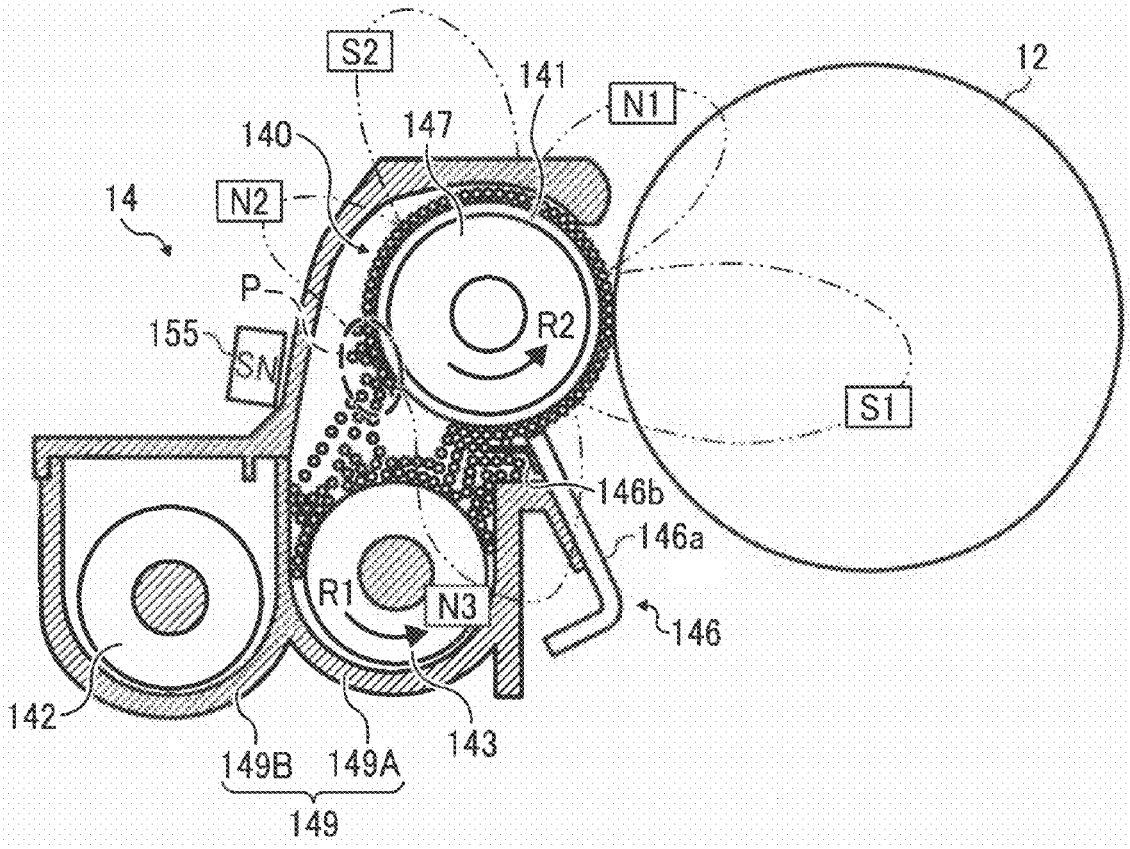
FIG. 9 is a cross-sectional view illustrating the developing unit of FIG. 4, indicating a distribution of a magnetic flux density in a direction to a development sleeve.

Specifically, the doctor blade 146 according to the first exemplary embodiment includes a doctor base body 146*a* (see FIG. 9) and a doctor supporting member 146*b* (see FIG. 9).

The doctor base body 146*a* is constituted as a nonmagnetic member for mainly regulating an amount of developer to be conveyed to the development region to a constant amount, and therefore receives a pressure of developer when regulating the developer. To withstand the pressure of developer, the doctor base body 146*a* generally maintains a certain amount of strength or hardness. For example, the doctor base body 146*a* is required to have a thickness from approximately 1.5 mm to approximately 2.0 mm, which corresponds to a distance of movement of the surface of the development sleeve 141 in a direction of conveyance of developer by the development sleeve 141 and the leading edge thereof, which is an end portion facing the surface of the development sleeve 141, is required to have straightness of approximately 0.05 mm to the surface of the development sleeve 141.

The doctor supporting member 146*b* is constituted as a magnetic member to mainly increase an amount of toner charge to be conveyed to the development region. The doctor supporting member 146*b* is normally much thinner than the doctor base body 146*a*, for example, includes a tubular or flat metal of approximately 0.2 mm. To obtain constant toner chargeability in an axial direction of the development sleeve 141, the doctor supporting member 146*b* may need to maintain a positional relation with the surface of the development sleeve 141 across the development sleeve 141 in its axial direction with accuracy. Thus, the doctor supporting member 146*b* is attached to the doctor base body 146*a* by spot welding or swaging.

Figure 5:
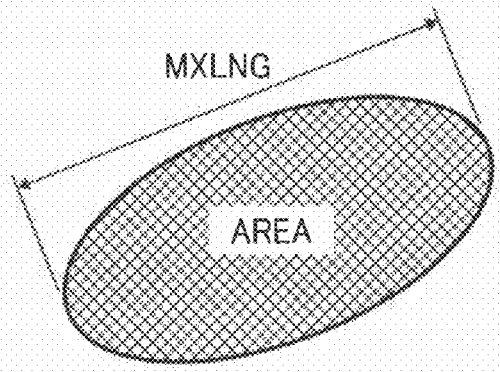
FIG. 5 is a drawing of a toner having an "SF-1" shape factor.
Figure 6:
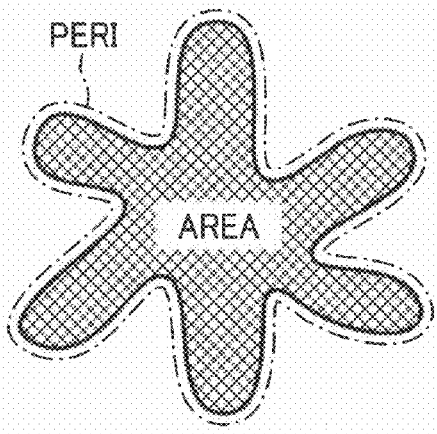
FIG. 6 is a drawing of a toner having an "SF-2" shape factor.

Referring to FIGS. 5 and 6, shapes of a toner particle are described.

It is preferable high roundness toner having an average roundness equal to or above 0.93 is adopted for use in the developing unit of the image forming apparatus 1. That is, it is known that the diameter of a toner particle is reduced to enhance image quality. However, when decreasing the diameter of a toner particle, a distribution of a conventional pulverized toner may become broad. Therefore, it is generally known to use a method for obtaining high image quality by increasing a circularity of toner by performing a polymerization reaction and making a sharp particle diameter distribution. The toner of this exemplary embodiment is typically prepared by dispersing a mixture of toner constituents including at least a polyester prepolymer having an isocyanate group, a polyester, a colorant, and a release agent in an aqueous medium in the presence of a particulate resin to perform a polymerization reaction (such as elongation and/or crosslinking). The toner constituents as described above are dissolved in an organic solvent to prepare a toner constituent solution. The dispersion is reacted with an elongation agent and/or a crosslinking agent in the aqueous medium. By using such a particulate resin, various effects can be achieved, for example, the pulverization process may not be required, the resource saving is promoted, the resultant toner has good charging ability and a sharp particle diameter distribution, and a toner shape control for changing the circularity of toner can be easily performed.

A shape factor "SF-1" of the toner used in the image forming apparatus may be in a range from approximately 100 to approximately 180, and the shape factor "SF-2" of the toner is in a range from approximately 100 to approximately 180.

Referring to FIG. 5, the shape factor "SF-1" is a parameter representing the roundness of a particle. The shape factor "SF-1" of a toner particle is calculated by the following Equation 1:

$$SF1=\{(MXLNG)^2/AREA\}\times(100\pi/4) \qquad \text{Equation 1,}$$

where "MXLNG" represents the maximum major axis of an elliptical-shaped figure obtained by projecting a toner particle on a two dimensional plane, and "AREA" represents the projected area of elliptical-shaped figure.

When the value of the shape factor "SF-1" is 100, the particle has a perfect spherical shape. As the value of the "SF-1" increases, the shape of the particle becomes more elliptical.

Referring to FIG. 6, the shape factor "SF-2" is a value representing irregularity (i.e., a ratio of convex and concave portions) of the shape of the toner particle. The shape factor "SF-2" of a particle is calculated by the following Equation 2:

$$SF2=\{(PERI)/AREA\}\times(100\pi/4) \qquad \text{Equation 2,}$$

where "PERI" represents the perimeter of a figure obtained by projecting a toner particle on a two dimensional plane.

When the value of the shape factor "SF-2" is 100, the surface of the toner is even (i.e., no convex and concave portions). As the value of the "SF-2" increases, the surface of the toner becomes uneven (i.e., the number of convex and concave portions increase).

In this exemplary embodiment of the present invention, toner images are sampled by using a field emission type scanning electron microscope (FE-SEM) S-800 manufactured by HITACHI, LTD. The toner image information is analyzed by using an image analyzer (LUSEX3) manufactured by NIREKO, LTD.

As a toner particle has a higher roundness, the toner particle is more likely to make a point-contact with the surface of the photoconductor drum 12 or another toner particle on the photoconductor drum 12. In this case, the adhesion force between these toner particles is weak, thereby making the toner particles highly flowable. Also, while weak adhesion force between the round toner particle and the photoconductive drum 12 enhances the transfer rate. Therefore, when the shape factor "SF-1" of the shape factor "SF-2" of the toner used in the image forming apparatus 1 exceeds 180, the transfer rate may decrease, which is not preferable.

Toner according to an exemplary embodiment of the present invention has a substantially spherical shape as provided by the following shape definition.

A toner has a relationship between major and minor axes r1 and r2 and a thickness r3 as follows:

$$r1 \geqq r2 \geqq r3.$$

The toner may be in a spindle shape in which the ratio (r2/r1) of the major axis r1 to the minor axis r2 is approximately 0.5 to approximately 1.0, and the ratio (r3/r2) of the thickness r3 to the minor axis is approximately 0.7 to approximately 1.0. Particularly, if the ratio r3/r2 of the thickness and the minor axis is 1.0, the toner particles become rotating objects that rotate around the minor axis as the axis of rotation and the fluidity of the toner can be enhanced, where the lengths r1, r2, and r3 were measured by a scanning electron microscope (SEM) by taking pictures by changing an angle of field of vision and while observing.

Preferably, the toners according to an exemplary embodiment of the present invention have an volume average particle diameter of 3 μm to 8 μm, the ratio of (Dv/Dn) is 1.00 to 1.40, wherein Dv means a volume average particle diameter and Dn means a number average particle diameter. Further, narrower particle diameter distribution may lead to uniform distribution of toner charge and thus high quality images with less fog of background, and also higher transfer rate.

Toner for preferred use in an image forming apparatus according to the present invention is produced through bridge reaction and/or elongation reaction of a liquid toner material in aqueous solvent. Here, the liquid toner material is generated by dispersing polyester prepolymer including an aromatic group having at least nitrogen atom, polyester, a coloring agent, and a release agent in organic solvent. In the following, toner constituents and a toner manufacturing method are described in detail.

Toner constituents and preferable manufacturing method of the toner of the prevent invention will be described below.

(Polyester)

Polyester is produced by the condensation polymerization reaction of a polyhydric alcohol compound with a polyhydric carboxylic acid compound.

A polyalcohol (PO) compound may be divalent alcohol (DIO) and tri- or more valent polyalcohol (TO). Only DIO or a mixture of DIO and a small amount of TO is preferred. The divalent alcohol (DIO) may be alkylene glycol (ethylene glycol, 1,3-propylene glycol, 1,4-butanediol, 1,6-hexanediol or the like), alkylene ether glycol (diethylene glycol, triethylene glycol, dipropyrene glycol, polyethylene glycol, polypropylene glycol, polytetramethylene ether glycol or the like), alicyclic diol (1,4-cyclohexane dimethanol, hydrogenated bisphenol A or the like), bisphenols (bisphenol A, bisphenol F, bisphenol S or the like), alkylene oxide adducts of above-mentioned alicyclic diols (ethylene oxide, propylene oxide, butylene oxide or the like), and alkylene oxide adducts of the above-mentioned bisphenols (ethylene oxide, propylene oxide, butylene oxide or the like).

Alkylene glycol having 2-12 carbon atoms and alkylene oxide adducts of bisphenols are preferred. In particular, the alkylene glycol having 2-12 carbon atoms and the alkylene oxide adducts of bisphenols are preferably used together. Tri- or more valent polyalcohol (TO) may be tri- to octa or more valent polyaliphatic alcohols (glycerin, trimethylolethane, trimethylol propane, pentaerythritol, sorbitol or the like), tri- or more valent phenols (trisphenol PA, phenol novolac, cresol novolac or the like), and alkylene oxide adducts of tri- or more valent polyphenols.

The polycarboxylic acid (PC) may be divalent carboxylic acid (DIC) and tri- or more valent polycarboxylic acid (TC). Only DIC or a mixture of DIC and a small amount of TC is preferred. The divalent carboxylic acid (DIC) may be alkylene dicarboxylic acid (succinic acid, adipic acid, sebacic acid or the like), alkenylene dicarboxylic acid (maleic acid, fumaric acid or the like), and aromatic dicarboxylic acid (phthalic acid, isophthalic acid, terephthalic acid, naphthalene dicarboxylic acid or the like). Alkenylene dicarboxylic acid having 4-20 carbon atoms and aromatic dicarboxylic acid having 8-20 carbon atoms are preferred. Tri- or more valent polycarboxylic acid may be aromatic polycarboxylic acid having 9-20 carbon atoms (trimellitic acid, pyromellitic acid or the like). Here, the polycarboxylic acid (PC) may be reacted to the polyalcohol (PO) by using acid anhydrides or lower alkyl ester (methylester, ethylester, isopropylester or the like) of the above-mentioned materials.

A ratio of the polyalcohol (PO) and the polycarboxylic acid (PC) is normally set between 2/1 and 1/1 as an equivalent ratio [OH]/[COOH] of a hydroxyl group [OH] and a carboxyl group [COOH]. The ratio preferably ranges from 1.5/1 through 1/1. In particular, the ratio is preferably between 1.3/1 and 1.02/1.

In the condensation polymerization reaction of a polyhydric alcohol (PO) with a polyhydric carboxylic acid (PC), the polyhydric alcohol (PO) and the polyhydric carboxylic acid (PC) are heated to a temperature from 150° C. to 280° C. in the presence of a known esterification catalyst, e.g., tetrabutoxy titanate or dibutyltineoxide. The generated water is distilled off with pressure being lowered, if necessary, to obtain a polyester resin containing a hydroxyl group. The hydroxyl value of the polyester resin is preferably 5 or more while the acid value of polyester is usually between 1 and 30, and preferably between 5 and 20. When a polyester resin having such an acid value is used, the residual toner is easily negatively charged. In addition, the affinity of the toner for recording paper can be improved, resulting in improvement of low temperature fixability of the toner. However, a polyester resin with an acid value above 30 can adversely affect stable charging of the residual toner, particularly when the environmental conditions vary.

The weight-average molecular weight of the polyester resin is from 10,000 to 400,000, and more preferably from 20,000 to 200,000. A polyester resin with a weight-average molecular weight between 10,000 lowers the offset resistance of the residual toner while a polyester resin with a weight-average molecular weight above 400,000 lowers the temperature fixability.

A urea-modified polyester is preferably included in the toner in addition to unmodified polyester produced by the above-described condensation polymerization reaction. The urea-modified polyester is produced by reacting the carboxylic group or hydroxyl group at the terminal of a polyester obtained by the above-described condensation polymerization reaction with a polyisocyanate compound (PIC) to obtain polyester prepolymer (A) having an isocyanate group, and then reacting the prepolymer (A) with amines to crosslink and/or extend the molecular chain.

Specific examples of the polyisocyanate (PIC) include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; 10 aromatic diisocyanate such as tolylenedisocyanate and diphenylmethanediisocyanate; aroma aliphatic diisocyanate such as αααα-te-tramethylxylylenediisocyanate; isocyanurate; the above-mentioned polyisocyanate blocked with phenol derivatives, oxime and caprolactam; and their combinations.

The polyisocyanate (PIC) is mixed with a polyester such that the equivalent ratio ([NCO]/[OH]) between the isocyanate group [NCO] of the polyisocyanate (PIC) and the hydroxyl group [OH] of the polyester is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When the molar ratio of [NCO] is less than 1, the urea content in the resultant modified polyester decreases and hot offset resistance of the resultant toner deteriorates.

The content of the constitutional unit obtained from a polyisocyanate (PIC) in the polyester prepolymer (A) is from 0.5% to 40% by weight, preferably from 1 to 30% by weight and more preferably from 2% to 20% by weight. When the content is less than 0.5% by weight, hot offset resistance of the resultant toner deteriorates and in addition the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diamino cyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of amino acid (B5) are aminopropionic acid and caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, molecular weight of the urea-modified polyester decreases, resulting in deterioration of hot offset resistance of the resultant toner.

Suitable polyester resins for use in the toner of the present invention include a urea-modified polyesters (i). The urea-modified polyester (i) may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the molar ratio of the urea bonding is less than 10%, hot offset resistance of the resultant toner deteriorates.

The urea modified polyester is produced by, for example, a one-shot method. Specifically, a polyhydric alcohol (PO) and a polyhydric carboxylic acid (PC) are heated to a temperature of 150° C. to 280° C. in the presence of the known esterification catalyst, e.g., tetrabutoxy titanate or dibutyltineoxide to be reacted. The resulting water is distilled off with pressure being lowered, if necessary, to obtain a polyester containing a hydroxyl group. Then, a polyisocyanate (PIC) is reacted with the polyester obtained above a temperature of from 40° C. to 140° C. to prepare a polyester prepolymer (A) having an isocyanate group. The prepolymer (A) is further reacted with an amine (B) at a temperature of from 0° C. to 140° C. to obtain a urea-modified polyester.

At the time of reacting the polyisocyanate (PIC) with a polyester and reacting the polyester prepolymer (A) with the amines (B), a solvent may be used, if necessary. Specific examples of the solvent include solvents inactive to the isocyanate (PIC), e.g., aromatic solvents such as toluene, xylene; ketones such as acetone, methyl ethyl ketone, methyl isobutyl ketone; esters such as ethyl acetate; amides such as dimethyl formamide, dimethyl acetatamide; and ethers such as tetrahydrofuran.

A reaction anticatalyst can optionally be used in the crosslinking and/or elongation reaction between the polyester prepolymer (A) and amines (B) to control a molecular weight of the resultant urea-modified polyesters, if desired. Specific examples of the reaction anticatalyst include monoamines such as diethyl amine, dibutyl amine, butyl amine and lauryl amine, and blocked amines, i.e., ketimine compounds prepared by blocking the monoamines described above.

The weight-average molecular weight of the urea-modified polyester is not less than 10,000, preferably from 20,000 to 10,000,000 and more preferably from 30,000 to 1,000,000. A molecular weight of less than 10,000 deteriorates the hot offset resisting property. The number-average molecular weight of the urea-modified polyester is not particularly limited when the above-mentioned unmodified polyester resin is used in combination. Namely, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000, and more preferably from 2,000 to 8,000. When the number-average molecular weight is greater than 20,000, the low temperature fixability of the resultant toner deteriorates, and in addition the glossiness of full color images deteriorates.

In the present invention, not only the urea-modified polyester alone but also the unmodified polyester resin can be included with the urea-modified polyester. A combination thereof improves low temperature fixability of the resultant toner and glossiness of color images produced by the full-color image forming apparatus, and using the combination is more preferable than using the urea-modified polyester alone. It is noted that the unmodified polyester may contain polyester modified by a chemical bond other than the urea bond.

It is preferable that the urea-modified polyester at least partially mixes with the unmodified polyester resin to improve the low temperature fixability and hot offset resistance of the resultant toner. Therefore, the urea-modified polyester preferably has a structure similar to that of the unmodified polyester resin.

A mixing ratio between the urea-modified polyester and polyester resin is from 20/80 to 95/5 by weight, preferably from 70/30 to 95/5 by weight, more preferably from 75/25 to 95/5 by weight, and even more preferably from 80/20 to 93/7 by weight. When the weight ratio of the urea-modified polyester is less than 5%, the hot offset resistance deteriorates, and in addition, it is difficult to impart a good combination of high temperature preservability and low temperature fixability of the toner.

The toner binder preferably has a glass transition temperature (Tg) of from 45° C. to 65° C., and preferably from 45° C. to 60° C. When the glass transition temperature is less than 45° C., the high temperature preservability of the toner deteriorates. When the glass transition temperature is higher than 65° C., the low temperature fixability deteriorates.

Since the urea-modified polyester can exist on the surfaces of the mother toner particles, the toner of the present invention has better high temperature preservability than conventional toners including a polyester resin as a binder resin even though the glass transition temperature is low.

(Colorant)

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, 25 Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LitholFast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

A content of the colorant in the toner is preferably from 1% by weight to 15% by weight, and more preferably from 3% by weight to 10% by weight, based on the total weight of the toner.

The colorants mentioned above for use in the present invention can be used as master batch pigments by being combined with a resin.

The examples of binder resins to be kneaded with the master batch or used in the preparation of the master batch are styrenes like polystyrene, poly-p-chlorostyrene, polyvinyl toluene and polymers of their substitutes, or copolymers of these with a vinyl compound, polymethyl metacrylate, polybutyl metacrylate, polyvinyl chloride, polyvinyl acetate, polyethylene, polypropylene, polyester, epoxy resins, epoxy polyol resins, polyurethane, polyamides, polyvinyl butyral, polyacrylic resins, rosin, modified rosin, terpene resins, aliphatic and alicyclic hydrocarbon resins, aromatic petroleum resins, chlorinated paraffins, paraffin wax etc. which can be used alone or in combination.

(Charge Controlling Agent)

Specific examples of the charge controlling agent include known charge controlling agents such as Nigrosine dyes, triphenylmethane dyes, metal complex dyes including chromium, chelate compounds of molybdic acid, Rhodaminedyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative) PR, COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among these materials, materials negatively charging a toner are preferably used.

The content of the charge controlling agent is determined depending on the species of the binder resin used, whether or not an additive is added, the toner manufacturing method (such as dispersion method) used, and is not particularly limited. However, the content of the charge controlling agent is typically from 0.1 parts by weight to 10 parts by weight, and preferably from 0.2 parts by weight to 5 parts by weight, per 100 parts by weight of the binder resin included in the toner. When the content is too high, the toner has too large a charge quantity. Consequently, the electrostatic force of a developing roller attracting the toner increases, resulting in deterioration of the fluidity of the toner and decrease of the image density of toner images.

(Releasing Agent)

A wax for use in the toner of the present invention as a releasing agent has a low melting point of from 50° C. to 120° C. When such a wax is included in the toner, the wax is dispersed in the binder resin and serves as a releasing agent at a location between a fixing roller and the toner particles. Thereby, hot offset resistance can be improved without applying an oil to the fixing roller used. Specific examples of the releasing agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. In addition, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

These charge controlling agents and releasing agents can be dissolved and dispersed after being kneaded and receiving an application of heat together with a master batch pigment and a binder resin; and can be added when directly dissolved and dispersed in an organic solvent.

(External Additives)

The inorganic particulate material preferably has a primary particle diameter of from $5\times10^{-3}$ to 2 μm, and more preferably from $5\times10^{-3}$ to 0.5 μm. In addition, a specific surface area of the inorganic particulates measured by a BET method is preferably from 20 $m^2/g$ to 500 $m^2/g$. The content of the external additive is preferably from 0.01% to 5% by weight, and more preferably from 0.01% to 2.0% by weight, based on total weight of the toner.

Specific examples of the inorganic fine grains are silica, alumina, titanium oxide, barium titanate, magnesium titanate, calcium tiatanate, strontium titanate, zinc oxide, tin oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide, and silicon nitride. Among them, as a fluidity imparting agent, it is preferable to use hydrophobic silica fine grains and hydrophobic titanium oxide fine grains in combination. Particularly, when such two kinds of fine grains, having a mean grain size of $5\times10^{-2}$ pin or below, are mixed together, there can be noticeably improved an electrostatic force and van del Waals force with the toner. Therefore, despite agitation effected in the developing device for implementing the desired charge level, the fluidity imparting agent does not part from the toner grains and insures desirable image quality free from spots or similar image defects. In addition, the amount of residual toner can be reduced.

Titanium oxide fine grains are desirable for environmental stability and image density stability, but tend to have lower charge start characteristics. Therefore, if the amount of titanium oxide fine particles is larger than the amount of silica fine grains, then the influence of the above side effect increases. However, so long as the amount of hydrophobic silica fine grains and hydrophobic titanium oxide fine grains is between 0.3 wt. % and 1.5 wt. %, the charge start characteristics are not noticeably impaired, i.e., desired charge start characteristics are achievable. Consequently, stable image quality is achievable despite repeated copying operations.

[Preparation of Toner]

The toner of the present invention is produced by the following method, but the manufacturing method is not limited thereto.

(1) First, a colorant, unmodified polyester, polyester prepolymer having isocyanate groups and a parting agent are dispersed into an organic solvent to prepare a toner material liquid.

The organic solvent should preferably be volatile and have a boiling point of 100° C. or below because such a solvent is easy to remove after the formation of the toner mother particles. More specific examples of the organic solvent includes one or more of toluene, xylene, benzene, carbon tetrachloride, methylene chloride, 1,2-dichloroethane, 1,1,2-trichloroethane, trichloro ethylene, chloroform, monochlorobenzene, dichloroethylidene, methyl acetate, ethyl acetate, methyl ethyl ketone, methyl isobutyl ketone, and so forth. Particularly, the aromatic solvent such as toluene and xylene; and a hydrocarbon halide such as methylene chloride, 1,2-dichloroethane, chloroform or carbon tetrachloride is preferably used. The amount of the organic solvent to be used should preferably 0 parts by weight to 300 parts by weight for 100 parts by weight of polyester prepolymer, more preferably 0 parts by weight to 100 parts by weight for 100 parts by weight of polyester prepolymer, and even more preferably 25 parts by weight to 70 parts by weight for 100 parts by weight of polyester prepolymer.

(2) The toner material liquid is emulsified in an aqueous medium in the presence of a surfactant and organic fine particles.

The aqueous medium for use in the present invention is water alone or a mixture of water with a solvent which can be mixed with water. Specific examples of such a solvent include alcohols (e.g., methanol, isopropyl alcohol and ethylene glycol), dimethylformamide, tetrahydrofuran, cellosolves (e.g., methyl cellosolve), lower ketones (e.g., acetone and methyl ethyl ketone), etc.

The content of the aqueous medium is typically from 50 to 2,000 parts by weight, and preferably from 100 parts by weight to 1,000 parts by weight, per 100 parts by weight of the toner constituents. When the content is less than 50 parts by weight, the dispersion of the toner constituents in the aqueous medium is not satisfactory, and thereby the resultant mother toner particles do not have a desired particle diameter. In contrast, when the content is greater than 2,000, the manufacturing costs increase.

Various dispersants are used to emulsify and disperse an oil phase in an aqueous liquid including water in which the toner constituents are dispersed. Specific examples of such dispersants include surfactants, resin fine-particle dispersants, etc.

Specific examples of the dispersants include anionic surfactants such as alkylbenzenesulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyldimethylammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycine, di(octylaminoethyle)glycine, and N-alkyl-N,N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylgl-utamate, sodium 3-{omega-fluoroalkyl(C6-C11)oxy}-1-alkyl(C3-C4)sulfonate, sodium, 3-lomega-fluoroalkanoyl(C6-C8)-N-ethylamino}-1-propanesulfonate, fluoroalkyl(C11-C20)carboxylic acids and their metal salts, perfluoroalkylcarboxylic acids (7C-13C) and their metal salts, perfluoroalkyl(C4-C12) sulfonate and their metal salts, perfluorooctanesulfonic acid diethanol amides, N-propyl-N-(2-hydroxyethyl-)perfluorooctanesulfone amide, perfluoroalkyl(C6-C10)sulfoneamidepropyltrimethylammonium salts, salts of perfluoroalkyl (C6-C10)-N-ethylsulfonylglycin, monoperfluoroalkyl(C6-C16)e-thylphosphates, etc.

Specific examples of the marketed products of such surfactants having a fluoroalkyl group include SARFRON® S-111, S-112 and S-113, which are manufactured by ASAHI GLASS CO., LTD.; FLUORAD® FC-93, FC-95, FC-98 and FC-129, which are manufactured by SUMITOMO 3M LTD.; UNIDYNE® DS-101 and DS-102, which are manufactured by DAIKIN INDUSTRIES, LTD.; MEGAFACE® F-110, F-120, F-113, F-191, F-812 and F-833 which are manufactured by DAINIPPON INK AND CHEMICALS, INC.; ECTOP EF-102, 103, 104, 105, 112, 123A, 123B, 306A, 501, 201 and 204, which are manufactured by TOHCHEM PRODUCTS CO., LTD.; FUTARGENT® F-100 and F150 manufactured by NEOS; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl(C6-C10)sulfone-amidepropyltrimethylammonium salts, benzalkonium salts, benzetonium chloride, pyridinium salts, imidazolinium salts, etc. Specific examples of the marketed products thereof include SARFRON® S-121 (manufactured by ASAHI GLASS CO., LTD.); FLUORADO FC-135 (manufactured by SUMITOMO 3M LTD.); UNIDYNE DS-202 (manufactured by DAIKIN INDUSTRIES, LTD.); MEGAFACE® F-150 and F-824 (manufactured by DAINIPPON INK AND CHEMICALS, INC.); ECTOP EF-132 (manufactured by TOHCHEM PRODUCTS CO., LTD.); FUTARGENTO F-300 (manufactured by NEOS); etc.

Resin fine particles are added to stabilize toner source particles formed in the aqueous solvent. The resin fine particles are preferably added such that the coverage ratio thereof on the surface of a toner source particle can be within 10% through 90%. For example, such resin fine particles may be methyl polymethacrylate particles of 1 μm and 3 μm, polystyrene particles of 0.5 μm and 2 μm, poly(styrene-acrylonitrile) particles of 1 μm, commercially, PB-200 (manufactured by KAO Co.), SGP, SGP-3G (manufactured by SOKEN), technopolymer SB (manufactured by SEKISUI PLASTICS CO., LTD.), micropearl (manufactured by SEKISUI CHEMICAL CO., LTD.) or the like.

Also, an inorganic dispersant such as calcium triphosphate, calcium carbonate, titanium oxide, colloidal silica, and hydroxyapatite may be used.

Further, it is possible to stably disperse toner constituents in water using a polymeric protection colloid in combination with the inorganic dispersants and/or particulate polymers mentioned above. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, (β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethyleneimine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethylcellulose and hydroxypropylcellulose, can also be used as the polymeric protective colloid.

The dispersion method is not particularly limited, and conventional dispersion facilities, e.g., low speed shearing type, high speed shearing type, friction type, high pressure jet type and ultrasonic type dispersers can be used. Among them, the high speed shearing type dispersion methods are preferable for preparing a dispersion including grains with a grain size of 2 μm to 20 μm. The number of rotations of the high speed shearing type dispersers is not particularly limited, but is usually 1,000 rpm (revolutions per minute) to 30,000 rpm, and preferably 5,000 rpm to 20,000 rpm. While the dispersion time is not limited, it is usually 0.1 minute to 5 minutes for the batch system. The dispersion temperature is usually 0° C. to 150° C., and preferably 40° C. to 98° C. under a pressurized condition.

(3) At the same time as the production of the emulsion, an amine (B) is added to the emulsion to be reacted with the polyester prepolymer (A) having isocyanate groups.

The reaction causes the crosslinking and/or extension of the molecular chains to occur. The elongation and/or crosslinking reaction time is determined depending on the reactivity of the isocyanate structure of the prepolymer (A) and amine (B) used, but is typically from 10 minutes to 40 hours, and preferably from 2 hours to 24 hours. The reaction temperature is typically from 0° C. to 150° C., and preferably from 40° C. to 98° C. In addition, a known catalyst such as dibutyltinlaurate and dioctyltinlaurate can be used. The amines (B) are used as the elongation agent and/or crosslinker.

(4) After the above reaction, the organic solvent is removed from the emulsion (reaction product), and the resultant particles are washed and then dried. Thus, mother toner particles are prepared.

To remove the organic solvent, the entire system is gradually heated in a laminar-flow agitating state. In this case, when the system is strongly agitated in a preselected temperature range, and then subjected to a solvent removal treatment, fusiform mother toner particles can be produced. Alternatively, when a dispersion stabilizer, e.g., calcium phosphate, which is soluble in acid or alkali, is used, calcium phosphate is preferably removed from the toner mother particles by being dissolved by hydrochloric acid or similar acid, followed by washing with water. Further, such a dispersion stabilizer can be removed by a decomposition method using an enzyme.

(5) Then a charge controlling agent is penetrated into the mother toner particles, and inorganic fine particles such as silica, titanium oxide etc. are added externally thereto to obtain the toner of the present invention.

In accordance with a well-known method, for example, a method using a mixer, the charge controlling agent is provided, and the inorganic particles are added.

Thus, a toner having a small particle size and a sharp particle size distribution can be obtained easily. Moreover, by controlling the stirring conditions when removing the organic solvent, the particle shape of the particles can be controlled so as to be any shape between perfectly spherical and rugby ball shape. Furthermore, the conditions of the surface can also be controlled so as to be any condition from a smooth surface to a rough surface such as the surface of pickled plum.

The volume average particle diameter of magnetic carrier according to an exemplary embodiment of the present invention is preferably approximately 20 μm to approximately 65 μm. When the volume average particle diameter is less than 20 μm, problems such as carrier adhesion unfavorably generate since uniformity of particles is decreased. On the other hand, the volume average particle diameter of above 65 μm is unfavorable since reproducibility of fine images is poor and fine precise images are unobtainable.

The volume average particle diameter of the carrier core material is measured using a Microtrack particle size analyzer of SRA type (by Nikkiso Co.), and the range can be set from approximately 0.7 μm to approximately 125 μm. Methanol is used for the dispersion liquid and the refractive index is set to 1.33, and refractive indices of carrier and core material are set to 2.42.

It is preferred that magnetic moment of the magnetic carrier is in a range of from approximately 40 [$A \cdot m^2$/kg] to approximately 90 [$A \cdot m^2$/kg] in an applied magnetic field of $1 \times 10^6/4\pi$ [A/m] (1 k [Oe]).

The magnetic moment of the above-described range may appropriately maintain retaining force between carrier particles, thus dispersing or mixing of the toner into the carrier or developer is rapid and proper. However, when the magnetic moment is less than 40 [$A \cdot m^2$/kg] at 1 kOe, shortage of the magnetic moment unfavorably brings about carrier adhesion. On the other hand, the magnetic moment of more than 90 [$A \cdot m^2$/kg] at 1 kOe is undesirable, since a developer rise for forming the magnetic brush becomes excessively hard at developing step and thus reproducibility of fine images is poor and fine precise images are unobtainable.

The magnetic moment may be measured as follows. A B-H tracer BHU-60 (by Riken Denshi Co.) is used as a measuring device, and particles of magnetic carrier core material of 1.0 g is filled into a cylindrical cell (inner diameter: 7 mm, height: 10 mm) and set to the device. The magnetic field is gradually increased up to an applied magnetic field of $3 \times 10^6/4\pi$ [A/m] (3 k [Oe]), then is gradually decreased to zero, and magnetic field of the opposing direction is gradually increased up to an applied magnetic field of $3 \times 10^6/4\pi$ [A/m] (3 k [Oe]). Then the magnetic field is gradually decreased to zero, thereafter the magnetic field is applied in the first direction. Thus, the B-H curve is figured in this way and the magnetic moment at $1 \times 10^6/4\pi$ [A/m] (1 k [Oe]) is determined from the figure.

Further, the magnetic carrier according to an exemplary embodiment of the present invention includes a resin coating film surrounding a core of a magnetic member. The resin coating film contains charge control agent to add to a carrier-coating material of cross-linked substance of a melamine resin and a thermoplastic resin such as an acrylic resin, and the like. By using the magnetic carrier, an effect for absorbing impact or shock to reduce abrasion and retaining large carrier particles by an enhanced adhesion force and an effect for preventing impact to the resin coating film and cleaning of toner spent, in a balanced manner. Thus, the usable life of magnetic carrier can be longer, and film abrasion and toner spent can be avoided.

Figure 7:
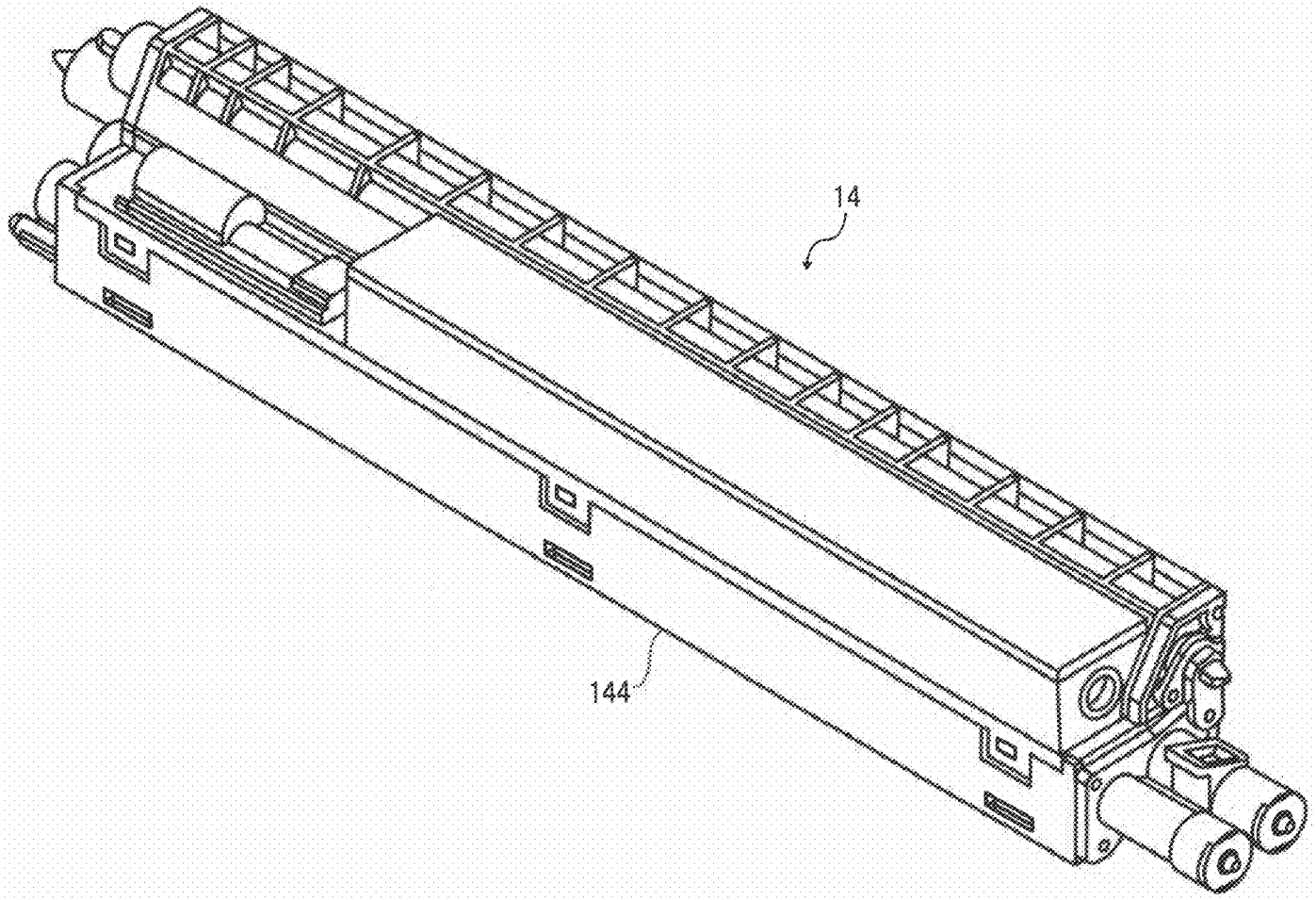
FIG. 7 is a perspective view illustrating a developing unit included in the image forming unit of FIG. 4.
Figure 8:
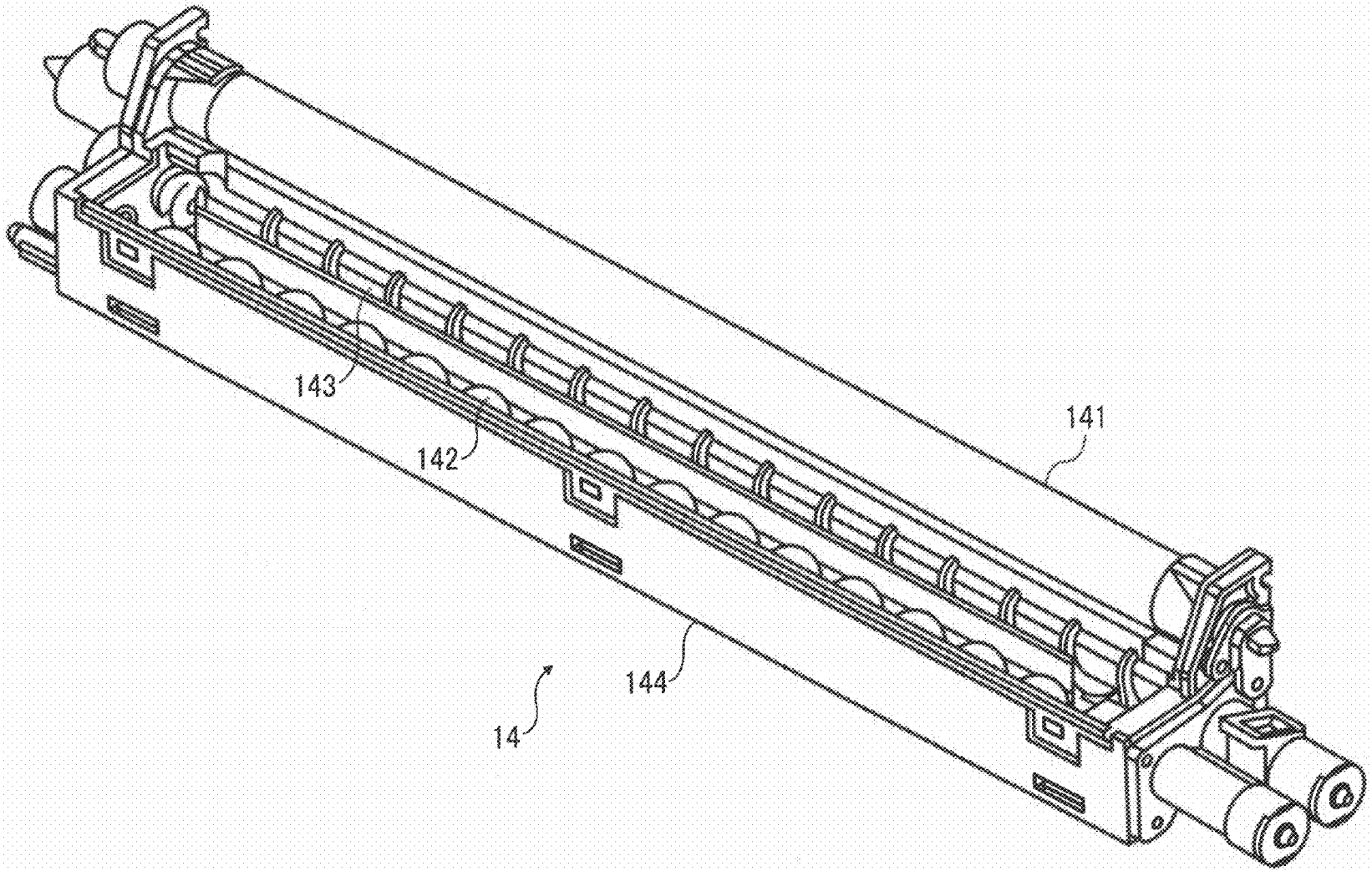
FIG. 8 is another perspective view illustrating the developing unit of FIG. 4 with a top part of the developing unit open.

Next, referring to FIGS. 7 to 9, descriptions are given of the developing unit 14 according to the first exemplary embodiment of the present invention. FIG. 7 is a perspective view illustrating the developing unit 14. FIG. 8 is a perspective view illustrating the developing unit 14 with the top part of the casing 144 open so as to show the inside of the developer container 149 of the developing unit 14. FIG. 9 is a cross-sectional view illustrating the developing unit 14, with a chain double-dashed line indicating a distribution of a magnetic flux density in a direction to the surface of the development sleeve 141 (absolute value).

The magnetic roller 147 in the developing unit 14 is a cylindrical member of resin with magnetic powder surrounded by an exterior perimeter surface magnetized by multiple magnetic poles (i.e., multiple magnets). A diameter of the magnetic roller 147 is approximately 18 mm. The magnetic poles formed on the magnetic roller 147 face the photoconductor drum 12 at the nip portion and are arranged in a counterclockwise direction in FIG. 9 (i.e., in a direction the development sleeve 141 conveys the developer), starting from a magnetic pole S1 for development (hereinafter, referred to as "magnetic pole S1"), magnetic poles N1 and S2 for conveyance (hereinafter, referred to as "magnetic pole N1" and "magnetic pole S2", respectively), magnetic pole N2 for upstream developer empty magnetic pole (hereinafter, referred to as "magnetic pole N2"), and magnetic pole N3 for developer empty, attraction, and regulation (hereinafter, referred to as "magnetic pole N3").

The magnetic roller 147 is an integrally formed member. However, the magnetic roller 147 can be formed with multiple magnet members per magnetic pole around the axis thereof. For the integrally formed magnetic roller 147 used in this exemplary embodiment, it is preferable to use a roller in which magnetic powder is dispersed to resin such as ethylene ethyl acrylate and nylon (registered trade name). Preferable examples of the magnetic powder used in this exemplary embodiment include ferrites such as strontium ferrite and the like or rare earth magnetic particles such as NdFeB, SmFeN, and the like.

By contrast, the development sleeve 141 is development sleeve 141 is a hollow member of some nonmagnetic material. Examples of preferable material of the development sleeve 141 are aluminum, stainless steel, and the like, for workability, cost, and durability. More preferably, multiple elliptic dents are formed randomly on the outer perimeter surface of the development sleeve 141 so that the development sleeve 141 has multiple elliptic concave parts randomly on the outer perimeter surface thereof. Thus, the development sleeve 141 may have an uneven surface with multiple concave parts at random pitches, thereby presenting slippage of developer without adhering to the surface of the development sleeve 141 while the development sleeve 141 is rotating.

Consequently a chain of developer beads rises on each concave part so that multiple chains of risen developer beads can form a thick magnetic brush. Further, the concave parts may not likely to abrade easily. Therefore, a good image with stable quality can be obtained without generating uneven image over an extended period of time. Such concave parts are preferably formed by using a conventional blasting, for example, colliding or bumping media of relatively large-shaped cut wires of short metallic wires to the surface of a pipe-shaped development sleeve.

It is a known method to form grooves or uneven convex and concave portions on the surface of the development sleeve by sand blasting, bead blasting, etc. so as to convey the developer easily. Specially, color image forming apparatuses typically use a development sleeve having convex and concave portions on the surface thereof by blasting for high image quality. Non-smooth processing such as groove forming, blasting, and the like prevents a decrease in image density generated due to slippage and accumulation of developer on the surface of the development sleeve 141 while the development sleeve 141 is rotating at high speed.

A magnet 155 is provided in the vicinity of the developing roller 140. Details of the magnet 155 will be described later.

The casing 144 provides separate space corresponding to a developer container 149 in the developing unit 14. The developer container 149 includes a developer storing chamber 149A, an agitation chamber 149B, and conveyance screws 142 and 143.

The developer storing chamber 149A is disposed below the development sleeve 141, extending in an axial direction of the development sleeve 141. The developer storing chamber 149A includes the conveyance screw 143 that rotates in a direction indicated by arrow "R1" in FIG. 9.

The agitation chamber 149B is disposed adjacent and separate from the developer storing chamber 149A, extending in the axial direction of the development sleeve 141. The agitation chamber 149B includes the conveyance screw 142.

The conveyance screw 143 conveys the developer to a downstream end (far or distal side in FIG. 9) of the developer storing chamber 149A, so as to transfer the developer into the agitation chamber 149B. The developer in the agitation chamber 149B is conveyed by the conveyance screw 142 to a downstream end (near or proximal side in FIG. 9) of the agitation chamber 149B. The developer is then conveyed to the developer storing chamber 149A again. Thus, the developer is circulated in the developer container 149.

New or fresh toner for supplementing toner consumed for development is supplied through the toner supply port 145 to the developer in the agitation chamber 149B. While traveling in the developer storing chamber 149A, the developer is attracted to the development sleeve 141 by the action of magnetic force exerted by the magnetic pole N3 of the magnetic roller 147. Then, the developer on the development sleeve 141 is regulated by the doctor blade 146, passes the development region while facing the photoconductor drum 12, and returns to the developer container 149.

In an exemplary embodiment, the developer attracted from the developer storing chamber 149A to the development sleeve 141 by the action of the magnetic force generated by the magnetic pole N3 is conveyed in a counterclockwise direction in FIG. 9 as the development sleeve 141 rotates in a direction indicated by arrow "R2" in FIG. 9. After the doctor blade 146 has regulated the developer to have a given thickness of a layer of developer on the development sleeve 141, the developer rises to form the magnetic brush by the magnetic force generated by the magnetic pole S1 in the development region. The developer raised by the electric field for development adheres to the electrostatic latent image formed on the surface of the photoconductor drum 12 to develop to a toner image. The post-development developer is conveyed as the development sleeve 141 rotates while being held on the development sleeve 141 by the magnetic forces in the order of the magnetic pole N1, the magnetic pole S2, and the magnetic pole N2. Then, the developer is removed or released from the development sleeve 141 by the action of a repulsive magnetic force or release force generated between the magnetic pole N2 and the magnetic pole N3 and falls onto the developer storing chamber 149A of the developer container 149.

The magnetic forces are calculated based on the following equations:

$$Fr=G\times(Hr\times(\partial Hr/\partial r)+Hr\times(\partial H\theta/\partial r)); \text{ and}$$

$$F\theta=G\times(1/r\times Hr\times(\partial Hr/\partial\theta)+1/r\times(Hr\times\partial H\theta/\partial\theta)),$$

where "Fr" represents a normal component of a magnetic force to the surface of a development sleeve (hereinafter, referred to as "normal component of the magnetic force Fr"), "Fθ" represents a tangential component of a magnetic force to the surface of a development sleeve (hereinafter, referred to as "tangential component of the magnetic force Fθ"), "Hr" represents a normal component of a magnetic flux density to the surface of a development sleeve, "Hθ" represents a tangential component of a magnetic flux density to the surface of a development sleeve, "r" represents a radius for calculation, and "G" represents a constant ($7.8\times10^{-15}$).

In the following description, when the normal component of the magnetic force Fr indicates a positive number, the magnetic force is exerted to move the magnetic carrier away from the development sleeve 141. By contrast, when the normal component of the magnetic force Fr indicates a negative number, the magnetic force is exerted to move the magnetic carrier toward the development sleeve 141.

Further, in the following description, an "upstream side" indicates an upstream side in a direction of conveyance of development on the development sleeve 141, a "downstream side" indicates a downstream side in a direction of conveyance of development on the development sleeve 141, and a "developer conveyance direction" indicates a direction of conveyance of development held on the surface of the development sleeve 141, unless otherwise specifically indicated.

In the first exemplary embodiment, the magnetic pole N3 that is disposed adjacent the magnetic pole N2 is disposed in the vicinity of the doctor blade 146, as shown in FIG. 9. The magnetic pole N2 and the magnetic pole N3 have an identical polarity to each other. According to this arrangement, the developer attracted to the development sleeve 141 may not be affected by a polarity inversion point in the magnetic field before the doctor blade 146 regulates the thickness of a layer of developer on the development sleeve 141. Therefore, different from the configuration of the conventional developing unit having the polarity inversion point (i.e., the polarity inversion point Q) as shown in FIG. 1, the configuration of the developing unit 14 shown in FIG. 9 can reduce mechanical stress on the developer at the upstream side from the doctor blade 146 in the developer conveyance direction.

Further, the development sleeve 141 has a developer-releasing region P on a given area thereon, where the magnetic poles N2 and N3 generate a magnetic force that acts as a release force to cause the developer held on the development sleeve 141 to move away from the development sleeve 141 or toward a direction opposite to the surface of the development sleeve 141. In the first exemplary embodiment, the developer-releasing region P is located so as not to be held in contact with (a top surface of) developer stored in the developer storing chamber 149A.

Figure 10A:
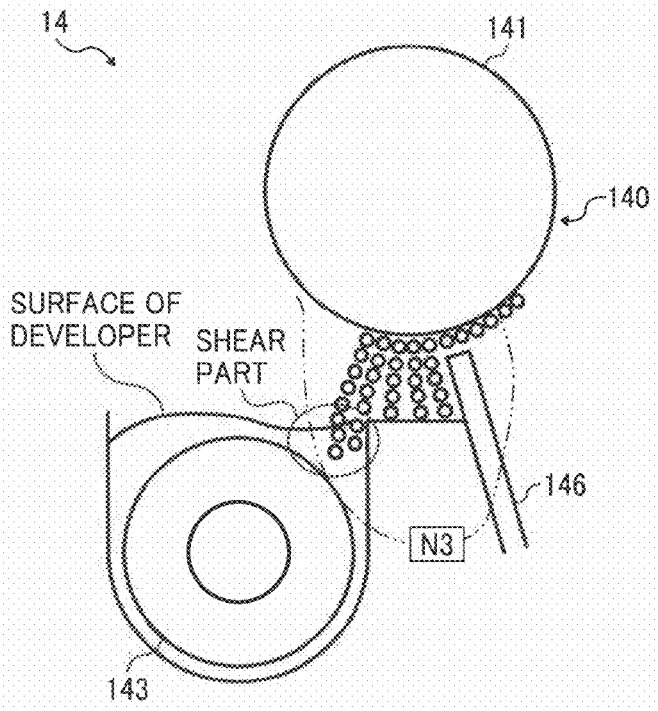
FIG. 10A is a drawing for explaining a magnetic brush formed in the developing unit according to an exemplary embodiment of the present invention.
Figure 10B:
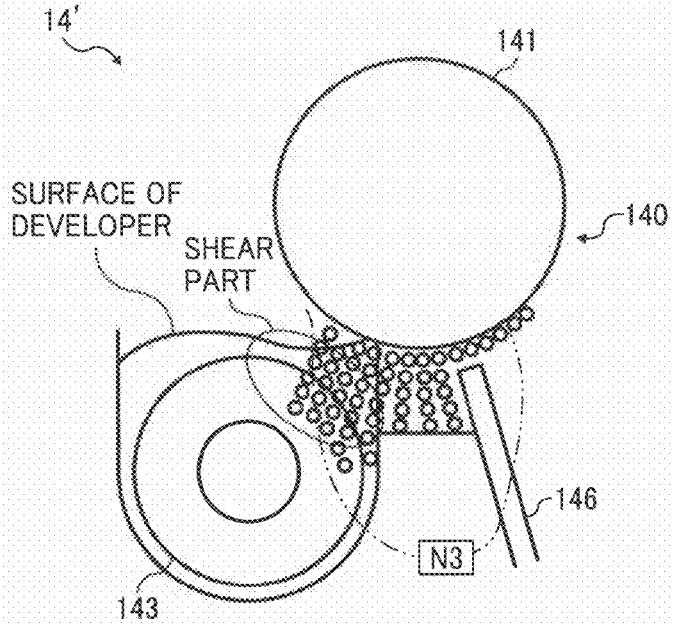
FIG. 10B is a drawing for explaining a magnetic brush formed in a conventional developing unit.

Specifically, descriptions are given of two developing units having different configurations, referring to FIGS. 10A and 10B. FIG. 10A illustrates a schematic configuration of the developing unit 14 according to an exemplary embodiment of the present invention, and FIG. 10B illustrates a schematic configuration of a conventional developing unit 14' of FIG. 2.

Figure 2:
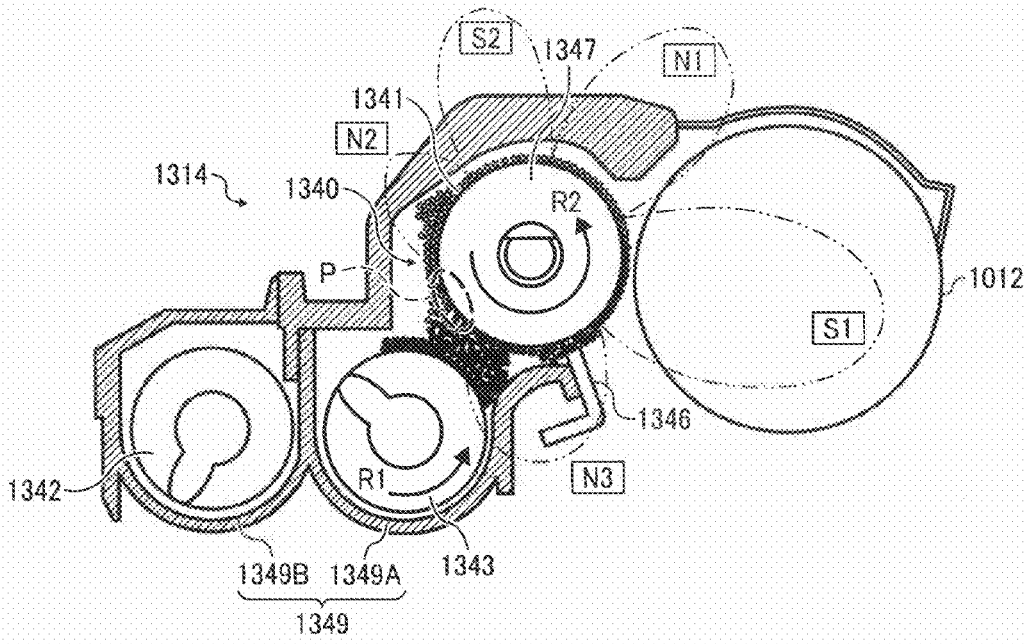
FIG. 2 BACKGROUND ART
FIG. 2 is a cross-sectional view of a schematic configuration of another example of a generally known developing unit.

As illustrated in FIG. 10A, the development sleeve 141 of the developing roller 140 is disposed at a position higher than the development sleeve 1341 in the conventional developing unit 1314 of FIG. 2, so that the developer-releasing region P on the development sleeve 141 may not contact the surface of the developer in the developer storing chamber 149A while the development sleeve 141 is rotating. With this configuration, even though some amount of the developer still remains on the development sleeve 141, the residual developer on the development sleeve 141 may not be scraped off by the developer in the developer storing chamber 149A to be removed from the development sleeve 141. Therefore, the developing unit 14 shown in FIG. 10A can reduce an amount of stress on the developer, compared to the conventional developing unit 1314 shown in FIG. 2 in which the developer-releasing region P is designed to be held in contact with the developer in the developer storing chamber 1349A.

Further, in the conventional developing unit 14' of FIG. 10B, which may correspond to the conventional developing unit 1314 of FIG. 2, the developer attracted by the magnetic force generated by the magnetic pole N3 to form a hard magnetic brush receives a shearing force exerted by the conveyance screw 143 and another shearing force exerted by the developer conveyed by the conveyance screw 143 to the development sleeve 141 in an axial direction of the development sleeve 141. The shearing forces may cause a large amount of stress on the developer.

By contrast, in the developing unit 14 according to the first exemplary embodiment as shown in FIG. 10A, the developer of a hard magnetic brush formed by the magnetic force generated by the magnetic pole N3 may not be subject to the above-described shearing forces, and thus the stress on the developer can be further reduced.

In the conventional developing unit 1314 of FIG. 2, the developer in the developer storing chamber 1349A has a function for scraping off the developer from the development sleeve 1341. However, the developing unit 14 according to an exemplary embodiment of the present invention is not designed for holding the developer in the developer storing chamber 149A in contact with the developer-releasing region P. Therefore, if the developer is not sufficiently removed from the development sleeve 141 while passing the developer-releasing region P, the developer on the development sleeve 141 may remain thereon continuously.

In addition to the above-described function, the developer in the developer storing chamber 1349A in the conventional developing unit 1314 of FIG. 2 acts as a wall to prevent the developer released from the development sleeve 1341 in the developer-releasing region P from being attracted to a developer-attracting region, not shown, by the magnetic force generated by the magnetic pole N3 or being attracted by other developer that is attracted toward the developer-attracting region. The developer-attracting region is located downstream from and adjacent the developer-releasing region P (in the direction of rotation of the development sleeve 141) where the magnetic force generated by the magnetic pole N3 is exerted to scoop up the developer.

However, since the developer does not act as or not form such a wall in the first exemplary embodiment of the present invention, if the developer released from the developer-releasing region P is not moved away from the developer-attracting region sufficiently or remains in the vicinity of the developer-attracting region, the developer can adhere to the development sleeve 141 again.

With the above-described reasons, the developing unit 14 according to the first exemplary embodiment of the present invention is designed such that the normal component of the magnetic flux density Hr in the developer-releasing region P on the development sleeve 141 is directed to the north pole or N-pole direction, which is a positive direction same as the direction of the magnetic pole N2 and the magnetic pole N3, across the developer-releasing region P and does not form the local maximum point. By so doing, the release force can be effectively directed to the developer adhering to the development sleeve 141 in the developer-releasing region P. Details of this action will be described later. According to the above-described release force, the developing unit 14 according to the first exemplary embodiment of the present invention can effectively reduce the developer carryover and developer reattachment on the development sleeve 141 even if the developer in the developer storing chamber 149A does not scrape off the developer in the developer-releasing region P or act as the wall to prevent developer reattachment to the development sleeve 141.

Figure 11:
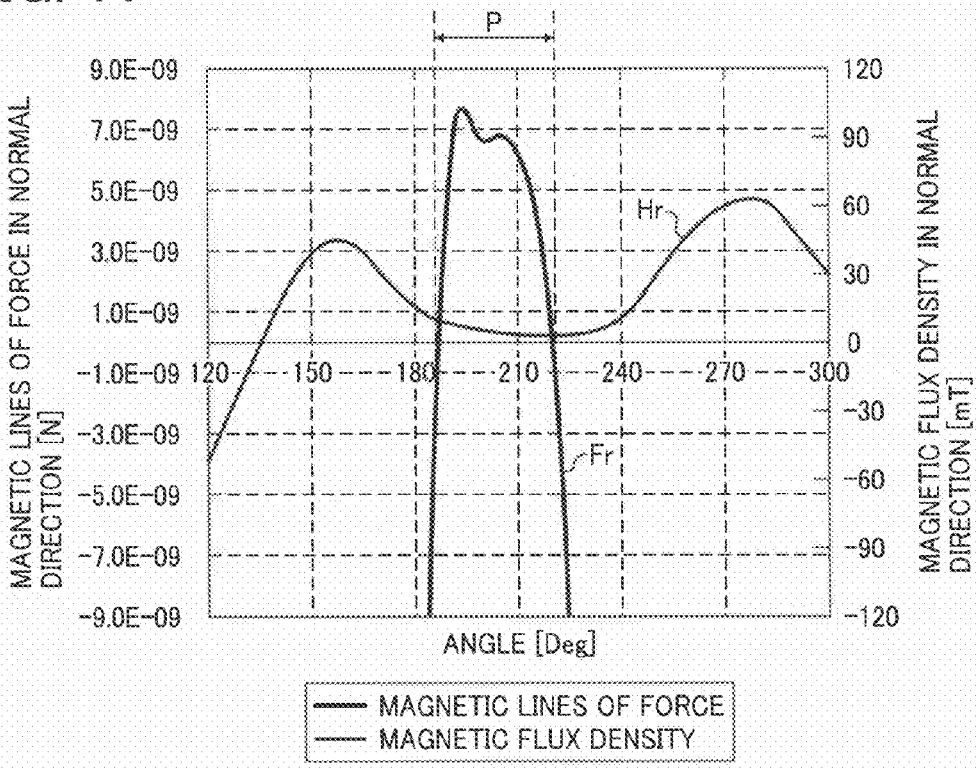
FIG. 11 is a graph showing a relation between a magnetic flux density in a direction normal to a developer-releasing region on the development sleeve and a magnetic force in a direction normal to the surface of the development sleeve in the developing unit according to an exemplary embodiment of the present invention.
Figure 12:
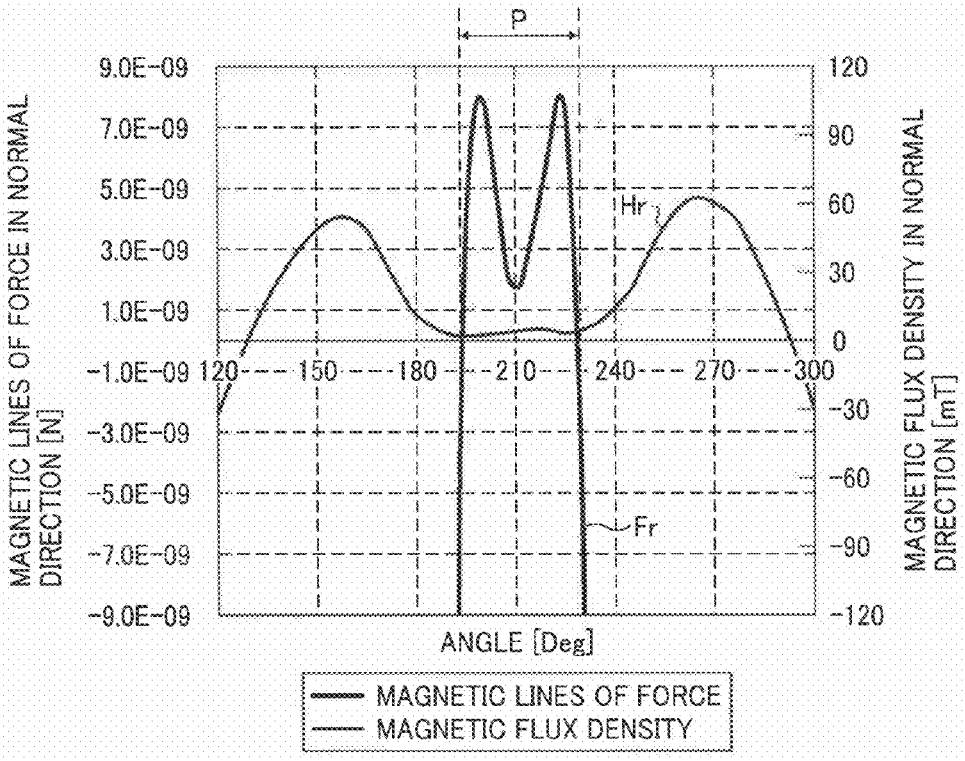
FIG. 12 is a graph showing a relation between a magnetic flux density in a direction normal to a developer-releasing region on the development sleeve and a magnetic force in a direction normal to the surface of the development sleeve in a comparative developing unit.

Next, descriptions are given of a relation between normal components of the magnetic flux density Hr and normal components of the magnetic force Fr with respect to respective surfaces of two different development sleeves, referring to graphs shown in FIGS. 11 and 12.

FIG. 11 is a graph showing a relation between the normal component of the magnetic flux density Hr to the surface of the development sleeve 141 around the developer-releasing region P and the normal component of the magnetic force Fr to the surface of the development sleeve 141 of the developing unit 14 according to the first exemplary embodiment of the present invention. The normal component of the magnetic flux density Hr is indicated by a thin line and the normal component of the magnetic force Fr is indicated by a thick line in the graph of FIG. 11.

Similarly to the graph of FIG. 11, FIG. 12 is a graph showing a relation between the normal component of the magnetic flux density Hr to the surface of a development sleeve around a developer-releasing region P of a developing unit according to a comparative example and the normal component of the magnetic force Fr to the surface of the development sleeve of the developing unit according to the comparative example. The normal component of the magnetic flux density Hr is indicated by a thin line and the normal component of the magnetic force Fr is indicated by a thick line in the graph of FIG. 12.

In these graphs of FIGS. 11 and 12, a region where the normal component of the magnetic force Fr drawn by the thick line obtains positive values corresponds to the developer-releasing region P.

The horizontal axis of the graphs indicates angles of the normal component of the magnetic force Fr to the development sleeve 141, when assuming that the direction of rotation of the development sleeve 141 or the counterclockwise direction is a positive direction and that a local maximum point of the normal component of the magnetic flux density Hr of the magnetic pole S1 to the development sleeve 141 has an angle of 0 degree.

The comparative developing unit basically has a similar structure as the developing unit according to the conventional developing unit, except that the development sleeve 141 is shifted upward, and the developer-releasing region P located on the development sleeve 141 does not contact the developer stored in the developer storing chamber 149A while the developer sleeve 141 is rotating.

The comparative developing unit has a configuration in which the normal component of the magnetic force Fr serving as a release force in the developer-releasing region P has two local maximum points, as shown in the graph of FIG. 12, and a sharp fall or drop occurs between the two local maximum points to form a local minimum point therebetween. The degree of the sharp fall corresponds to approximately 25% of the normal component of the maximum magnetic force Fr to the developer-releasing region P, and thereby causing large loss or negative factors.

To eliminate the large loss, the present inventors conducted further researches and studies, and found the reason why the local minimum point of the normal component of the magnetic force Fr sharply dropped as shown in the graph of FIG. 12. Specifically, an additional north pole was disposed between the magnetic pole N2 and the magnetic pole N3 to prevent from causing any inversion of the normal component of the magnetic flux density Hr. If the normal component of the magnetic flux density Hr inverts, a reverse point may be generated to exert a force to attract the developer to the development sleeve 141. Therefore, the additional north pole was disposed between the magnetic pole N2 and the magnetic pole N3 to prevent the inversion of the normal component of the magnetic flux density Hr. The additional north pole was magnetized weaker than the magnetic poles N2 and N3, and therefore the normal component of the magnetic flux density Hr to the developer-releasing region P on the development sleeve 141 may be directed to the north pole or N-pole direction, which is a positive direction same as the direction of the magnetic pole N2 and the magnetic pole N3, across the developer-releasing region P and does not have the attraction force to attract the developer to the developer-releasing region P on the development sleeve 141.

However, the weak north pole could form a small local maximum point corresponding thereto, as shown in the graph of FIG. 12, and the present inventors found that this small local maximum point caused a significant drop of the local minimum point of the normal component of the magnetic force Fr.

Thus, as shown in FIG. 11, the developing unit 14 according to the first exemplary embodiment of the present invention is designed such that the normal component of the magnetic flux density Hr to the developer-releasing region P on the development sleeve 141 is directed to the same positive direction as the magnetic pole N2 and the magnetic pole N3 across the developer-releasing region P and does not form the local maximum point.

Next, descriptions are given of examples of a manufacturing method of a magnetic roller 147 having a distribution of the normal component of the magnetic flux density as described above, referring to FIGS. 13 and 14.

Figure 13:
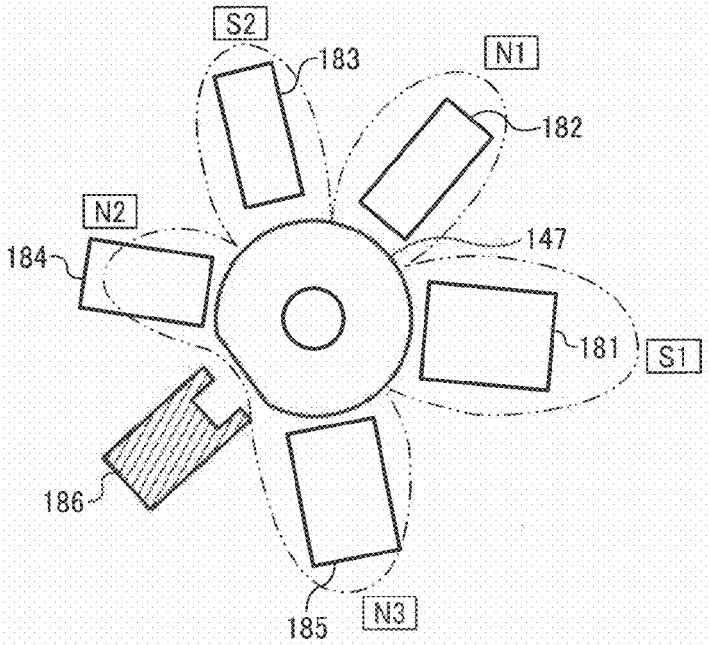
FIG. 13 is a schematic diagram for explaining a magnetizing process in manufacturing a magnetic roller of the developing unit according to an exemplary embodiment of the present invention.

FIG. 13 is a schematic diagram for explaining a magnetizing process in manufacturing the magnetic roller 147 of the developing unit 14 according to an exemplary embodiment of the present invention.

Figure 14:
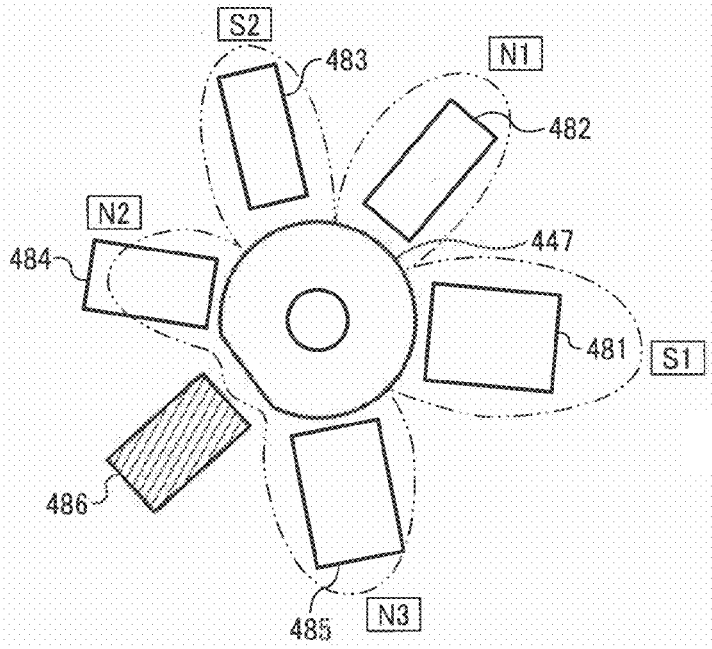
FIG. 14 is a schematic diagram for explaining a magnetizing process in manufacturing a magnetic roller of the comparative developing unit.

FIG. 14 is a schematic diagram for explaining a magnetizing process in manufacturing a magnetic roller 447 of the comparative developing unit.

The magnetic roller 147 is constituted as a cylindrical member of a resin mixed with magnetic powder and has a perimeter surface surrounded by or facing magnetizing yokes 181 to 186 so as to magnetize the exterior perimeter surface to form magnetic poles S1, N1, S2, N2, and N3 in this order. The magnetizing yokes 181 to 185 corresponding to the magnetic poles S1, N1, S2, N2, and N3 are different in size, shape, and intensity of magnetic force depending on each width of the corresponding magnetic pole and intensity of the corresponding magnetic field.

Similarly, the magnetic roller 447 is constituted as a cylindrical member of a resin mixed with magnetic powder and has a perimeter surface surrounded by or facing magnetizing yokes and 481 to 486 so as to magnetize the perimeter surface to form magnetic poles S1, N1, S2, N2, and N3 in this order. The magnetizing yokes 481 to 485 corresponding to the magnetic poles S1, N1, S2, N2, and N3 are different in size, shape, and intensity of magnetic force depending on each width of the corresponding magnetic pole and intensity of the corresponding magnetic field.

As shown in FIG. 14, the comparative developing unit forms the magnetizing yoke 486 between the magnetic pole N2 and the magnetic pole N3 to magnetize weaker than the magnetic pole N2 and the magnetic pole N3. Same as the other magnetizing yokes 481 to 485, the magnetizing yoke 486 has a flat surface that faces the perimeter surface of the magnetic roller 447, and therefore the center part of the flat surface thereof is most highly magnetized. With this reason, if the normal component of the magnetic flux density Hr to the developer-releasing region P on the development sleeve 141 is magnetized so as to surely be directed to the same positive direction as the magnetic pole N2 and the magnetic pole N3 across the developer-releasing region P, the local maximum point is formed as shown in the graph of FIG. 12 and as illustrated in FIG. 14.

By contrast, the developing unit 14 according to an exemplary embodiment of the present invention employs the magnetizing yoke 186 as shown in FIG. 13 so as to form a north pole between the magnetic pole N2 and the magnetic pole N3, which is magnetized weaker than the magnetic poles N2 and N3. Specifically, the magnetizing yoke 186 is arranged such that a surface thereof facing the magnetic roller 147 to be disposed farther from the exterior perimeter surface thereof than the surfaces of the magnetizing yokes 181 to 185. By arranging the surface of the magnetizing yoke 186 as described above, an amount of magnetization in the center part thereof can be smaller, and therefore the normal component of the magnetic flux density Hr to the developer-releasing region P on the development sleeve 141 can be magnetized to surely be directed to the same positive direction as the magnetic pole N2 and the magnetic pole N3 across the developer-releasing region P and the local maximum point may not be formed, as shown in the graph of FIG. 11 and as illustrated in FIG. 13.

The method of manufacturing the magnetic roller 147 described here is an example and is not limited to. The present invention can be applied to any other method capable of manufacturing a magnetic roller such that the normal component of the magnetic flux density Hr to the developer-releasing region P on the development sleeve 141 can be magnetized to surely be directed to the same positive direction as the magnetic pole N2 and the magnetic pole N3 across the developer-releasing region P and the local maximum point may not be formed therein.

Further, the present invention can be applied to the magnetic roller 147 and any other roller or member disposed such that the normal component of the magnetic flux density Hr to the developer-releasing region P on the development sleeve 141 can be magnetized to surely be directed to the same positive direction as the magnetic pole N2 and the magnetic pole N3 across the developer-releasing region P and the local maximum point may not be formed therein.

As previously described, the greater the local minimum point of the normal component of the magnetic force (i.e., the release force) Fr falls or drops, the greater the loss becomes when the developer is removed from the development sleeve 141 in the developer-releasing region P. As shown in the graph of FIG. 11, the developing unit 14 according to an exemplary embodiment of the present invention does not form the local maximum point to the normal component of the magnetic flux density Hr to the developer-releasing region P of the development sleeve 141, and therefore the normal component of the magnetic force Fr that has positive values can make the degree of the drop of the local minimum point smaller. Specifically, the normal component of the magnetic force Fr at the local minimum point is controlled to fall or drop to a certain level so that approximately 90% of the maximum values can be maintained. It is preferable that the degree of fall or drop can be reduced such that an amount of the normal component of the magnetic force (release force) Fr at the local minimum point is 50% or greater of the local maximum point. By so doing, the developing unit 14 according to the first exemplary embodiment of the present invention can effectively reduce developer carryover and developer reattachment on the development sleeve 141 even if the developer in the developer storing chamber 149A does not scrape off the developer in the developer-releasing region P or act as the wall to prevent the developer reattachment to the development sleeve 141, thereby effectively preventing image quality deterioration caused by the above-described reasons.

Figure 15:
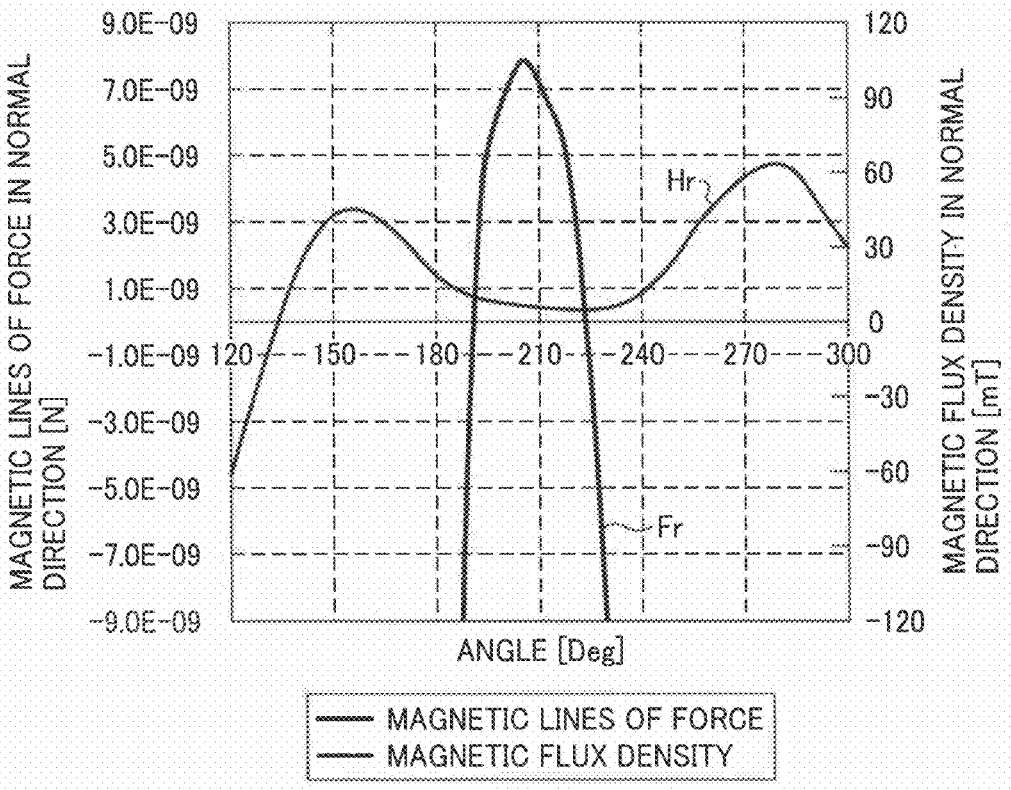
FIG. 15 is a graph showing a relation between a magnetic flux density in a direction normal to a developer-releasing region on the development sleeve and a magnetic force in a direction normal to the surface of the development sleeve in the developing unit according to a modified example of the present invention.

Next, a description is given of a first modified example of a relation between a normal component of the magnetic flux density and a normal component of the magnetic force with respect to a surface of a development sleeve, referring to graphs shown in FIG. 15.

FIG. 15 is a graph showing a relation between a normal component of the magnetic flux density Hr to a surface of the development sleeve 141 around the developer-releasing region P and a normal component of the magnetic force Fr to the surface of the development sleeve 141 of the developing unit 14 according to the first modified example of the present invention. The normal component of the magnetic flux density Hr is indicated by a thin line and the normal component of the magnetic force Fr is indicated by a thick line in the graph of FIG. 15.

As shown in the graph of FIG. 15, the developing unit 14 according to the first modified example of the present invention can include a configuration such that the normal component of the magnetic force (release force) Fr in the developer-releasing region P has a single local maximum point. Specifically, the magnetizing process of each magnetic pole provided to the magnetic roller 147 can be adjusted so that the normal component of the magnetic force (release force) Fr in the developer-releasing region P has a single local maximum point. With this configuration, the normal component of the magnetic force (release force) Fr may not form its local minimum point, and thereby not causing a fall or drop temporarily. Therefore, this configuration according to the first modified example can reduce or minimize the loss caused when removing the developer from the development sleeve 141 in the developer-releasing region P, and thus can effectively prevent image quality deterioration.

Figure 16A:
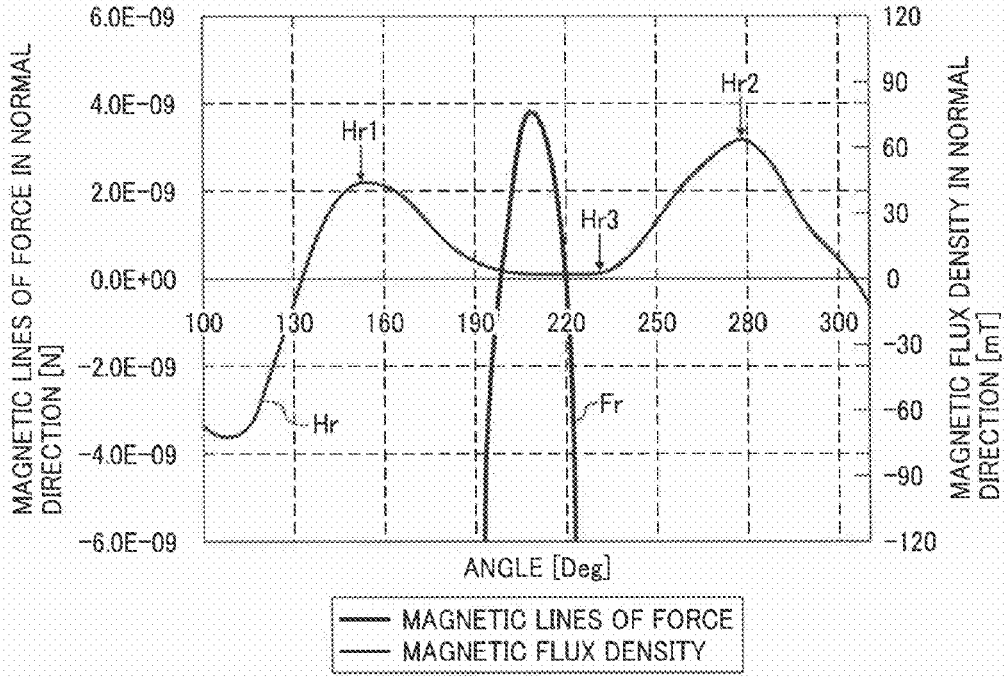
FIG. 16A is a graph showing a relation between a magnetic flux density in a direction normal to a developer-releasing region on the development sleeve and a magnetic force in a direction normal to the surface of the development sleeve in the developing unit according to another modified example of the present invention.
Figure 16B:
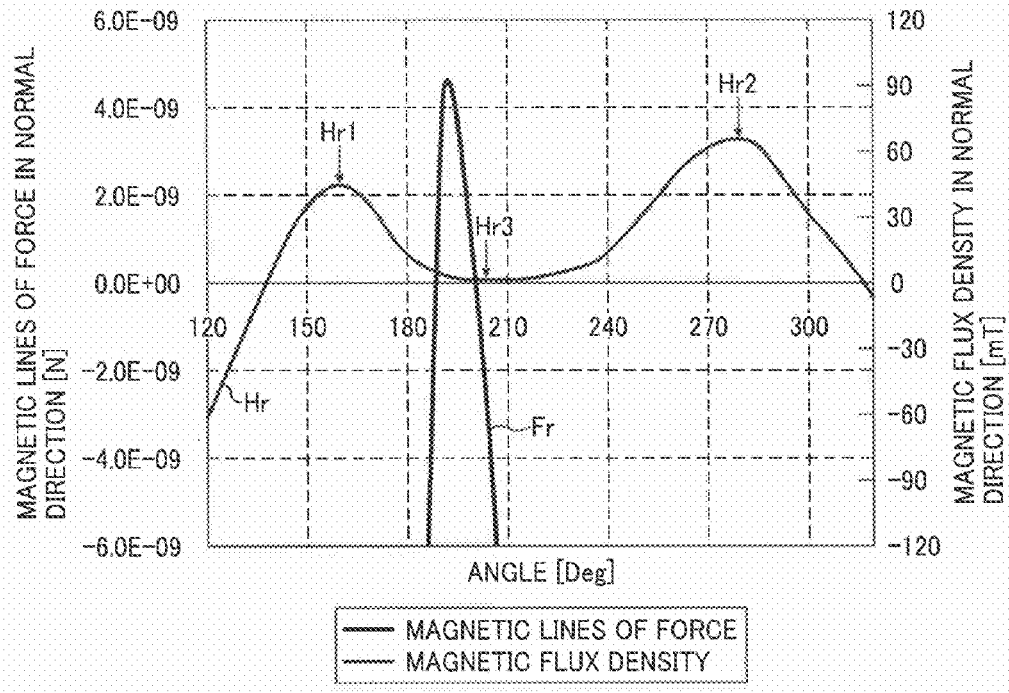
FIG. 16B is a graph showing a relation between a magnetic flux density in a direction normal to a developer-releasing region on the development sleeve and a magnetic force in a direction normal to the surface of the development sleeve in a comparative developing unit with respect to the developing unit of FIG. 16A.

Next, a description is given of a second modified example of a relation between normal components of the magnetic flux density Hr and normal components of the magnetic force Fr with respect to respective surfaces of two different development sleeves, referring to graphs shown in FIGS. 16A and 16B.

FIG. 16A is a graph showing a relation between a normal component of the magnetic flux density Hr to a surface of the development sleeve 141 around the developer-releasing region P and a normal component of the magnetic force Fr to the surface of the development sleeve 141 of the developing unit 14 according to the second modified example of the present invention. The normal component of the magnetic flux density Hr is indicated by a thin line and the normal component of the magnetic force Fr is indicated by a thick line in the graph of FIG. 16A.

Similarly to the graph of FIG. 16A, FIG. 16B is a graph showing a relation between a normal component of the magnetic flux density Hr to a surface of the development sleeve 141 around the developer-releasing region P and a normal component of the magnetic force Fr to the surface of the development sleeve 141 of a developing unit according to a comparative example to the second modified example. The normal component of the magnetic flux density Hr is indicated by a thin line and the normal component of the magnetic force Fr is indicated by a thick line in the graph of FIG. 16B.

In FIGS. 16A and 16B, "Hr1" represents a first local maximum point where the normal component of the magnetic flux density Hr of the magnetic pole N2 reaches a maximum on the development sleeve 141 in the developer conveyance direction of the development sleeve 141, "Hr2" represents a second local maximum point where the normal component of the magnetic flux density Hr of the magnetic pole N3 reaches a maximum on the development sleeve 141 in the developer conveyance direction of the development sleeve 141, and "Hr3" represents a local minimum point where the normal component of the magnetic flux density Hr to the development sleeve 141 between the first local maximum point Hr1 and the second local maximum point Hr2 reaches a minimum on the development sleeve 141.

As shown in the graph of FIG. 16A, the local minimum point Hr3 can be located closer to the second local maximum point Hr2 than to the first local maximum point Hr1 from a center point between the first local maximum point Hr1 and the second local maximum point Hr2. This arrangement can locate the developer-releasing region P close to the magnetic pole N3, thereby reducing reattachment of the removed developer to the developer sleeve 141.

The inventors of the present invention have found that the above-described developer reattachment is remarkably observed when a speed of the surface movement of the development sleeve 141 is 350 mm/sec or greater. The present invention can achieve a significant effect under the above-described condition.

The developing unit 14 according to the first exemplary embodiment, the developing roller 140 includes the magnet 155 that serves as a repulsive magnetic field generator. The magnet 155 is disposed between the magnetic pole N2 and the magnetic pole N3 as shown in FIG. 9.

Figure 17:
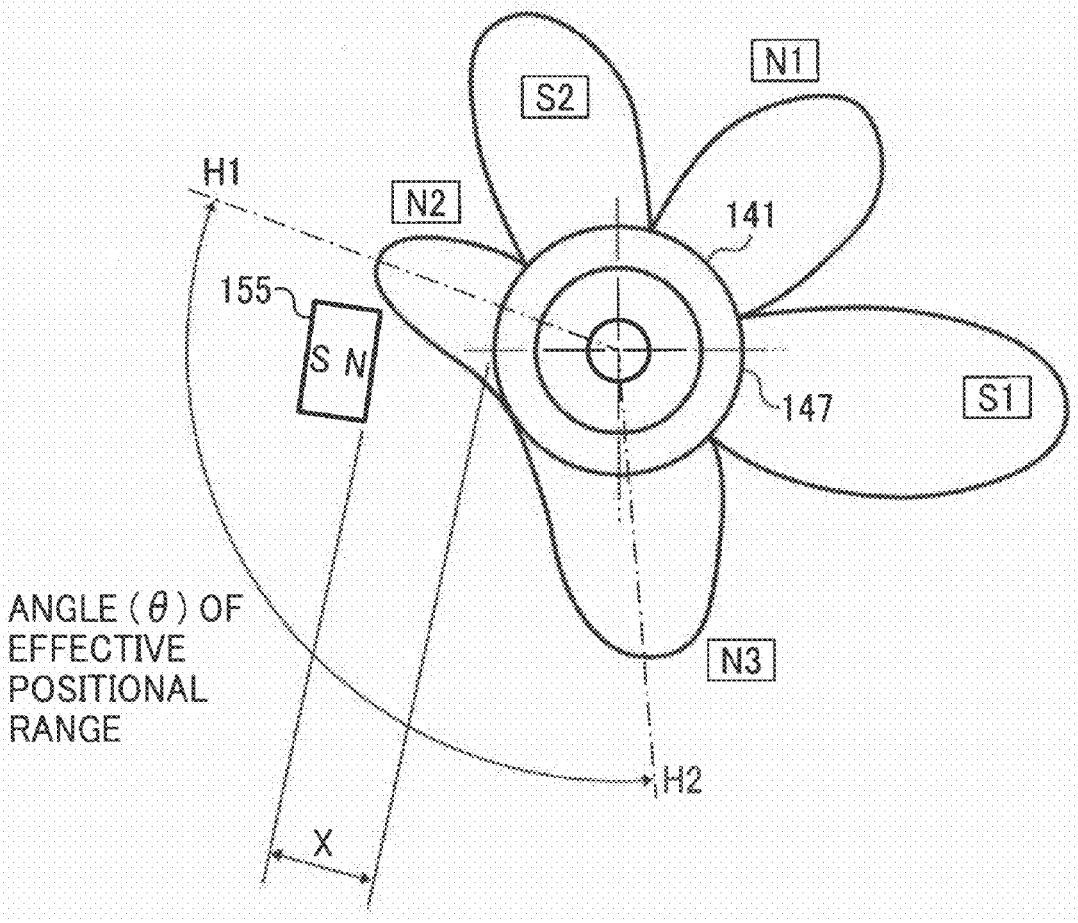
FIG. 17 is a drawing showing a position of a magnet with respect to the development sleeve according to an exemplary embodiment of the present invention.
Figure 18:
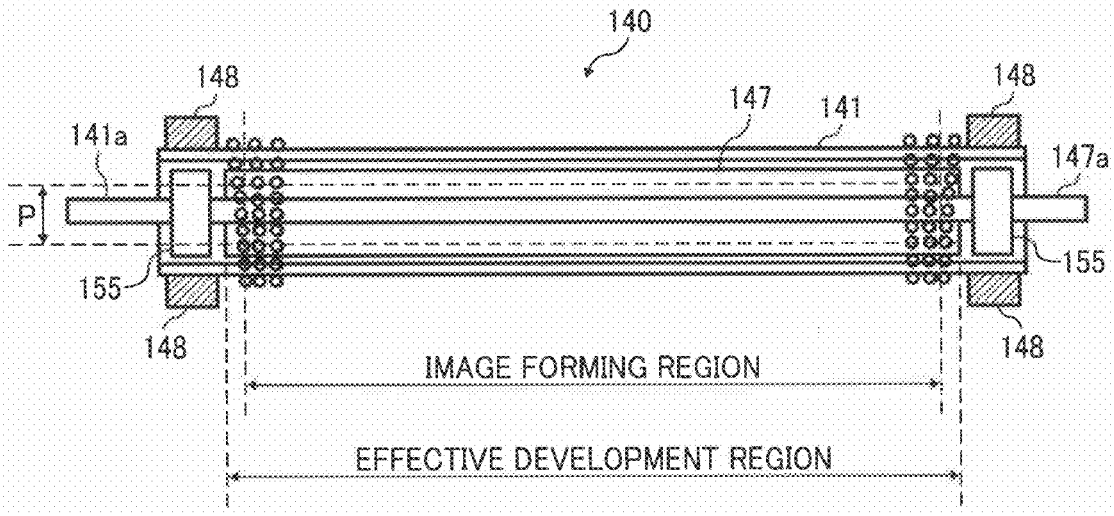
FIG. 18 is a drawing showing the position of the magnet of FIG. 17, viewed in an axial direction of the development sleeve.

For details, a description is given to a positional relation of the magnet 155 with respect to the magnetic poles of the development sleeve 141 with reference to FIGS. 17 and 18. FIG. 17 is a drawing to show the position of the magnet 155, viewed from one end of the development sleeve 141 along the direction of conveyance of developer by the development sleeve 141. FIG. 18 is a drawing to show the position of the magnet 155, viewed along a longitudinal or axial direction of the developing roller 140.

As illustrated in FIG. 17, the magnet 155 may be disposed at a position within an effective positional range with a given angle θ, which is a range between a normal line H1 to the local maximum point of the normal component of the magnetic flux density Hr of the magnetic pole N2 and a normal line H2 to the local maximum point of the normal component of the magnetic flux density Hr of the magnetic pole N3.

Also as illustrated in FIG. 18, the magnet 155 includes two magnets 155, each of which is disposed outside an opposed region of the effective development region of the magnetic roller 147 or an image forming region facing the magnetic roller 147 in the axial direction of the development sleeve 141. Each magnet 155 is disposed such that the magnetic pole face with the north pole same as the magnetic poles N2 and N3 is directed to the developer-releasing region P.

When the above-described magnet 155 is not incorporated, the previously described developer carryover and developer reattachment on the development sleeve 141 can occur in each end region in a direction along a shaft 141*a* of the development sleeve 141 in the opposed region of the effective development region of the magnetic roller 147 on the exterior perimeter surface of the development sleeve 141. Such a phenomenon may occur since, in the developer-releasing region P, magnetic field lines generated in the end region in the axial direction of the development sleeve 141 in the opposed region of the magnetic roller 147 may direct to the outside in the axial direction of the development sleeve 141. Therefore, the magnetic force exerting on the developer in the end regions has components directing toward the outside in the axial direction of the development sleeve 141. Therefore, the magnetic force serving as a release force cannot effectively exert the release force on the developer, and thereby causing the developer carryover and/or developer reattachment on the development sleeve 141.

Since the development sleeve 141 and the magnetic roller 147 are coaxially and integrally mounted as the developer roller 140, the shaft 141*a* of the development sleeve 141 corresponds to a shaft 147*a* of the magnetic roller 147.

As previously described, the configuration according to this exemplary embodiment of the present invention includes the magnet 155. Therefore, in the developer-releasing region P on the development sleeve 141, a direction of magnetic field lines in the each end region in the axial direction of the development sleeve 141 in a region opposite to the magnetic roller 147 can be close to a direction perpendicular to the direction of the shaft 141*a* of the development sleeve 141. This can increase in the release force in the end regions, which can cause the release force to be effectively exerted on the developer even in the end regions, so as to remove the developer from the outer perimeter surface of the development sleeve 141. As a result, the developer carryover and/or developer reattachment can be effectively reduced even in the end regions.

A magnetic pole face, which is the north pole face of the magnet 155, can be disposed at each end region of the magnetic roller 147 across the development sleeve 141 in the axial direction thereof. In this case, however, a part of the magnetic pole face disposed outside the end regions of the magnetic roller 147 may be arranged to generate a magnetic field greater than a different part of the magnetic pole face disposed inside the end regions of the magnetic roller 147 (i.e., a magnetic pole face facing the opposed region of the magnetic roller 147). For example, if the N-pole face of the magnet 155 has a magnetic force evenly on the N-pole face, the magnetic pole face of the magnet 155 can be arranged such that a part disposed outside the end regions of the magnetic roller 147 has area wider than other part disposed inside the end regions of the magnetic roller 147. With this configuration, even if the N-pole face of the magnet 155 is disposed across each end region of the magnetic roller 147 in the axial direction of the development sleeve 141, the direction of magnetic field lines at each end region of the magnetic roller 147 can be directed closer to a direction perpendicular to the axial direction of the development sleeve 141.

However, as described in the first exemplary embodiment, the configuration in which the N-pole face of the magnet 155 is disposed other than a position that faces the opposed region of the magnetic roller 147 is more effective to cause the direction of the magnetic field lines to make close to the direction perpendicular to the axis of the development sleeve 141, and therefore developer carryover can be reduced or prevented effectively.

Further, the developing unit 14 includes a seal member 148 to seal or eliminate space between the perimeter surface of the development sleeve 141 and the casing 144 of the developing unit 14. As shown in FIG. 17, the seal member 148 is disposed in a range between the normal line H1 to the local maximum point of the normal component of the magnetic flux density Hr of the magnetic pole N2 and the normal line H2 to the local maximum point of the normal component of the magnetic flux density Hr of the magnetic pole N3 in the developer conveyance direction of the development sleeve 141, which is within a range with a given angle indicated in FIG. 17. That is, the seal member 148 is disposed at each position outside the effective development range that covers the image forming region on the photoconductor drum 12 shown in FIG. 18. In the first exemplary embodiment of the present invention, the whole N-pole face of the magnet 155 is disposed outside an inner surface of the seal member 148 in the axial direction of the development sleeve 141. With this configuration, even if the magnet 155 is disposed at the position, it can prevent that the developer in the developer container 149 is accumulated therein due to the magnetic force of the magnet 155.

Further, in the first exemplary embodiment, the N-pole face of the magnet 155 is disposed so as to face the exterior perimeter surface of the development sleeve 141. However, the N-pole surface is not necessarily or limited to be disposed as above. For example, the N-pole face of the magnet 155 an be disposed outside the end region of the axis of the development sleeve 141 along the axis of the development sleeve 141. Specifically, for example, the magnet 155 can be disposed at the outer surface of the seal member 148 such that the N-pole face faces toward the center part of the axis of the development sleeve 141. Even with this configuration, the direction of magnetic field lines in each end region of the magnetic roller 147 in the axial direction of the development sleeve 141 can be close to a direction perpendicular to the axial direction of the development sleeve 141.

Further, in the first exemplary embodiment, a minimum distance "X" (see FIG. 17) between the N-pole face of the magnet 155 and the exterior perimeter surface of the development sleeve 141 is designed to become greater than the height or thickness of layer of the developer held on the exterior perimeter surface of the development sleeve 141. With this configuration, the developer carried on the developer sleeve 141 may not be affected to move or release therefrom due to the magnetic force generated by the magnet 155 while the development sleeve 141 is rotating, and therefore a targeted effect such as developer removal or release can be obtained without causing any problem.

Next, a description is given of the doctor supporting member 146*b*. As described in detail below, the doctor supporting member 146*b* serves as a magnetic member fixedly mounted on an upstream side face of the doctor blade 146.

Similar to the related-art developing unit 14 shown in FIG. 2, the developing unit 14 according to the first exemplary embodiment of the present invention does not have the polarity inversion point Q in an upstream part of a developer-regulating region so that developer may not accumulate in the upstream part of the developer-regulating region significantly, and therefore the developing unit 14 according to the first exemplary embodiment can reduce stress on the developer when compared with the conventional developing unit 1314 shown in FIG. 2. The developing unit 14 according to the first exemplary embodiment has the configuration in which the developer in the developer-releasing region P may not be scraped off by the developer stored in the developer storing chamber 149A, and therefore can further reduce the stress on the developer when compared to the conventional developing unit 1314 of FIG. 2, which has the configuration in which the developer-releasing region P contacts the developer stored in the developer storing chamber 149A.

Since the developing unit 14 according to the first exemplary embodiment of the present invention does not accumulate in the upstream part of the developer-regulating region, the developer accumulated in the upstream part of the developer-regulating region does not substantially average or mean the deviation of toner densities of the developer. Therefore, when the post-development developer remains on the surface of the development sleeve 141 or when the post-development developer is scooped up immediately after it falls on the surface of the developer stored in the first container or developer storing chamber 149A, the developer with a low toner density and the developer with a high toner density pass the developer-regulating region without being sufficiently mixed to be conveyed to the development region, which can result in unevenness in image density.

Figure 19:
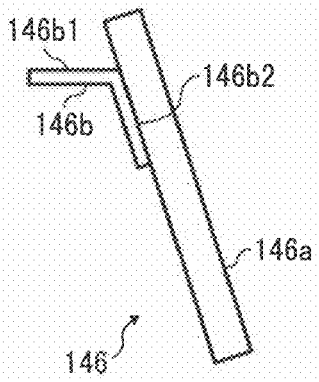
FIG. 19 is a drawing for explaining a schematic structure of a doctor blade included in the developing unit according to an exemplary embodiment, viewed from one end of the development sleeve.
Figure 20A:
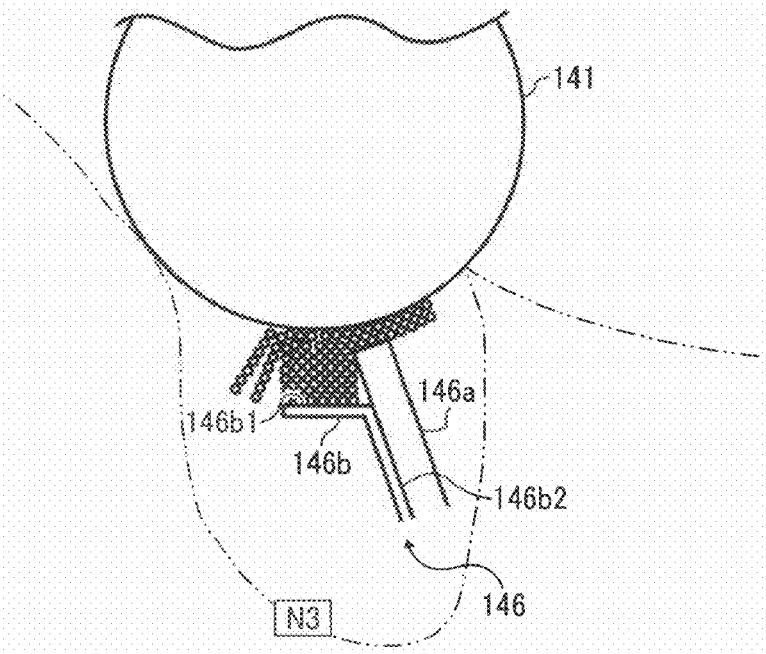
FIG. 20A is a drawing for explaining behavior of developer on an upstream side of the doctor blade of FIG. 19.
Figure 20B:
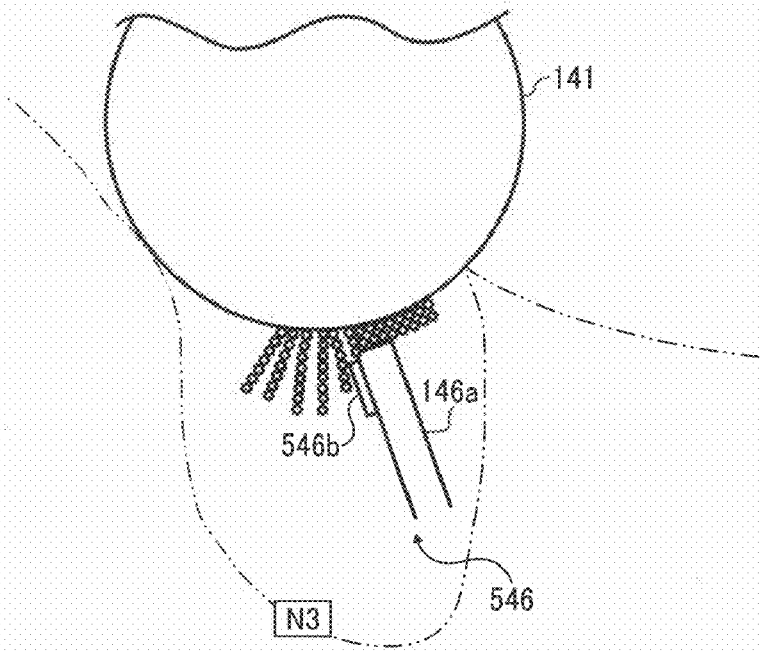
FIG. 20B is a drawing for explaining behavior of developer on an upstream side of a conventional doctor blade.

Next, descriptions are given of the doctor blade 146 according to the first exemplary embodiment of the present invention, with reference to FIGS. 19, 20A, and 20B.

FIG. 19 is a schematic structure of the doctor blade 146 according to the first exemplary embodiment, viewed from one end of the development sleeve 141. FIG. 20A is a drawing for explaining the developer on the upstream side of the doctor blade 146 according to the first exemplary embodiment of the present invention. FIG. 20B is a drawing for explaining the developer on the upstream side of a doctor blade 546 of a conventional developing unit.

The doctor supporting member 146*b* is obtained by bending a tabular thin plate through bending process such that a cross-section thereof forms substantially L-shaped. In the first exemplary embodiment, the thus-bent doctor supporting member 146*b* includes a first face 146*b*1 and a second face 146*b*2. The first face 146*b*, which is hereinafter also referred to as a "magnetic pole opposing face", is disposed to face the magnetic pole N3 over the whole image forming region along the axial direction of the development sleeve 141. The second face 146*b*2, which is hereinafter also referred to as an "adhesion face", adheres to the doctor base body 146*a* of the doctor blade 146. The adhesion face 146*b*2 adheres on the upstream part of the doctor base body 146*a* using a known process, so that the doctor supporting member 146*b* is fixed to the doctor base body 146*a*.

In the first exemplary embodiment of the present invention, the magnetic pole opposing face 146*b*1 disposed to the magnetic pole N3 over the entire image forming region facing the effective development region is directed to be a substantially same direction as a tangential direction of a region on the development sleeve 141 where the normal component of the magnetic flux density Hr generated by the magnetic pole N3 exists.

Further, in the first exemplary embodiment of the present invention, the magnetic pole opposing face 146*b*1 is formed such that a direction normal to the center part of the magnetic pole opposing face 146*b*1 and a direction normal to a point on which a shortest distance between the exterior perimeter surface of the development sleeve 141 and the magnetic pole opposing face 146*b*1 are a substantially same direction.

The conventional developing unit shown in FIG. 20B includes a magnetic sheet 546*b* that is formed by a thin tabular body with a sheet-like surface. The surface of the magnetic sheet 546*b* adheres to an upstream face of the doctor base body 146*b* of the doctor blade 146 so that an end face of the magnetic sheet 546*b* faces the magnetic pole N3. In the conventional developing unit with the above-described configuration, developer in the upstream part of the doctor blade 546 rises by the magnetic force exerted by the magnetic pole N3 to form a magnetic brush, as shown in FIG. 20B. Due to the above-described action, the developer in the upstream part of the doctor blade 546 may have a lower density and is restrained on the exterior perimeter surface of the development sleeve 141 by a large magnetic force. Therefore, the substantially whole developer that has entered the upstream part of the doctor blade 546 slides and moves by following the movement of surface of the development sleeve 141, and passes the developer-regulating region. Accordingly, when the developer having significant deviation in toner densities is conveyed to the upstream part of the doctor blade 546, the developer slides and passes the developer-regulating region, which may result in unevenness in image density.

By contrast, since the developing unit 14 according to the first exemplary embodiment has the configuration in which the magnetic pole opposing face 146*b*1 is directed to face the magnetic pole N3, a wide region to which the magnetic field is concentrated is formed between the magnetic pole opposing face 146*b*1 and the magnetic pole N3, as shown in FIG. 20A. That is, the magnetic field concentrated region between the magnetic pole opposing face 146*b*1 in the upstream part of the doctor blade 146 and the magnetic pole N3 is more extended than the conventional developing unit of FIG. 20B in the developer conveyance direction of the development sleeve 141. Therefore, in this exemplary embodiment, the developer that has entered to the magnetic field concentrated region in the upstream part of the doctor blade 146 moves in the magnetic field concentrated region as the developer is interfered by colliding with the developer restrained in the magnetic field concentrated region or by being restrained by the magnetic field in the region. As a result, even if the developer having significant deviation of different toner densities is conveyed to the magnetic field concentrated region, the deviation of the toner densities of the developer may be averaged or smoothed after the developer has passed the region, thereby reducing the deviation of the toner densities.

Even in the conventional developing unit shown in FIG. 20B, from a microscopical point of view, it is estimated that a narrow or small magnetic field concentrated region is formed between the end surface of the magnetic sheet 546*b* and the magnetic pole N3, and that the developer in the narrow magnetic field concentrated region of the conventional example acts same as the developer in the magnetic field concentrated region of the exemplary embodiment. However, in the conventional developing unit shown in FIG. 20B, the length or distance in the magnetic field concentrated region is too short to substantially achieve an effect to average or mean the fluctuations of the toner densities in the developer so as to reduce the unevenness in image density.

Further, even if the magnetic sheet 546*b* is thickened to have a substantially same length or distance as that of the magnetic field concentrated region formed between the end surface of the magnetic sheet 546*b* and the magnetic pole N3, the magnetic sheet 546*b* may increase in size, which may disturb the magnetic field on the exterior perimeter surface of the development sleeve 141 significantly. Therefore, adverse affects such as poor developer conveyance and/or poor developer attraction by the development sleeve 141 may be exerted.

Further, in this exemplary embodiment, the doctor supporting member 146*b* is disposed such that the upstream end part of the magnetic pole opposing face 146*b*1 is located upstream from a normal line to a point where the normal component of the magnetic flux density Hr generated by the magnetic pole N3 reaches a maximum on the development sleeve 141, as shown in FIGS. 9 and 20A. With this configuration, the magnetic field concentrated region can be formed with the largest magnetic force, and therefore an effect greater than the effort to average or mean the fluctuation of toner densities of the developer can be obtained. However, if the upstream end part of the magnetic pole opposing face 146*b*1 extends to an exceedingly upstream part, poor developer attraction can occur. Therefore, an extension of the upstream end part of the magnetic pole opposing face 146*b*1 is limited.

Further, in this exemplary embodiment, the doctor blade 146 is disposed such that an upstream end part of the developer-regulating region of the doctor blade 146 is located downstream from a normal line to a point where the normal component of the magnetic flux density Hr generated by the magnetic pole N3 reaches a maximum on the development sleeve 141, as shown in FIGS. 9 and 20A. With this configuration, the developer can be cut at which the thick magnetic brush is bent, and therefore a constant amount of developer degraded with time can be supplied to the development region.

Figure 21:
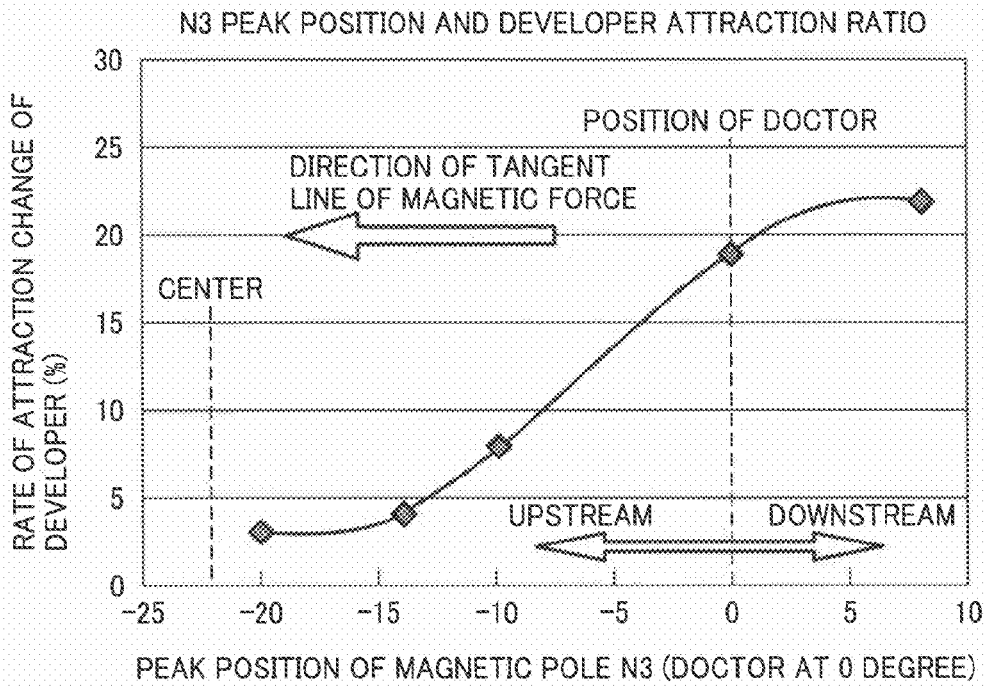
FIG. 21 is a graph showing rates of change in attraction of developer in various developer-regulating regions.

Next, a detail description is given of a rate of change of developer attraction with respect to the developer-regulating region, with reference to a graph of FIG. 21.

In the graph of FIG. 21, a vertical axis indicates angle of the local maximum point where the component of the magnetic flux density Hr generated by the magnetic pole N3 reaches its local maximum point on the development sleeve 141, which is a peak position of the magnetic pole N3, to the doctor blade 146, and a horizontal axis indicates the rate of change of developer attraction. The angle along the horizontal axis of the graph shown in FIG. 21 indicates that an angle of the developer-regulating region of the doctor blade 146 is "0 degree". A direction with positive values of the peak position indicates that the peak of the magnetic pole N3 is located downstream from the developer-regulation region, and a direction with negative values of the peak position indicates that the peak of the magnetic pole N3 is located upstream from the developer-regulation region.

Further, the rate of change of developer attraction along the vertical axis of the graph shown in FIG. 21 indicates results of calculation in a unit of percentage (%), based on an equation: New Developer−Degraded Developer/New Developer. That is, the rate of change of developer attraction is obtained by subtracting a ratio of an amount of attraction of degraded developer with respect to an amount of attraction of new developer (an amount of developer that passes the regulation region to the development region) from the amount of new developer. When the rate of change of developer attraction is zero (0%), changes in new developer and degraded developer are small. On the other hand, the larger the rate or percentage of change is, the greater the amount of developer attraction becomes.

As shown in the graph of FIG. 21, as the peak of the magnetic pole N3 with respect to the doctor blade 146 shifts to the upstream side, the rate of change of developer attraction becomes smaller. This phenomenon can be explained with the tangential component of the magnetic force of the exterior perimeter surface of the development sleeve 141.

Figure 22:
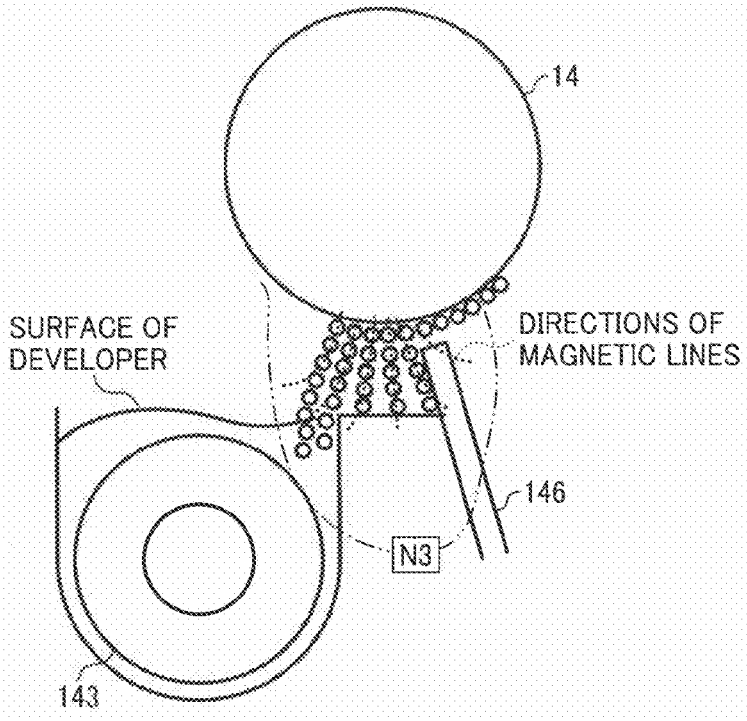
FIG. 22 is a drawing for explaining a distribution of magnetic force in the vicinity of the developer-regulating region of the doctor blade of FIG. 19.

Referring to FIG. 22, a description is given of a distribution of magnetic forces in the vicinity of the developer-regulation region of the doctor blade 146.

The tangential component of the magnetic force is zero (0) at the peak of the normal component of the magnetic force or the peak of the magnetic pole N3. However, as the position of the normal component of the magnetic force shifts to the downstream side, the tangential component of the magnetic force is gradually increased. By using the tangential component of the magnetic force, good developer attraction can be stably maintained.

Figure 23:
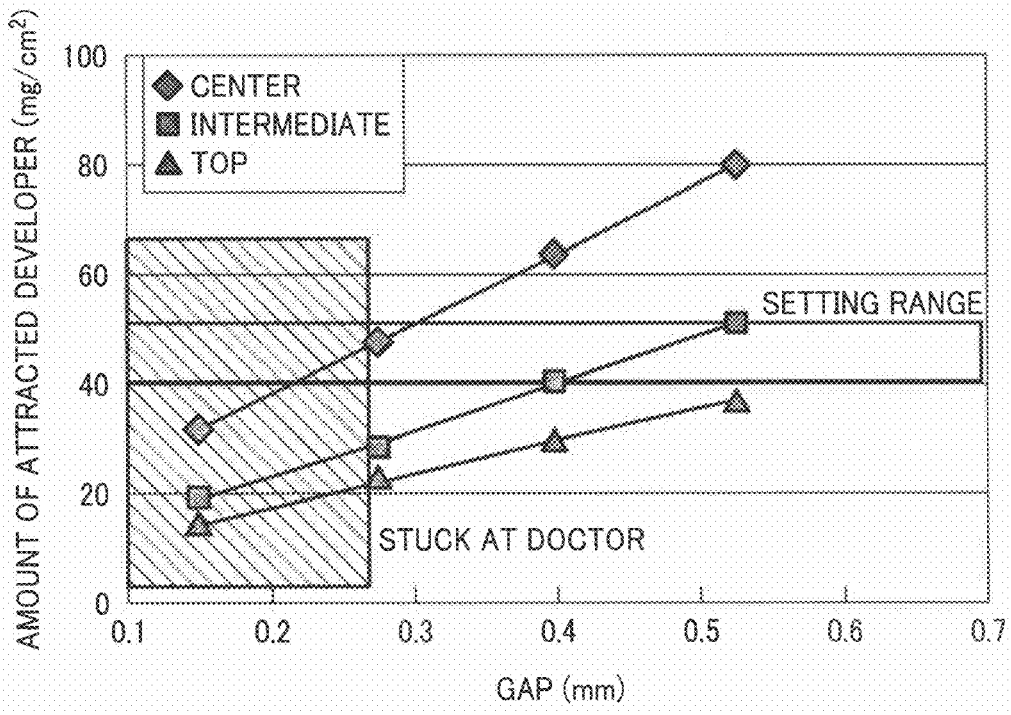
FIG. 23 is a graph showing results of measurement of developer attraction with respect to multiple doctor gaps when the developer-regulating region is changed according to magnetic poles.

Referring to FIG. 23, a description is given of results of the amount of developer attraction with respect to multiple doctor gaps when the developer-regulating region of the doctor blade 146 to the magnetic pole of the magnetic roller 147 is changed.

The graph of FIG. 23 shows the results of measuring the amounts of developer attraction to the respective doctor gaps by changing the developer-regulating region of the doctor blade 146 to the following three positions: a top position where the developer-regulating region of the doctor blade 146 corresponds to the peak of the magnetic pole N3; a center position where the developer-regulating region of the doctor blade 146 is located at the center of two magnetic poles along the developer conveyance direction of the development sleeve 141; and an intermediate region where the developer-regulating region of the doctor blade 146 is located between the center thereof and the magnetic pole at the downstream side.

As can be seen from the graph of FIG. 23, as the developer-regulating region of the doctor blade 146 becomes closer to the center position between the two magnetic poles, the amount of developer attraction is more increased. Therefore, as the developer-regulating region of the doctor blade 146 becomes closer to the center position between the two magnetic poles, the doctor gap to obtain a desired amount of attraction of developer becomes narrower. With the above-described configuration, the doctor gap can easily become stuck by foreign materials, which may increase production of defected images.

On the other hand, as the developer-regulating region of the doctor blade 146 becomes closer to the top position, the amount of developer attraction decreases. Therefore, it may be more difficult to obtain a desired amount of developer attraction.

Accordingly, it is preferable that the developer-regulating region of the doctor blade 146 is located at the intermediate position. It is more preferable that the developer-regulation region of the doctor blade 146 is located at a position on the development sleeve 141 where the normal component of the magnetic flux density Hr reaches ⅓ of the maximum amount thereof.

Figure 24:
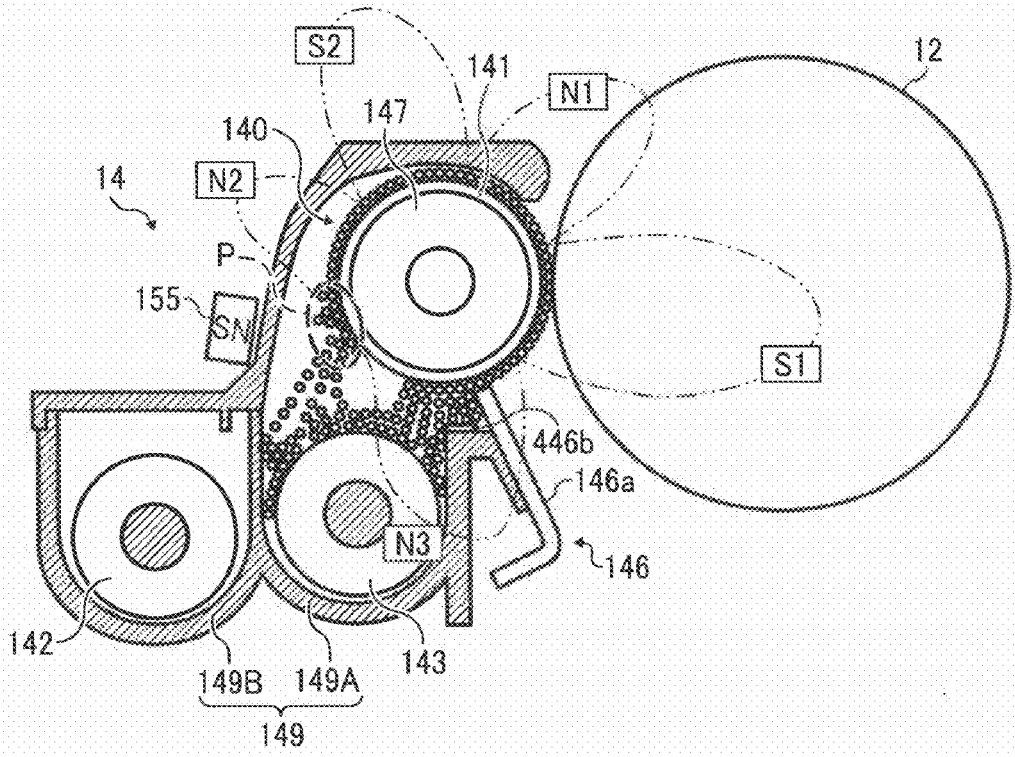
FIG. 24 is a cross-sectional view of the developing unit, showing a modified example of position of the magnetic member.

In this exemplary embodiment, the doctor supporting member 146*b* serving a magnetic member is fixedly mounted on the doctor base body 146*b* of the doctor blade 146 so as to compensate rigidity of both sides. However, the magnetic member is not limited to but can be disposed separate from the doctor base body 146*a* of the doctor blade 146. For example, as shown in FIG. 24, a magnetic member 446*b* can be attached to the inner wall of the casing 144. By disposing the magnetic member separate from the doctor blade 146, a constant distance between the development sleeve 141 and the magnetic member 446*b* can be maintained stably regardless of the gap between the doctor blade 146 and the development sleeve 141, thereby achieving an effect to average the deviation of toner densities of developer stably.

Figure 25:
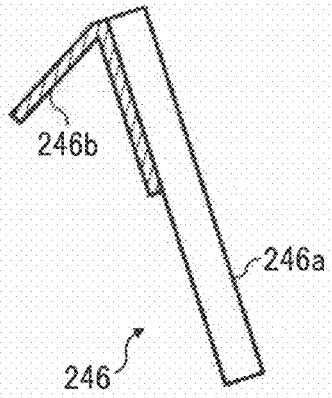
FIG. 25 is a drawing for explaining a configuration with a different shape of a doctor supporting member of the doctor blade.

Further, as a doctor supporting member that can be used in this exemplary embodiment, a doctor blade 246 has a V-shaped doctor supporting member 246*b* that is fixedly mounted at the upstream part of the doctor blade 246 on a doctor base body 246*a* thereof, as shown in FIG. 25.

Second Exemplary Embodiment

Figure 26:
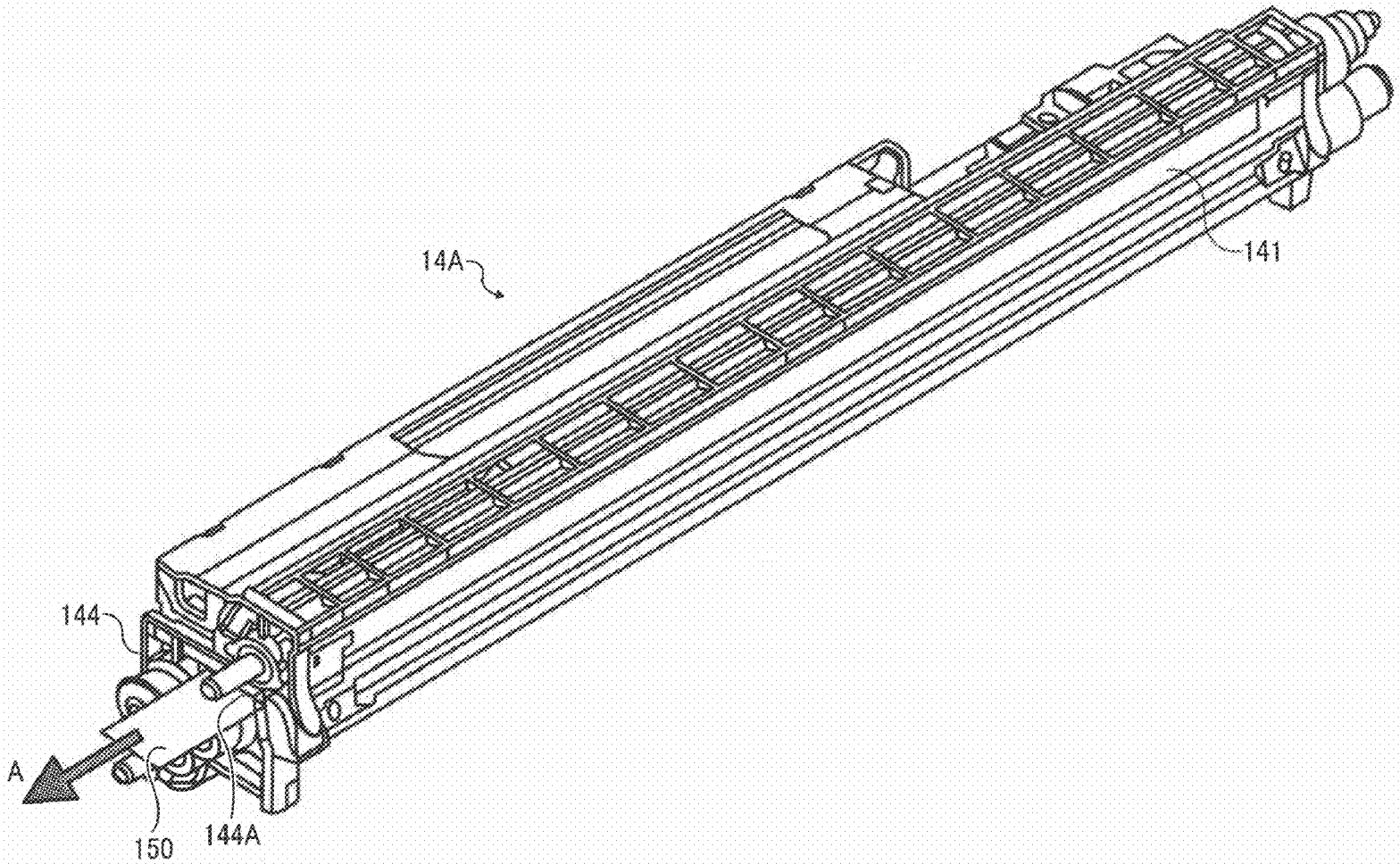
FIG. 26 is a perspective view of a developing unit according to an exemplary embodiment of the present invention.
Figure 27:
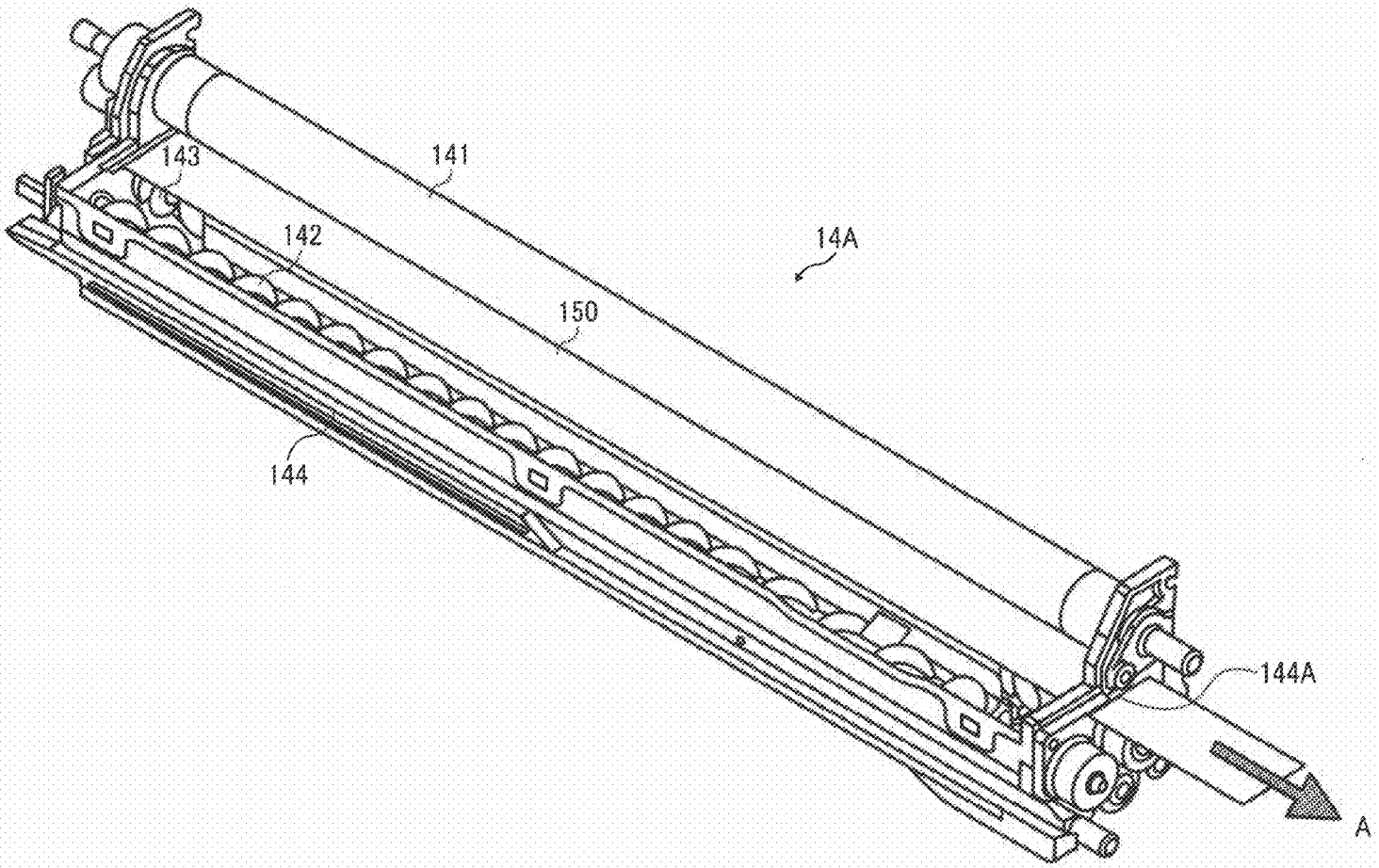
FIG. 27 is a perspective view of the developing unit of FIG. 26 with a top part of a casing open.
Figure 28:
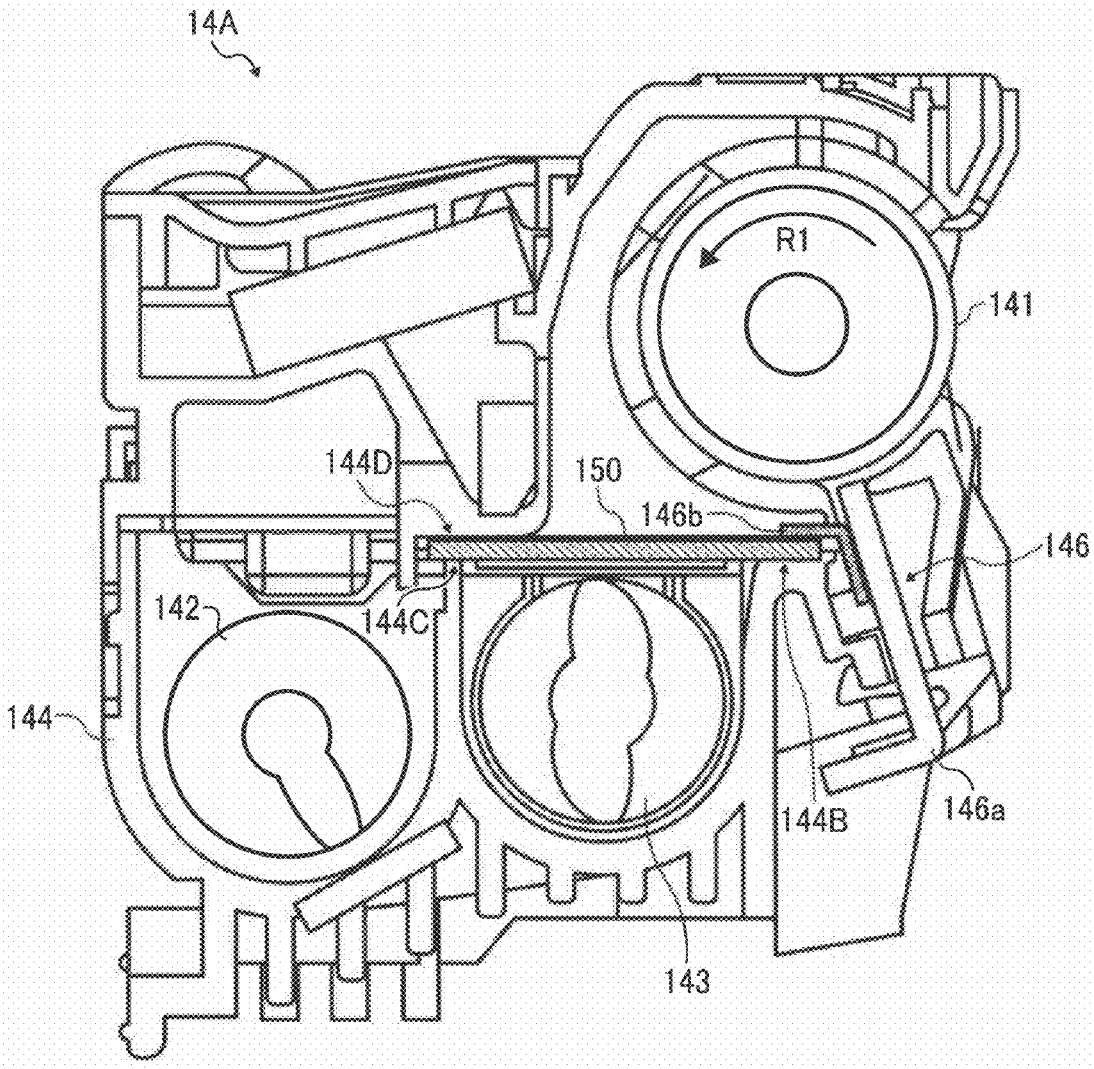
FIG. 28 is a cross-sectional view of a schematic configuration of the developing unit of FIG. 26, viewed from an end side in a direction perpendicular to an axis of a development sleeve included in the developing unit.

Next, descriptions are given of another configuration of a developing unit 14A for use in an image forming apparatus such as a copier, printer, facsimile machine, and so forth, according to a second exemplary embodiment of the present invention, referring to FIGS. 26 to 28.

Since the configuration of the developing unit 14A according to the second exemplary embodiment is basically similar to the configuration of the developing unit 14 according to the first exemplary embodiment, units or components of the developing unit 14A according to the second exemplary embodiment may be denoted by the same reference numerals as those of the developing unit 14 according to the first exemplary embodiment and the descriptions thereof are omitted or summarized.

Generally, when shipping and transporting developing units that contain two-component developer including toner particles and magnetic carrier particles, outside air is preferably shut down from the developer in the developing units. It is because the performance of the toner components in the developer may easily be degraded due to humidity and temperature conditions, and the developer is likely to leak or escape from the developing units due to vibration during transportation.

As a conventional method or first method for shutting down air from developer, it is known that a developer preset case has been disposed above a developer container that includes an agitation/conveyance screw for agitating and conveying developer, and a seal member has also been detachably adhered to an inner wall of a developing unit for shutting down space between the developer container and the developer preset case. With this method, by pulling out the seal member to outside the developing unit when an image forming apparatus incorporating the developing unit with the above-described components is installed to a place of use, an adhered surface of the seal member is removed from the inner wall of the developing unit, which allows the developer container and the developer present case to communicate with each other so that developer stored in the developer preset case can move into the developer container for development by the developing unit.

A different conventional method or second method for shutting down air from the developer, it is also known that a seat-like seal member has been detachably attached to an inner wall of a developing unit to shut down space between a development sleeve and an agitation/conveyance screw for sealing the developer in a developer container or agitation space where the agitation/conveyance screw is disposed. Since this method does not require the developer present case, the size of the developing unit can be reduced.

For example, Japanese Laid-open Patent Publication No. 2002-372862 discloses a technique that employs the second method used for an image forming apparatus. In the image forming apparatus using the technique, a separation frame with a seal member thereon is incorporated to an inside of the developing unit between a development sleeve and an agitation/conveyance screw to eliminate complex operations to attach the seal member to the inner wall of the developing unit when manufacturing and reuse. However, the separation frame remains inside the developing unit of the image forming apparatus even after the seal member is pulled out to outside the developing unit at the start of its use, even though the separation frame is not used for image forming. That is, it has been likely that the separation frame that is not necessary for image forming limits flexibility of the interior layout of the developing unit.

Further, an end portion of the separation frame extending in a direction of a rotary axis of the development sleeve may obstruct a movement of developer in the developer container that corresponds to the end region of the development sleeve, which can easily cause unevenness in image density on an image where an end region of the axis of the development sleeve is disposed.

Further, as a method for detachably attaching the sheet-like seal member to the separation frame, a sheet material for a heat adhesive layer formed on one side of a laminate film of polyethylene and nylon, for example, is deposit using a welding jig with a shape of the separation frame. However, the configuration with the sheet-like seal member can increase manufacturing cost.

Considering the above-described issues, a method that does not leave a useless member such as the separation frame in the developing unit and that does not require a process for attaching a seal member is desired as a method for shutting down air from the developer. The developing unit 14A according to the second exemplary embodiment of the present invention can provide a configuration that can achieve such a method.

FIG. 26 is a perspective view of the developing unit 14A according to the second exemplary embodiment. FIG. 27 is a perspective view of the developing unit 14A of FIG. 26, with the top part of the casing 144 open so as to show the inside of the developer container 149 of the developing unit 14A. FIG. 28 is a cross-sectional view of a schematic configuration of the developing unit 14A, viewed from an end side in a direction perpendicular to an axis of the development sleeve 141.

Before using the developing unit 14A, one end part of a seal member 150 according to the second exemplary embodiment protrudes from a slot arranged at one end portion of the casing 144 along an axial direction of the developing sleeve 141, which rotates in a direction indicated by arrow "R1" in FIG. 28. By pulling the end part of the seal member 150 along a direction indicated by "A" in FIGS. 26 and 27, which is the axial direction of the development sleeve 144, the seal member 150 may be taken out from the developing unit 14A.

As illustrated in FIG. 28, when shipping or transporting the image forming apparatus incorporating the developing unit 14A according to the second exemplary embodiment, the seal member 150 shuts down space between the development sleeve 141 and the conveyance screws 142 and 143 to seal the developer container 149 in which the conveyance screws 142 and 143 for agitating the developer. At this time, the developer container 149 contains some amount of developer. However, since the seal member 150 has sealed the developer container 149, the developer may not be exposed to outside air until the seal member 150 is taken out from the developing unit 14A, and therefore the developer may not change its characteristics or may not escape or flow out of the developer container 149.

In the second exemplary embodiment, the seal member 150 is an elongate planar member extending along the axial direction of the development sleeve 141. As illustrated in FIG. 28, the seal member 150 is simply held in contact with the inner wall of the casing 144 without using adhesive. However, to retain the contact condition of the seal member 150 against the inner wall of the casing 144, the seal member 150 in the second exemplary embodiment is sandwiched between the inner wall of the casing 144 and the doctor supporting member 146*b* serving as a retaining member at a position 144B in the axial direction of the development sleeve 141 and is also sandwiched between a position 144C indicating a lower portion of the inner wall of the casing 144 and a position 144D indicating an upper portion of the inner wall of the casing 144. With this configuration, the seal member 150 is taken out from the developing unit 14A in the axial direction of the development sleeve 141 while slidably moving at these positions where the seal member 150 is supported.

According to the second exemplary embodiment, any member that is unnecessary after the developing unit 14A has been used may not remain in the developing unit 14A, and therefore such an unnecessary member does not limit the flexibility of the interior layout of the developing unit 14A. Further, in the second exemplary embodiment, the seal member 150 is not fixed against the inner wall with adhesive but is simply held in contact with the inner wall of the developing unit 14A, thereby reducing the manufacturing costs.

Third Exemplary Embodiment

Figure 29:
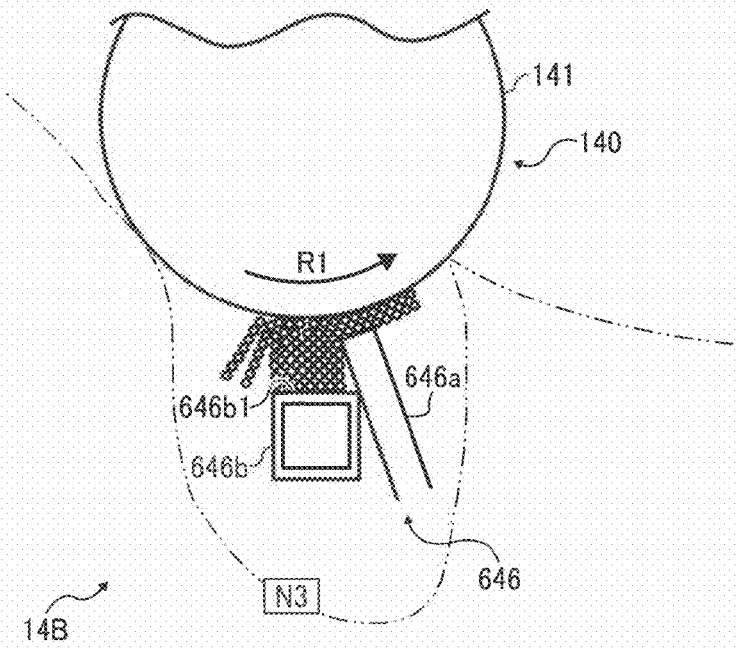
FIG. 29 is a drawing for explaining a hollow member of a doctor blade according to an exemplary embodiment of the present invention.
Figure 30:
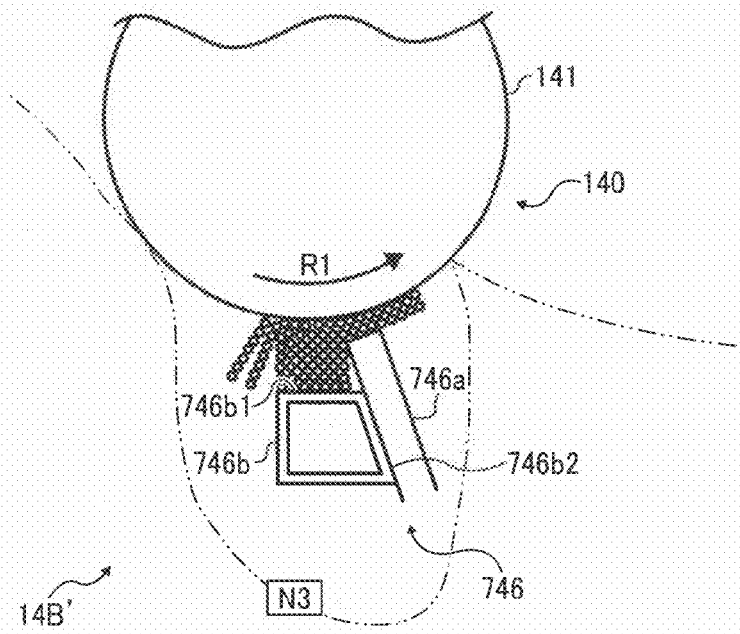
FIG. 30 is a drawing for explaining another hollow member of a modified doctor blade according to an exemplary embodiment of the present invention.

Next, descriptions are given of another configuration of a developing unit 14B for use in an image forming apparatus such as a copier, printer, facsimile machine, and so forth, according to a third exemplary embodiment of the present invention, referring to FIGS. 29 and 30.

Since the configuration of the developing unit 14B according to the third exemplary embodiment is basically similar to the configuration of the developing unit 14 according to the first exemplary embodiment, units or components of the developing unit 14B according to the third exemplary embodiment may be denoted by the same reference numerals as those of the developing unit 14 according to the first exemplary embodiment and the descriptions thereof are omitted or summarized.

In the vicinity of the developer-regulating region where a doctor blade 146 regulates the thickness of a layer of developer, heat can be generated due to friction between the doctor blade 646 and the developer, friction between the surface of the development sleeve 141 and the developer, friction between the developers, and so forth. An increase in temperature caused by the heat generates aggregates of toner particles in the developer and reduces the life of developer by promoting toner spent to the magnetic carrier due to softening of toner. Further, the external additives adhering to the toner particles may bury in each particle of toner to cause the magnetic carrier particles to directly contact with each other, which can deform the magnetic carrier particles to degrade the developer. Further, the increase in temperature of toner in the developer can cause toner filming on the surface of the development sleeve 141. That is, an increase in temperature of toner can soften the toner to eventually melt the toner. In this case, the melted toner adheres in a form of film to the surface of the development sleeve 141 to cause the toner filming. Further, if the aggregates of toner particles are easily generated due to an increase in temperature of toner as described above, the aggregated toner particles is stuck between the development sleeve 141 and the doctor blade 646 or in a doctor gap S, which is likely to cause white streaks on an output image. Further, in recent years, there is a trend to lower a fixed temperature to satisfy the demands for energy saving. However, to meet the demands, toner with a lower melting point is employed, which further increases in importance to restrain the temperature increase at the developer-regulating region.

To restrain the increase in temperature at the developer-regulating region, the developing unit 14B in the third exemplary embodiment includes a hollow member 646*b* of a doctor blade 646 instead of the doctor supporting member 146*b* that is disposed in the developing unit 14 according to the first exemplary embodiment. The hollow member 646*b* of the doctor blade 646 is constituted as a hollow region therein extending along the rotary axis of the development sleeve 141.

FIG. 29 is a drawing for explaining the hollow member 646*b* of the doctor blade 646 by its shape and action, viewed from one end portion of the development sleeve 141, which rotates in a direction indicated by arrow "R1", of the developing roller 140.

As shown in FIG. 29, the hollow member 646*b* is disposed upstream from a doctor base body 646*a* of the doctor blade 646 in a direction of rotation of the development sleeve 141 and is processed to have a hollow and substantially square shape in its cross-section perpendicular to the axial direction of the development sleeve 141. The hollow member 646*b* has a magnetic pole opposing face 646*b*1. The magnetic pole opposing face 646*b*1 functions same as the magnetic pole opposing face 146*b*1 of the doctor supporting member 146*b*. The magnetic pole opposing face 646*b*1 is disposed to face the magnetic pole N3 along the effective development region. Therefore, similar to the developing unit 14 according to the first exemplary embodiment, the developing unit 14B according to the third exemplary embodiment has a wide region where the magnetic field is concentrated is formed between the magnetic pole opposing face 646*b*1 and the magnetic pole N3, as shown in FIG. 29. That is, the magnetic field concentrated region between the magnetic pole opposing face 646*b*1 in the upstream part of the doctor blade 646 and the magnetic pole N3 is more extended than the conventional developing unit in the developer conveyance direction of the development sleeve 141. Therefore, in this exemplary embodiment, the developer that has entered to the magnetic field concentrated region in the upstream part of the doctor blade 646 moves in the magnetic field concentrated region as the developer is interfered by colliding with the developer restrained in the magnetic field concentrated region or by being restrained by the magnetic field in the region. As a result, even if the developer having significant deviation of different toner densities is conveyed to the magnetic field concentrated region, the deviation of the toner densities of the developer may be averaged or smoothed after the developer has passed the region, thereby reducing the deviation of the toner densities.

As described above, in the third exemplary embodiment, the wide magnetic field concentrated region is formed in the upstream region of the doctor blade 646 and the developer entered to the magnetic field concentrated region collides with the developer restrained in the magnetic field concentrated region or is restrained by the magnetic field in the region. When compared with the configuration of the conventional developing unit not having such a wide magnetic field concentrated region, the developer may increase in temperature in the upstream region of the doctor blade 646 of the developing unit 14B. Therefore, it is more important to reduce the increase in temperature than the configuration of the conventional developing unit.

To reduce the increase in temperature, the developing unit 14B according to the third exemplary embodiment includes the hollow member 646*b* that is formed by the same material as the doctor supporting member 146*b* provided in the developing unit 14 according to the first exemplary embodiment. The hollow member 646*b* has an opening at either end of the shaft of the development sleeve 141. Therefore, when air flows through a non-illustrated cooling unit such as an exhaust fan and an intake fan provided to the main body of the image forming apparatus, air current is generated in a hollow area in the hollow member 646, which can effectively reduce or eliminate the heat generated on the magnetic pole opposing face 646*b*1 of the hollow member 646*b* through airflow in the hollow area. Therefore, the heat of the developer in the upstream region of the doctor blade 646 can be effectively eliminated via the magnetic pole opposing face 646*b*1 of the hollow member 646*b*, and thereby preventing an increase in temperature of the developer in the upstream region of the doctor blade 646 effectively.

The developing unit 14B according to this exemplary embodiment communicates with the cooling unit for cooling the hollow member 646*b* by moving the heat in the hollow member 646*b* to outside the hollow area thereof. As examples of the cooling unit, an intake fan for taking air into the image forming apparatus or an exhaust fan for exhausting air out of the image forming apparatus are used. However, the cooling unit is not limited thereto. For example, an air blowing unit to blow air directly to the hollow area, a vacuum unit to take air directly from the hollow area, and the like can be used as the cooling unit. Further, the cooling unit can have a configuration in which coolant that is cooled in a cooling unit is circulated via the hollow area of the hollow member 646*b*. In this case, both ends of the hollow member 646*b* extending along the shaft of the development sleeve 141 may not be opened.

Referring to FIG. 30, a description is given of another example of a doctor blade 746 provided to a developing unit 14B'.

FIG. 30 is a drawing for explaining the developing unit 14B', viewed from one end portion of the development sleeve 141 of the developing roller 140, according to a modified example of the developing unit 14B of the third exemplary embodiment.

The developing unit 14B' includes a hollow member 746*b* of a doctor blade 746 different from the hollow member 646*b* of the developing unit 14B of FIG. 29 by its shape and action.

As illustrated in FIG. 30, the hollow member 746*b* is disposed upstream from a doctor base body 746*a* of the doctor blade 746 in a direction of rotation of the development sleeve 141 (as indicated by arrow "R1") and is processed to have a hollow and trapezoidal shape in its cross-section perpendicular to the axial direction of the development sleeve 141. The hollow member 746*b* has a magnetic pole opposing face 746*b*1 and an outer face 746*b*2.

The magnetic pole opposing face 746*b*1 functions same as the magnetic pole opposing face 146*b*1 of the doctor supporting member 146*b* and the magnetic pole opposing face 646*b*1 of the doctor supporting member 646*b*. The magnetic pole opposing face 746*b*1 is disposed to face the magnetic pole N3 along the effective development region.

The outer face 746*b*2 is one of outer faces of the hollow member 746*b* and is attached to or is held in contact with the doctor base body 746*a* of the doctor blade 746. Alternatively, the outer face 746*b*2 of the hollow member 746*b* can adhere to the doctor base body 746*a* with adhesive by using a known method. By so doing, the hollow member 746*b* can be fixedly attached to the doctor base body 746*a*. Thus, by contacting the outer face 746*b*2 of the hollow member 746*b* to the doctor base body 746*a*, heat generated from the magnetic pole opposing face 746*b*1 of the hollow member 746*b* can be moved from the outer face 746*b*2 to the doctor base body 746*a*. Therefore, an effect in which not only heat of the hollow member 746*b* but also heat of the doctor base body 746*a* can be achieved. As a result, the heat of the developer in the upstream area of the doctor blade 746 can be removed effectively via the magnetic pole opposing face 746*b*1 of the hollow member 746*b*, and thereby further reducing the increase in temperature of the developer in the upstream area of the doctor blade 746 effectively.

As described above, each of the developing units 14Y, 14C, 14M, and 14K according to the first and second exemplary embodiments includes the developing roller 140 serving as a developer bearing member, the developer container 149, conveyance screws 142 and 143 serving as agitation/conveyance members, and a doctor blade 146 serving as a developer regulating member. The developing roller 140 includes a magnetic roller 147 serving as a magnetic generator and a development sleeve 141 serving as a nonmagnetic hollow body containing the magnetic roller 147 to bear a two-component developer including magnetic carrier particles and toner particles on an exterior perimeter surface thereof by a magnetic force generated by the magnetic roller 147. The developer container 149 is disposed adjacent to the developing roller 140 and includes the developer storing chamber 149A to store the two-component developer therein. The conveyance screws 142 and 143 are disposed in the developer container 149 to convey the two-component developer in an axial direction of the development sleeve 141 of the developing roller 140 while agitating the two-component developer. The doctor blade 146 is disposed opposite the developing roller 140 to regulate the thickness of a layer of the two-component developer held on the development sleeve 141 of the developing roller 140. The two-component developer conveyed in the developer container 149 is attracted by the magnetic force exerted by the magnetic roller 147 to the developer bearing member, is regulated by the doctor blade 146, then passes through a development region of the development sleeve 141 of the developing roller 140 facing a corresponding one of the photoconductor drums 12Y, 12C, 12M, and 12K, and returns to the developer container 149. The magnetic roller 147 includes the magnetic pole N2 serving as a first magnetic pole and the magnetic pole N3 serving as a second magnetic pole with an identical polarity (north pole or N-pole) disposed adjacent to each other and downstream from the development region in a direction of rotation of the developing roller 140 to generate respective magnetic forces for removing the two-component developer from the development sleeve 141 of the developing roller 140 after the developer passes through the development region. The magnetic pole N3 is disposed downstream from the magnetic pole N2 in a direction of conveyance of developer by the development sleeve 141 of the developing roller 140 and proximate to the doctor blade 146 to generate a magnetic force to attract the two-component developer from the developer storing chamber 149A in the developer container 149 for forming a magnetic brush of the two-component developer on the development sleeve 141 of the developing roller 140 regulated by the doctor blade 146. And in the first and second exemplary embodiments, the doctor blade 146 includes the doctor base body 146*a* serving as a base member and the doctor supporting member 146*b* serving as a thin plate magnetic member projecting outwardly from the doctor base body 146*a* toward an exterior perimeter surface of the development sleeve 141 of the developing roller 140 upstream from the doctor blade 146 in a direction of conveyance of developer by the development sleeve 141 of the developing roller 140, the magnetic pole opposing face 146*b*1 that is one planar surface of the magnetic roller 147 facing the magnetic pole N3 across an effective development region. With this configuration, even if the developer having significant deviation of different toner densities is conveyed to the magnetic field concentrated region that is formed between the magnetic pole opposing face 146*b*1 and the magnetic pole N3, the deviation of the toner densities are averaged or smoothed after the developer has passed through the region, thereby reducing the deviation and unevenness in image density.

Further, in the first and second exemplary embodiments, the doctor supporting member 146*b* serving as a magnetic member is fixedly mounted on the doctor blade 146, thereby compensating rigidity of both sides.

Further, in the first and second exemplary embodiments, the doctor supporting member 146*b* of thin plate is bent to include the magnetic pole opposing face 146*b*1 serving as a first face disposed to face the magnetic pole N3 and the second face 146*b*2 to adhere to the blade base body 146*a* of the doctor blade 146. The second face 146*b*2 is fixedly adhered to the blade base body 146*a* on one side which faces the upstream side in a direction of conveyance of developer by the development sleeve 141 of the developing roller 140, thereby achieving an effect to compensating rigidity of both sides.

Further, as described above, a magnetic member that may not act as the doctor supporting member 146*b* can be disposed at a position spaced away from the doctor blade 146. By disposing the magnetic member separate from the doctor blade 146, a constant distance between the development sleeve 141 and the magnetic member can be maintained stably regardless of the gap between the doctor blade 146 and the development sleeve 141, thereby achieving an effect to average fluctuations of toner densities of developer stably.

Further, in the first and second exemplary embodiments, the doctor supporting member 146*b* is disposed such that an upstream end part of the magnetic pole opposing face 146*b*1 of the doctor supporting member 146*b* in a direction of conveyance of developer by the development sleeve 141 of the developing roller 140 is located upstream from a normal line to a local maximum point of a magnetic flux density of the magnetic pole N3 in a normal direction on the development sleeve 141 of the developing roller 140. Therefore, the magnetic force concentrated region can be formed by a strongest magnetic force, thereby achieving a high effect to average fluctuations of toner densities of developer stably.

Further, in the first and second exemplary embodiments, the doctor blade 146 is disposed such that an upstream end part of the doctor blade 146 in a direction of conveyance of developer by the development sleeve 141 of the developing roller 140 is located downstream from a normal line to a local maximum point of a magnetic flux density of the second magnetic pole in a normal direction on the development sleeve 141 of the developing roller 140. With this configuration, the developer can be cut at which the thick magnetic brush is bent, and therefore a constant amount of developer degraded with time can be supplied to the development region.

Further, in the first and second exemplary embodiments, the doctor base body 146*a* of the doctor blade 146 includes a nonmagnetic material. If the doctor base body 146*a* includes a magnetic material, more magnetic field lines gather to the doctor base body 146*a* than the doctor supporting member 146*b* since the doctor base body 146*a* is larger in size than the doctor supporting member 146*b*, which can degrade the effect to average the fluctuations in toner densities of the developer. Further, since multiple magnetic field lines direct to the doctor base body 146*a*, the magnetic force that causes developer attraction can become insufficient, which can cause poor developer attraction easily. The nonmagnetic doctor base body 146*a* in the configurations according to the first and second exemplary embodiments can eliminate the above-described drawbacks. Preferable materials for the doctor blade 146 are stainless steel, aluminum, and the like.

Further, in the first and second exemplary embodiments, the doctor blade 146 is disposed in a vertically downward direction with respect to the development sleeve 141 of the developing roller 140. This configuration can make the developer that could not pass by the doctor blade 146 return immediately to the developer container 149 by its own weight, thereby reducing mechanical stress on the developer at the upstream side from the doctor blade 146. Further, the magnetic pole N2 can be located higher than the top surface of the developer in the developer storing chamber 149A of the developer container 149, and so is the magnet 155. With this configuration, the developer in the developer storing chamber 149A of the developer container 149 may not be attracted to the magnet 155, which can prevent developer accumulation in that area.

Further, in the first and second exemplary embodiments, multiple elliptic dents are formed randomly on the exterior perimeter surface of the development sleeve 141 of the developing roller 140. Therefore, as previously described, a good image with stable quality can be obtained without generating uneven image over an extended period of time.

Further, in the second exemplary embodiment, the developing unit 14 further includes the seal member 150 and the doctor supporting member 146*b*. The seal member 150 is disposed between the development sleeve 141 of the developing roller 140 and the conveyance screws 142 and 143 and held in contact with an inner wall of the casing 144 of the developing unit 14 to seal the developer container 149 where the conveyance screws 142 and 143 are disposed. The doctor supporting member 146*b* is disposed at one side of the development sleeve 141 of the developing roller 140 to retain the seal member 150 so that the seal member 150 can be pulled out from the developing unit 14 in an axial direction of the development sleeve 141 of the developing roller 140 to closely contact the seal member 150 against the inner wall of the casing 144 of the developing unit 14. With this configuration, any member or component that is unnecessary after the developing unit 14 has been used may not remain in the developing unit 14, and therefore such a member or component does not limit the flexibility of the interior layout of the developing unit 14.

Further, in the second exemplary embodiment, the seal member 150 is held in contact with an inner wall of the developing unit 14 without adhesive, thereby reducing manufacturing cost.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. A developing unit, comprising:

a developer bearing member to bear a two-component developer on a surface thereof, the two-component developer including magnetic carrier particles and toner particles, the developer bearing member including a magnetic field generator, and a nonmagnetic hollow body containing the magnetic field generator for bearing the two-component developer on an exterior perimeter surface thereof via a magnetic force generated via the magnetic field generator, a developer container disposed adjacent to and oriented vertically lower than the developer bearing member, the developer container including a developer storing chamber to store the two-component developer therein;

an agitation/conveyance member disposed in the developer container to convey the two-component developer in an axial direction of the developer bearing member while agitating the two-component developer; and a developer regulating member disposed opposite the developer bearing member to regulate a thickness of a layer of the two-component developer held on the developer bearing member, wherein the two-component developer conveyed in the developer container is attracted by the magnetic force exerted by the magnetic field generator to the developer bearing member, the two-component developer being regulated by the developer regulating member and then passing through a development region of the developer bearing member facing an image bearing member and returning to the developer container, wherein the magnetic field generator includes first and second magnetic poles with an identical polarity disposed adjacent to each other and downstream from the development region in a direction of rotation of the developer bearing member, the first and second magnetic poles generating respective magnetic forces for removing the two-component developer from the developer bearing member after the two-component developer passes through the development region, wherein the second magnetic pole is disposed downstream from the first magnetic pole, in a direction of conveyance of the two-component developer by the developer bearing member, and proximate to the developer regulating member so as to generate a magnetic force to attract the two-component developer from the developer storing chamber in the developer container, thereby forming a magnetic brush of the two-component developer on the developer bearing member regulated by the developer regulating member, and wherein the developer regulating member includes a base member and a thin plate magnetic member projecting outwardly from the base member toward an exterior perimeter surface of the developer bearing member upstream from the base member in the direction of conveyance of the two-component developer by the developer bearing member, a planar surface of the magnetic member facing the second magnetic pole across an effective development region, and the magnetic member projecting in a direction transverse to a vertical direction between the developer container and the developer bearing member.

2. The developing unit according to claim 1, wherein the magnetic member is fixedly mounted on the base member.

3. The developing unit according to claim 2, wherein the magnetic member comprises a first face disposed to face the second magnetic pole and a second face that is fixedly mounted to the base member of the developer regulating member, the second face being fixedly mounted to the base member on one side of the base member which faces an upstream side in the direction of conveyance of the two-component developer by the developer bearing member.

4. The developing unit according to claim 1, wherein the magnetic member is disposed at a position spaced away from an end of the base member, the end of the base member being adjacent to the developer bearing member.

5. The developing unit according to claim 1, wherein the magnetic member comprises a hollow body defining an interior hollow region therein extending in the axial direction of the developer bearing member, and wherein the magnetic member is cooled by exhausting heat from the hollow region inside the hollow body of the magnetic member to outside the hollow body.

6. The developing unit according to claim 1, wherein the magnetic member is disposed such that an upstream end part of the planar surface of the magnetic member, in the direction of conveyance of the two-component developer by the developer bearing member, is located upstream from a normal line to a local maximum point of a normal component of a magnetic flux density of the second magnetic pole to the developer bearing member.

7. The developing unit according to claim 1, wherein the developer regulating member is disposed such that an upstream end part of the developer regulating member, in the direction of conveyance of the two-component developer by the developer bearing member, is located downstream from a normal line to a local maximum point of a normal component of a magnetic flux density of the second magnetic pole to the developer bearing member.

8. The developing unit according to claim 1, wherein the base member of the developer regulating member comprises a nonmagnetic material.

9. The developing unit according to claim 1, wherein the base member of the developer regulating member is disposed in a vertically downward direction with respect to the developer bearing member.

10. The developing unit according to claim 1, further comprising:

a seal member disposed between the developer bearing member and the agitation/conveyance member and held in contact with an inner wall of the developing unit to seal the developer container where the agitation/conveyance member is disposed; and a retaining member disposed at one side of the developer bearing member to retain the seal member so that the seal member can be pulled out from the developing unit in an axial direction of the developer bearing member to closely contact the seal member against the inner wall of the developing unit.

11. The developing unit according to claim 10, wherein the seal member comprises a planar member.

12. A process cartridge detachably attachable to an image forming apparatus, the process cartridge comprising:

an image bearing member to bear an image on a surface thereof; and the developing unit according to claim 1, the image bearing member and the developing unit being integral in the process cartridge, and the developing unit being disposed facing the image bearing member to convey and adhere the two-component developer to the image bearing member for developing a toner image to be transferred from the image bearing member onto a recording medium.

13. An image forming apparatus, comprising:

an image bearing member to bear an image on a surface thereof; and the developing unit according to claim 1, the developing unit being disposed facing the image bearing member to convey and adhere the two-component developer to the image bearing member for developing a toner image to be transferred from the image bearing member onto a recording medium.

14. A developing unit, comprising:

a developer bearing member to bear a two-component developer on a surface thereof, the two-component developer including magnetic carrier particles and toner particles, the developer bearing member including a magnetic field generator, and a nonmagnetic hollow body containing the magnetic field generator for bearing the two-component developer on an exterior perimeter surface thereof via a magnetic force generated via the magnetic field generator, a developer container disposed adjacent to and oriented vertically lower than the developer bearing member, the developer container including a developer storing chamber to store the two-component developer therein;

an agitation/conveyance member disposed in the developer container to convey the two-component developer in an axial direction of the developer bearing member while agitating the two-component developer; and a developer regulating member disposed opposite the developer bearing member to regulate a thickness of a layer of the two-component developer held on the developer bearing member, wherein the two-component developer conveyed in the developer container is attracted by the magnetic force exerted by the magnetic field generator to the developer bearing member, the two-component developer being regulated by the developer regulating member and then passing through a development region of the developer bearing member facing an image bearing member and returning to the developer container, wherein the magnetic field generator includes first and second magnetic poles with an identical polarity disposed adjacent to each other and downstream from the development region in a direction of rotation of the developer bearing member, the first and second magnetic poles generating respective magnetic forces for removing the two-component developer from the developer bearing member after the two-component developer passes through the development region, wherein the second magnetic pole is disposed downstream from the first magnetic pole, in a direction of conveyance of the two-component developer by the developer bearing member, and proximate to the developer regulating member so as to generate a magnetic force to attract the two-component developer from the developer storing chamber in the developer container, thereby forming a magnetic brush of the two-component developer on the developer bearing member regulated by the developer regulating member, wherein the developer regulating member includes a base and a magnetic member outwardly disposed toward an exterior perimeter surface of the developer bearing member upstream from the base of the developer regulating member in the direction of conveyance of the two-component developer by the developer bearing member, a surface of the magnetic member facing the second magnetic pole across an effective development region, and the magnetic member projecting in a direction transverse to a vertical direction between the developer container and the developer bearing member, and wherein the magnetic member is disposed such that a line normal to an opposing face of the magnetic member facing the second magnetic pole is substantially parallel to a line tangential to a region on the developer bearing member where a magnetic flux density of the second magnetic pole in the normal direction exists.

15. The developing unit according to claim 14, wherein the magnetic member comprises a hollow body defining an interior hollow region therein extending in the axial direction of the developer bearing member, and wherein the magnetic member is cooled by exhausting heat from the hollow region inside the hollow body of the magnetic member to outside the hollow body.

16. The developing unit according to claim 15, wherein an outer face of the magnetic member is held in contact with the base of the developer regulating member.

17. The developing unit according to claim 14, further comprising:

a seal member disposed between the developer bearing member and the agitation/conveyance member and held in contact with an inner wall of the developing unit to seal the developer container where the agitation/conveyance member is disposed; and a retaining member disposed at one side of the developer bearing member to retain the seal member so that the seal member can be pulled out from the developing unit in an axial direction of the developer bearing member to closely contact the seal member against the inner wall of the developing unit.

18. The developing unit according to claim 17, wherein the seal member comprises a planar member.

19. A process cartridge detachably attachable to an image forming apparatus, the process cartridge comprising:

an image bearing member to bear an image on a surface thereof; and the developing unit according to claim 14, the image bearing member and the developing unit being integral in the process cartridge, and the developing unit being disposed facing the image bearing member to convey and adhere the two-component developer to the image bearing member for developing a toner image to be transferred from the image bearing member onto a recording medium.

20. An image forming apparatus, comprising:

an image bearing member to bear an image on a surface thereof; and the developing unit according to claim 14, the developing unit being disposed facing the image bearing member to convey and adhere the two-component developer to the image bearing member for developing a toner image to be transferred from the image bearing member onto a recording medium.

* * * * *